US005507436A

United States Patent [19]

Ruttenberg

[11] Patent Number: 5,507,436

[45] Date of Patent: Apr. 16, 1996

[54] METHOD AND APPARATUS FOR CONVERTING PRESSURIZED LOW CONTINUOUS FLOW TO HIGH FLOW IN PULSES

[76] Inventor: Gideon Ruttenberg, 81-465 Date Palm Ave., Indio, Calif. 92201

[21] Appl. No.: 396,176

[22] Filed: Feb. 24, 1995

Related U.S. Application Data

[63] Continuation of Ser. No. 988,946, Mar. 10, 1993, abandoned.

[51] Int. Cl.[6] ..... B05B 1/08

[52] U.S. Cl. ..... 239/1; 239/99; 239/204; 239/412; 239/416.5; 239/428.5; 239/524; 239/547; 239/570; 137/624.14; 137/853; 137/895; 251/5

[58] Field of Search ..... 239/1, 99, 101, 239/276, 428.5, 533.13, 547, 570, 204, 412, 416.5, 524; 137/624.14, 853, 895; 251/4, 5, 342

[56] References Cited

U.S. PATENT DOCUMENTS

| | | | |
|---|---|---|---|
| 1,883,960 | 10/1932 | Koppel et al. | 251/4 |
| 2,622,620 | 12/1952 | Annin . | |
| 2,715,980 | 8/1955 | Frick | 137/853 |
| 2,749,180 | 6/1956 | Andrews | 239/208 |
| 2,988,288 | 6/1961 | Nielsen . | |
| 3,298,391 | 1/1967 | Savage . | |
| 3,624,801 | 11/1971 | Gannon | 251/5 |
| 3,687,365 | 8/1972 | Laessig | 239/99 |
| 3,865,133 | 2/1975 | Alford | 137/853 |
| 3,883,074 | 5/1975 | Lambert | 239/101 |
| 3,902,664 | 9/1975 | Deines | 239/381 |
| 3,920,185 | 11/1975 | Kwok . | |
| 3,991,768 | 11/1976 | Portnoy | 251/5 |
| 4,108,418 | 8/1978 | Ensign et al. | 251/5 |
| 4,111,391 | 9/1978 | Pilolla | 251/5 |
| 4,301,967 | 11/1981 | Hunter | 239/99 |
| 4,512,514 | 4/1985 | Elcott | 239/99 |
| 4,702,280 | 10/1987 | Zakai et al. | 137/853 |
| 4,779,800 | 10/1988 | Tuomi | 239/547 |
| 4,781,217 | 11/1988 | Rosenberg | 137/624.14 |
| 4,796,804 | 1/1989 | Weiss | 239/1 |

FOREIGN PATENT DOCUMENTS

| | | |
|---|---|---|
| 191716 | 8/1986 | European Pat. Off. . |

*Primary Examiner*—Karen B. Merritt

[57] ABSTRACT

A device and method, especially adapted for operating sprinklers, shower heads etc. at low flow, converts low continuous liquid flow to a high intermittent and pulsating flow. The liquid is introduced at a controlled low rate of flow, such as by the use of a pressure-compensated dripper in a liquid supply line. The liquid then flows into a chamber which is somewhat expandable in volume. The pressure increases in the chamber while outflow of the liquid is restricted until pressure created by introduction of the liquid is sufficient to eject the fluid intermittently at a higher flow. This is achieved by utilizing a pressure-responsive valve in the liquid exit of the container. The valve has a preset pressure response designed for quick response to create a water hammer effect. The valve has openings which create a pumping effect to admix air or another liquid with the effluent stream. Sprinklers, shower heads, or any other spraying devices connected to this pulsator will spray liquids to a large designated area with only a very small fluid flow. A drip line connected to such a device may have very large openings, yet the flow through each such dripper can be very large. A preferred form of the pulsator is a pulsating valve in which the receptacle container and the other required elements for such a pulsating device are part of the valve itself.

48 Claims, 17 Drawing Sheets

FIG. 15b
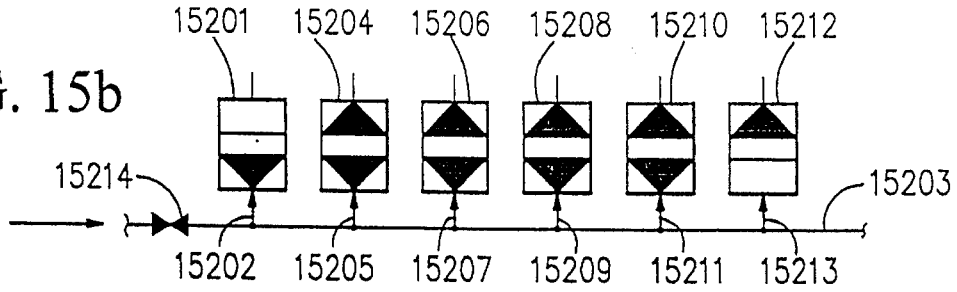
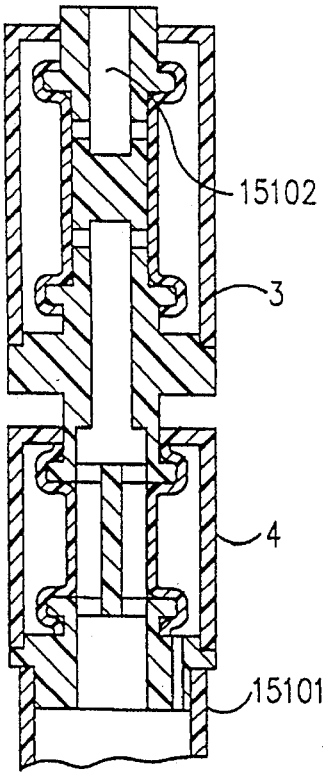
FIG. 15a
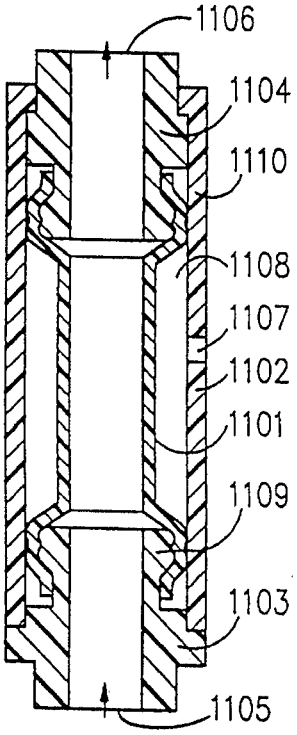
FIG. 16a
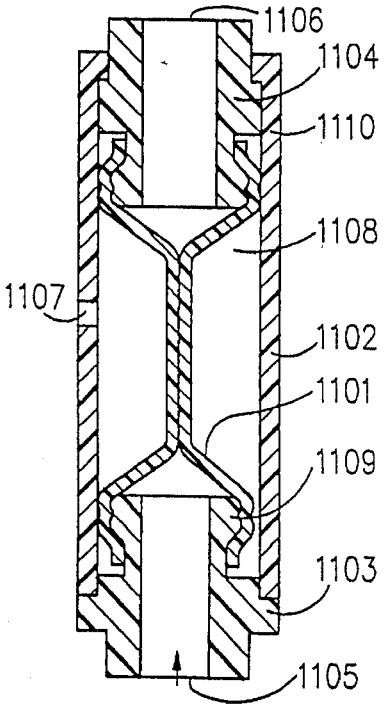
FIG. 16b

METHOD AND APPARATUS FOR CONVERTING PRESSURIZED LOW CONTINUOUS FLOW TO HIGH FLOW IN PULSES

BACKGROUND—CROSS-REFERENCE TO RELATED APPLICATIONS

This is a continuation of parent application Ser. No. 07/988,946, filed 1993 Mar. 10, now abandoned. This parent application is based upon PCT application Ser. No. PCT/US90/05,033, filed 1990 Sep. 10.

BACKGROUND—FIELD OF THE INVENTION

This invention relates to irrigation and pulsators, particularly to apparatus for irrigating with low flows and other applications using pulsators.

BACKGROUND—DESCRIPTION OF PRIOR ART

Most trees in the world require very small amounts of water per day. If water to the tree were supplied over a 24-hour period every day, a very small flow would be required to supply the needs of each tree. In order to develop a good root system and to allow the ground to store water for the tree, water to the tree should be supplied in such a way that a large wetted area is created next to the tree. Commonly used systems cannot wet a large area next to the tree by using such a small flow as described. A much higher flow per tree is required in order to create a large wetted area. This is what makes all such systems complicated and expensive. It requires large size pipes and numerous valves to control the system.

Other water and fluid systems have similar problems.

Some of the prior-art systems described in my U.S. Pat. No. 4,938,420 utilize a device which converts low pressurized flow to high, non-pressurized flow. They consist of a non-pressurized container and a siphon tube. Water is supplied to the container at a low flow. When water accumulating in the container reaches a certain level in the container, it flows out by gravity, through the siphon, at a very high pulsating flow to wet a large area next to each tree. The same problem as described is typical to any type of irrigation systems for any type of plants.

Shower heads are designed in such a way that water is ejected at relatively high velocity over a large designated area. A common shower head has to use a very high flow of approximately 120–180 gallons of water per hour. As a result, the water supply system should be designed to supply this high flow. Because of the high flow, the amount of water used by most shower heads is very high.

Instant warm water shower heads consist of heating element connected at the inlet to the shower head. Because of the high flow of water passing through the head, relatively high power heating elements and large amount of energy are required.

A drip irrigation system requires emitters with low flow. When a perforated plastic tube is used as a dripline, in order that the flow through each perforation will be low, the size of each hole should be very small. However since such small holes are easily plugged, for practical reasons such a dripline cannot be used for irrigation.

Driplines installed under the ground surface also become plugged up as a result of roots that penetrates the opening of the drippers.

At the end of each irrigation cycle, when the drip tubes drains, a vacuum may be created at different locations along the tube. This can cause sand particles to enter the dripline and plug the drippers.

Self cleaning filters consist of a screen or other filter means as well as hydraulic valves controlled by a controller actuated by a pressure sensor or by a timer. These cause the fluid to change its flow direction and flush the filter. Self-cleaning filters consist of many parts, so that operating and maintaining the filters requires highly trained technicians.

Most self-cleaning filter systems require at least two filters, because the filtered fluid of one filter is used to flush the second filter. A self cleaning gravity type filter consists of a screen and a rotating sprinkler which ejects water onto the screen to flush it. As a result the rotating sprinkler requires a high water flow to flush the screen.

Injection pumps in which the energy of one fluid is used to pump a second fluid, are used for various applications. For example pressurized air is used to pump irrigation water. It is also used to pump and inject fertilize into irrigation systems.

Frost damage in agriculture is often a cause of great economic losses. Different types of frost protection equipment are used, from water sprayers to heaters. Most of the systems have limited results at specific conditions. The failure of frost protection methods results from the fact they target an unconfined volume. Heaters may provide enough heat to eliminate the temperature in a citrus grove from dropping below a critical point, yet light winds may carry the warm air away and replace it with cold air.

Pop-up sprinklers are used mainly for irrigating lawns. The flow of pop-up sprinklers is relatively high. This results from the way they are made.

Valves and hydraulic valves consist of many parts which make them complicated, expensive, and difficult to install and maintain. Solid particles trapped at the sealing point of the valves may cause them to malfunction. As a result they have to be installed in such a way that they can be easily maintained, serviced, or replaced and this by itself makes the valves assembly more complicated.

Receptacle and pressure containers are commonly used for storing different fluids. Some materials may be spoiled when coming in contact with air. Adhesive materials, for example, paints etc., will become dry. Soda, e.g., cola, stored in a two-liter bottle will loose some of its properties after the bottle is opened and the bottle is not full. In such a case some of the carbonated gas flows from the liquid to the space created above the liquid, reducing the concentration of carbonated gas in the liquid.

Aerosol pressure containers employ a special enertic gas which is ejected into the container, causing the liquid in the container to be pressurized. Some gases used for this purpose create a problem with the ozone layer.

Flow controls are used to provide a constant flow of fluid which does not change when the pressure in the fluid supply system is changed. Flow controls are used in irrigation to control the flow through sprinklers and other irrigation devices. They are also used to control the flow through shower heads. They are further used to control the flow of different fluids used for industry and medical applications. Such flow controls consist of an elastic member with an orifice which, in response to pressure changes, undergoes a deformation in the elastic member, causing the cross-section of the orifice to decrease at high pressure, or to increase at low pressure.

A flow control for a low flow device, for example, an irrigation dripper, has a very small orifice which becomes even smaller in response to a pressure increase. Such a flow control is very sensitive to plugging.

Small changes in the orifice size, for example from production tolerance, or when used with abrasive liquids, namely irrigation water which contains sand, will cause relatively large variations in the flow through the device. As a result, such devices cannot operate properly.

Drippers consists of a long tube or labyrinth through which water flows at a low rate. Such drippers where developed in order to increase the cross section opening through which the water flows. As such, for any nominal flow, the opening cross section is much larger than the opening cross section of a regular nozzle or the size of a perforation in a tube.

A flow control having a construction similar to that of a dripper in which a long tube made of elastic material changes its dimension in response to pressure changes will have an opening with a larger cross section than a flow control with an orifice and will be more accurate.

OBJECTS AND ADVANTAGES

By using the method and apparatus described in this invention, a spray means can spray water and wet a large area next to a tree by using a very small flow. An irrigation system using such a device will be able to receive a very small flow which is much smaller than that of conventional drip or minisprinkler systems, and create a large wetted area next to the trees. Also the present device solves or reduces all of the other aforenoted problems.

Further objects and advantages will be come apparent from a consideration of the following description and accompanying drawings.

SUMMARY OF THE INVENTION

This invention relates to a device and method for converting pressurized low continuous liquid flow to pressurized high intermittent pulsating flow. It employs a pressurized hydraulic transformer (PHT) which is useful in any application in which low continuous fluid flow can be converted to pulsating higher flows in a continuous repetitive manner.

Although liquid flows from the PHT at a high rate in a small fraction of time in each pulsating cycle, some properties that are related to high rate of liquid flow can be achieved by using low flow.

It further relates to a method and apparatus for distributing liquid to a large designated area with a low flow, using a spray device that under regular conditions will need a much higher flow.

In one preferred application, this invention relates to a device, such as a minisprinkler, that under regular operating conditions will spray liquid to a certain designated area by using a flow Q1 and using the PHT, the same spray device will spray liquid to the same or larger designated area, using a much smaller flow Q2. When liquid is ejected from such a device, its instant flow is Q1 and it is ejected during a short time t of a cycle time T, in such a way that its actual flow is: $Q2=Q1\times t/T$.

For example, if a regular minisprinkler having a flow Q1=8 GPH is forced to pulsate so that it will eject liquid for one second (t) every 4 seconds (T), its actual flow Q2 will be 2 GPH. However since its instant flow during the spray portion of the cycle is at the rate of 8=GPH, it will spray water to the same distance as a minisprinkler having a flow Q1=8 GPH. Thus it operates at the same pressure, but actually uses only 2 GPH As described and as shown in the drawings, such a device includes the following elements:

A. A pressure compensated dripper, or other means that will be described, which is fed from a liquid supply tube and discharges in a low continuous flow to a receptacle container.

B. A receptacle container, such that pressurized liquid flowing into it will cause it to deform slightly to allow its volume to be increased due to a pressure increase within the container. Different forms of such containers will be described.

C. A preset, pressure-responsive valve designed to open itself at a critical preset pressure P1. Different types of such preset valves can be used. Such valves that have elastic sleeve which responds to pressure differential will be described in detail. Such valve has a quick response and this is used to cream a water hammer, that increases the pressure and the velocity of the ejected fluid. Such a valve also has perforations in its casing by which fluid can flow into the casing of the valve, be mixed with and ejected with the liquid that flows through the valve and operates it as a fluid driven injection pump.

A small size tube, or other means which will be described, creates a resistance D to the flow or back pressure on the valve. This forces the valve, when it opens due to pressure, to become widely open and allow the liquid to flow at a relatively high rate from the container through the valve and the resistance.

For example, liquid may flow from a liquid supply tube through a compensated dripper A to a receptacle container B, at a controlled low continuous flow Q2. As liquid accumulates in container B, the volume and pressure therein increases to a critical pressure P1, at which a preset valve C connected to the conminer's outlet opens. Liquid than flows from pressure container B through valve C and a resistor D, at a low flow Q2. As a result of the pressure drop dP created in the hydraulic resistance, and in order that the liquid will continue to flow, the pressure in the container has to increase from P1 to P2 and P2=P1+dP. In response to pressure P2, preset valve C is forced to become widely open and liquid at a high flow Q1 is ejected from the container. At the same time, liquid continues to flow to container B, through dripper A, at a low flow Q2. As a result, the volume of liquid in container B will be decreased by $DV=(Q1-Q2)t$, the pressure in container B will be decreased below P1 and preset valve C closes the outlet from container B.

Liquid will continue to flow through dripper A to container B, increasing volume and pressure within the container and a new pulsating cycle will begin. The quick action of the preset valve which causes the outlet from the container to be quickly shut off, creates a water hammer which causes pressure to drastically increase.

Water hammer is a well-known term used to express the resulting shock caused by the sudden decrease in the motion or velocity of fluid. Thus, the increase in pressure caused by the sudden closing of an outlet, i.e., a valve or the like, will cause a sudden increase in pressure. This effect is utilized in the system described herein. The water hammer phenomenon is described further in numerous publications, for example, in McGraw-Hill, Encyclopedia of Science and Technology, 5th ed. vol. 14, pp. 500–501.

As a result, when a sprinkler is connected to such a device, the sprinkler throws water to a larger diameter than the same sprinkler operating at a higher flow and at same pressure without the PHT.

When a liquid flows through a pipe which is made from non-elastic material and the liquid is water at a temperature of 60° F., as a result of water hammer, the pressure increase P (in PSI) will be: P=65V, where V is the velocity of the liquid in feet/sec. When using elastic material, the pressure increase due to the water hammer effect will be P=65V[1/(1+K)], where:

$$K = \frac{\text{modulus of water } (EW)}{\text{modulus of pipe material } (EM)} \times \frac{\text{diameter of pipe } D}{\text{wall thickness of pipe } (W)}$$

or $$K = \frac{(EW)}{(EM)} \times \frac{D}{(W)}$$

When the device is made of very elastic material, which means small EM, K will be large and pressure increase will be small. In order to achieve. The water hammer the device should be made from rigid material or a material with a low elasticity.

By way of example, in the case where the outlet conduit D comprises a rigid tube having a length of 6" and an I.D. of 0.080", where the flow to the container is at the rate of 2 GPH, the preset valve will open and close rapidly, creating the water hammer effect and produce frequent rapid pulses (about 10/sec). As a result, a finger jet type of spray nozzle with an orifice of 0.040" which would normally spray water to a diameter of 6', will, using the device spray water to diameter of 25'.

The volume of liquid ejected at each pulse dV depends upon a few factors. These are the size of container B, its elasticity, the critical pressure P1 of the preset valve, etc.

One way of increasing the amount of liquid ejected at each pulse is to use a container with a certain geometric shape that allows its volume to be increased without changing its circumference. Such a container can be produced from a rigid material that has a very small flexibility and would generally be one which has a rectangular transverse cross section.

E.g., such a container can have a square cross section of 1"×1", horizontal circumference of 4", and a cross section area of 1 $in^2$, and a predetermined length. If the pressure in such a container forces its cross section to become circular, its circumference will still be 4" and its cross section will increase to 1.27 $in^2$, which means an increase of 27% in volume can be achieved with such a container without changing its circumference.

Such a container, made of a rigid material and having such a geometric shape, will allow its volume to be increased due to pressure changes, and still maintain the possibility of creating water hammer. For certain applications, a container formed of material having a desired degree of resiliency may be used.

Another possibility of increasing the ejected amount of liquid in each pulse is by using trapped air in the container.

Pressure changes in the container will cause trapped air to contract and expand, thus increasing the ejected amount of liquid. Since air might be dissolved in the liquid, and thus escape from the container, the air can be trapped in a small secondary container, for example, a small, hollow, flexible ball installed in container B. Pressure increase in container B will cause the ball to contract and allow more liquid to accumulate in container B before it is be ejected.

In order to force preset valve C to become widely open, a resistance to the flow can be created downstream from the preset valve. The magnitude of such resistance depends upon a few factors and mainly upon the properties of valve C and inlet flow Q2 to the container Resistor D should be such that it will create enough resistance to inlet flow Q2 to force valve C to widely open, yet it should be as small as possible to create minimum resistance to the high ejected flow Q1 from container B. The resistance can be hydraulic resistance created by friction loss due to a liquid flowing through a small size diameter tube, or a small orifice. It can be created due to an elevation difference between a spray nozzle and valve C, or it can be a mechanical resistance created by an obstacle, for example, a floating ball installed in the path of flow between the outlet of valve C and the spray nozzle. Also it can be a combination of such elements.

When the perforations in the preset valve are surrounded by air, a mixture of liquid flowing through dripper A and air flowing through the perforations in valve C will be ejected through tube D.

When the perforations in preset valve C are surrounded by a second liquid, namely liquid fertilizer, a mixture of liquids consisting of one liquid flowing through dripper A and a second liquid flowing through the perforations in the casing of valve C will be mixed and ejected through tube D.

When such a device is installed in a container in which a second liquid is being stored, as long as the level of the second liquid is higher than the level of the perforations in the preset valve, a mixture of the two liquids will be ejected through tube D. When the level of the second liquid in the container is at or below the level of the perforation in valve C, a mixture of liquid from dripper A and air from the container will be ejected through tube D.

By adjusting the level of valve C in the container of the second liquid, the total amount of the second liquid that will be ejected in each operation can be controlled.

When the pressure in the liquid supply system is kept below the critical pressure P1 of valve C, the outlet from container B will stay closed, and liquid will not be able to drain from container B. This means that by reducing the pressure in the liquid supply system below the critical pressure P1 of valve C, we can prevent the system from draining at the end of each operation.

Valve C can be designed to have different critical pressure. P1. E.g., one group of preset valves can be designed to have a critical pressure P1=20 PSI and a second group can have a preset valve with a critical pressure P1=40 PSI. If the two groups are connected to the same liquid supply system, they can be operated as follows:

When pressure in the liquid supply is lower than 20 PSI, no liquid flows out from the system.

When pressure is between 20 and 40 PSI, liquid will flow out from the system only through group one.

When pressure is higher than 40 PSI, liquid will flow out through the two groups Each, a few, or all features of the PHT can be used in different applications, some of which are described below. E.g., I have designated a Pulsating Compensated Non-leaky Minisprinkler (PCNM) as shown .in FIG. 1 and as described below.

Such a device includes: A. A pressure compensated dripper; B. A receptacle container having a form of a spike; C. A preset pressure responsive valve having a perforation in its casing and has a quick response; D. A small size inside diameter rigid tube; and E. A spraying device.

This PCNM has the following features:

It can be operated at a very low flow, namely Q2 (2 GPH).

It will wet a very large area, namely, a wetted area having a diameter of 20'.

Its flow is compensated. It will spray the same flow regardless of the pressure in the irrigation tube.

Its spray nozzle will be relatively large, namely 0.060", which will eliminate plugging.

It will eject water and air. This can also eliminate plugging of the spray nozzle.

Due to water hammer, water will be ejected at a very high velocity.

When pressure in the irrigation tube is decreased below the critical pressure P1, namely, below 20 PSI, by shutting off the main valve, the water in the irrigation pipes will not drain, and the system will stay full.

Two groups of such PCNM units can be connected to the same irrigation system. One group having a low P1, namely, P1=20 PSI, may be used for irrigation and the second group of PCNM units having a higher preset pressure P1=30 PSI, will be operated only in emergency by increasing the pressure in the system.

One preferred pulsating device is a normally closed pulsating valve. formed in such a way that the three basic elements of a pulsating device (B, the receptacle, C, the reset normally closed valve, and D, the hydraulic resistance) are created in the pulsating valve itself.

Such a pulsating valve consists of at least one preset pressure responsive normally closed "valve" created at its outlet. A second normally closed "valve" may be created at its inlet. A receptacle container is created in the pulsating valve between the two valves.

The first "valve", being normally closed, may serve also as the hydraulic resistance described before. If needed, additional resistance can be created within the pulsating valve, or downstream from the normally closed "valve" at the outlet as part of the pulsating valve, by using the same means described before or by connecting such means at the outlet from the pulsating valve.

The invention also includes a preset pressure-responsive normally open pulsating valve consisting of elastic tube enclosed in a casing. The space surrounding the elastic tube is connected to the inlet of the valve. Thus the pressures of the fluid at the inlet to the valve and at the space surrounding the elastic tube are the same. When a fluid flows through the elastic tube, a pressure drop is created along the tube, the pressure inside the elastic tube decreases, and the pressure surrounding the elastic tube causes it to contract and become flat, preventing from the fluid to flow through the tube. Since at no flow there is no pressure drop, the pressure inside the elastic tube increases and the valve opens, terminating one pulsating cycle.

A pulsating dripline which consist of perforated tube or any type of dripline connected to the water supply system by means of a pulsating device can have drippers or perforations with a very large opening operating at a very low flow.

The invention includes a frost Control method by which an item that needs protection is enclosed in a sheath that is wetted by means of a pulsating minisprinkler. The pulsating minisprinkler sprays water at very low rates on the sheath and a small layer of water is retained by the sheath. At low temperature the thin layer of water is converted to ice, creating an "igloo" which isolates a designated small volume surrounding the item. E.g., the item can be a plant.

The pulsating valve can operate as a an injection pump as was described and it can also function as a fluid driven pump.

When a main fluid flows through the valve and causes it to pulsate, the elastic member of the valve contracts and expands.

When the elastic member contracts, a second fluid can enter the casing of the valve through one port. When the elastic member expands, it is pressed against the port in the casing, sealing it and pressing the second fluid against the inner walls of the casing. This pressurizes the second fluid and forces it to admix and eject with the main fluid through the outlet of the valve (as described before) or to eject separately at an elevated pressure through a second port in the casing.

One special application of the fluid driven pump is a soaping device which is created by connecting a container with liquid soap to the second fluid outlet of the pump. The device is connected to a faucet. When water flows through the valve, causing it to pulsate, air enters the casing of the pump and flows through the liquid soap, converting it to foam which then admixes and ejects with the water.

A self cleaning filter is a pulsating valve in which part of the elastic member of the valve, which creates the receptacle container, is perforated. A fluid, namely water, flows from the inlet of the valve through a "screen" created by the perforated elastic member, out through a port in the casing.

When the screen plugs, the screen then becomes a receptacle container, the filter is convened to a pulsating valve, and fluid from the receptacle container ejects at a high pulsating flow through the outlet of the valve, flushing the screen.

The invention includes a self cleaning low flow pulsating sprinkler in which the sliding guide of a pop-up head is a screen that is automatically flushed at each new irrigation cycle. A pulsating valve is connected between the riser and the sprinkler head.

The pulsating valve can be used for operating rotating sprinklers such as those which are used to irrigate row crops at a low flow.

The pulsating valve can also be produced with a deflector as part of the pulsating valve itself to control the pattern of the ejected fluid.

A flow control can be installed inside the pulsating valve at its inlet portion.

By connecting a normally closed preset pressure responsive valve to the outlet of a normally open preset pressure responsive valve, a new type of valve is created. This is a limited pressure range valve that opens only at a limited range of pressures at its inlet to the valve.

A fluid control method and apparatus is described. By using different combinations of normally closed, normally open, and limited range valves, different outlets from the same fluid supply system can be controlled and operate separately in response to pressure changes in the system.

A low flow pulsating shower head is described which consists of a shower head connected to the outlet of a pulsating valve. Such a head can be operated with a relatively very low flow of water, saving water and heating energy.

An instant warm water low flow, low energy pulsating shower head is described which consists of a shower head connected to the outlet of a pulsating valve. The water flows through a heating element that can provide instant warm water by using a low power heating element and low energy. It operates at a higher efficiency resulting also from high velocity jets that flow in the air with minimum heat losses.

A group of pulsating shower heads as described may include cold water pulsating shower heads, warm water pulsating shower heads and soaping devices as described. These are connected to the same pipe and controlled separately in response to pressure changes in the pipe. A normally closed pulsating valve with a relatively high preset pressure connected to the system can serve as a pressure relief valve, providing a safety device.

A domestic, industrial, or commercial water supply system may consist of a group of different heating elements, concentrated in one or more locations, actuated in different combinations in response to different requirements for warm water, that flows through different types of valves as described but having different preset pressures.

During the development of the pulsating valve, new innovated valves, receptacles, and flow controls were developed. These items are described and are claimed as new innovative inventions independently from the main claims to the of pulsating devices and their directly related applications.

Normally open valves and hydraulic valve and normally closed valves and hydraulic valves are produced in a simple way. They consist of elastic tubes which surround an insert and are enclosed in a casing. The different functions of the valves are achieved when the elastic tube is exposed to pressures from different controlled locations. In response the elastic tube deforms, causing it to expand or contract and thus closing or opening the different valves.

Although some hydraulic valves commonly used in the market contain elastic members, the elastic members in those valves are used mainly as sealing materials in which a rubberlike material is pressed against a solid member, serving a similar function to that of an O-ring. Further, additional finings and pans are used in such valves to hold the elastic member fixed.

A normally open valve according to this invention comprises an elastic tube installed around an insert having a fluid inlet and a fluid outlet having a larger outside diameter formed as a barb. The elastic tube at both of its ends is held fixed by surrounding it tightly. The elastic tube and the insert are enclosed in a casing which has a port through which the space surrounding the elastic tube is vented when the valve is in its normally open position, and pressurized for closing the valve. The port can be connected directly to the fluid supply pipe. Such a valve will close itself when a force F3 created by the pressure surrounding the elastic becomes larger than the force created on the elastic tube by the pressure inside the elastic tube and a force F2 which is the resistance of the elastic tube to contract and become flat.

The valve will close when F3>F1+F2. I.e., the valve will close when the walls of the elastic tube are pressed against each other or against a center rod inside the elastic tube which is part of the insert.

The same valve can operate as a normally open hydraulic valve when the pressure at the port is controlled by a valve, namely a solenoid valve which can be remote controlled.

A normally closed valve according to this invention comprises an insert having a fluid inlet and fluid outlet and openings at the inlet and outlet through which a fluid can flow from the space inside the insert to the space outside the insert. The elastic tube is held fixed by surrounding tightly both sides of the insert which has at this location a larger outside diameter. The elastic tube surrounds tightly the center section of the insert (or at least a portion of it) and surrounding tightly the openings at the inlet and or outlet from the insert.

At the normally closed position of the valve the elastic tube surrounds tightly the opening at the insert, preventing fluid flow from the inlet to the space surrounding the insert.

When the pressure of the fluid at the inlet is high enough, the elastic tube expands. Its inside diameter increases and a fluid then can flow from the inlet, through the opening, to the space created between the insert and the elastic tube and out through the opening at the outlet and through the outlet from the valve.

The normally closed preset pressure P0 at which the elastic tube expands, allowing fluid to flow from the space inside the inlet to the space surrounding the insert, depends upon several factors.

The outside diameter of the insert at its closing cross section.

The inside diameter of the elastic tube, its wall thickness, and its physical properties.

When the insert is made with different outside diameters at the inlet and outlet, the valve has two preset normally closed valves, one at the inlet and a second at the outlet.

A receptacle according to this invention consists of an insert surrounded tightly by elastic tube having a construction similar to the normally closed valve described above. Such a receptacle has one or two normally closed valves. When the device has two normally closed valves, and when a fluid is injected through the inlet of the insert at a sufficient pressure higher than the preset pressure P0/1 at the inlet, the fluid flows from the inlet, through the opening at the inlet to the space surrounding the insert and enclosed by the elastic tube.

The fluid will continue to flow to this space, increasing the volume of the stored fluid and its pressure. When the pressure of the fluid at the space is slightly lower than the preset pressure P0/2 of the normally closed valve at the outlet, injection of the fluid through the inlet terminates. At this stage a volume V0 of fluid is stored in a receptacle created by the fluid itself. Such a receptacle has the following properties:

No fluid can enter the container through its inlet or its outlet unless its pressure is higher than the preset pressures P0/1 at the inlet or P0/2 at the outlet.

The volume of the container increases when the volume of the fluid stored increases and the volume of the container decreases when the volume of fluid it stores decreases.

When the container is empty, the container has no volume!

The fluid in the container is pressurized at any stage, including the stage in which it stores even one drop of fluid.

The fluid will be ejected from the container only when its pressure will increase and becomes higher than the preset pressure P0/2 at the outlet.

The pressure of the fluid inside the container can be increased by pressing on the elastic tube, namely by squeezing it.

The invention includes three types of receptacles:

Flow controls according to this invention comprise an elastic tube held fixed by surrounding it tightly with a larger outside diameter fluid inlet fitting and fluid outlet fitting. The elastic tube is enclosed in a casing and the device is made in such a way that the space surrounding the elastic tube is connected by means of a port to the inlet fitting. As such the fluid has the same pressure P2 at the inlet to the elastic tube and in the space surrounding the elastic tube.

When a fluid flows from the inlet through the elastic tube at a nominal flow, no deformation (or negligible deformation) is created in the tube. When pressure P2 at the inlet increases as a result of higher flow through the tube, a pressure drop dP is created along the tube, causing the pressure inside the tube to decrease from P2 at the inlet to the tube to P1, close to the outlet from the tube. Pressure P2 surrounding tube P2 is now higher than pressure P1 at the outlet portion of the tube. The elastic tube contracts, its inside diameter decreases, and the flow through the elastic tube decreases back to its nominal rate.

The device can be made so that all or a substantial length of the tube will decrease its inside diameter in response to a pressure increase at the inlet.

Some of the valves described above comprise elastic tubes enclosed in a casing. They can be produced as one part comprising one tube inside another tube. The outside tube serves as a casing.

The insert and the elastic tube of a normally closed pulsating valve 9 can be, with minor changes, installed inside a plastic tube which serves as a casing for the device. This can be done automatically during the extrusion of the plastic tube (using a two-head extruder). The end product can be a dripline in which the water from each "dripper" ejects from the tube in pulses according to the method described above.

A normally closed elastic perforated dripline tube has the following advantages:

- When not in operation, the perforations in the tube stay closed, preventing roots from penetration.
- At the end of each irrigation cycle the tube stays full of water. No vacuum is created along the tube, and sand particles are not sucked into the tube.
- By increasing the pressure inside the tube, its inside diameter increases and the tube can then carry a higher flow.
- By increasing the pressure inside the tube, the size of the perforations can be increased substantially. By periodically increasing the pressure inside the tube, plugging of the perforations can be eliminated.
- A pulsating valve as described above connected at the inlet of such a dripline can be used in order to reduce the flow through the perforations.
- The perforations in the tube can be made in such a shape that each opening will be a flow control by itself. The flow through each perforation is the same regardless of the pressure inside the tube.
- The dripline as described can be made of elastic materials. Also it can be made of plastic materials with short sections of elastic perforated tubes-connected to the plastic tube.
- Similar results can be achieved by surrounding the perforations of a plastic tube with an elastic perforated sleeve, or by connecting elastic membranes to the perforations of a plastic tube.

Drawing Figures

FIG. 1 is a view, partly in cross section, showing a pulsating minisprinkler operating with the method described above. Its receptacle is made in the form of a spike for insertion in the ground. It operates at a very low flow, wetting a large area. Water is ejected from the spray device at a very high pressure due to a water hammer created by the quick responses of the preset pressure response valve. It ejects water and air which is sucked through a perforation in the casing of the valve.

Figure 1:
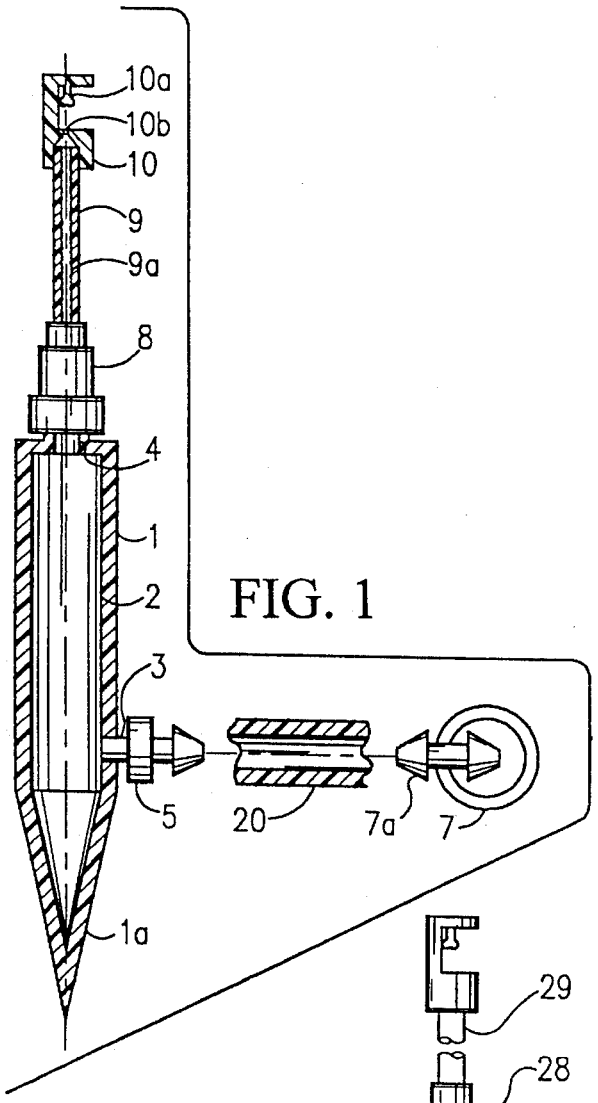
Figure 5:
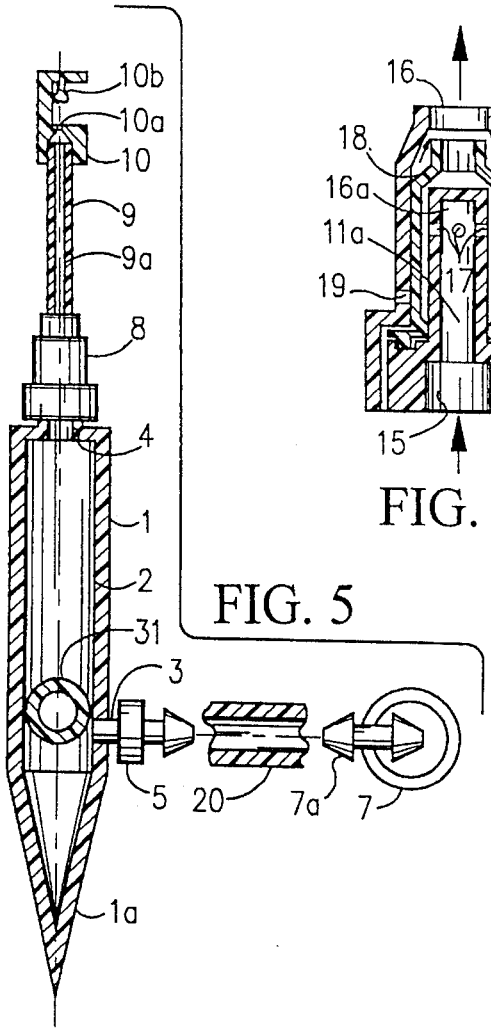
Figure 8A:
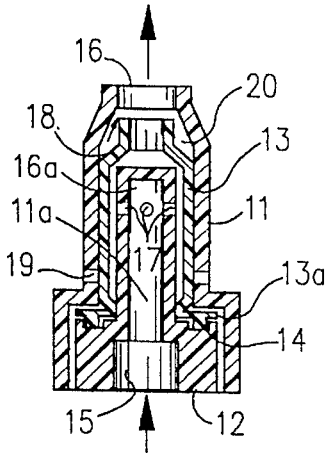
Figure 8B:
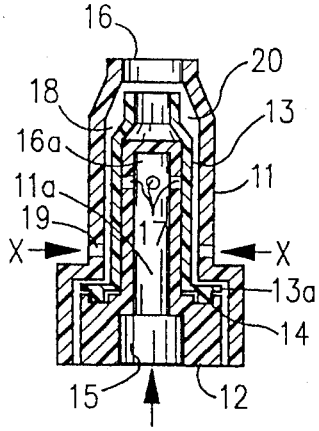
Figure 7:
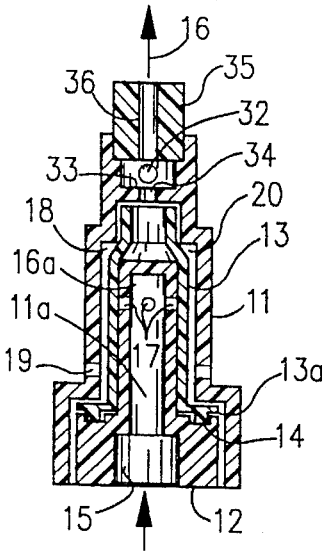
Figure 6:
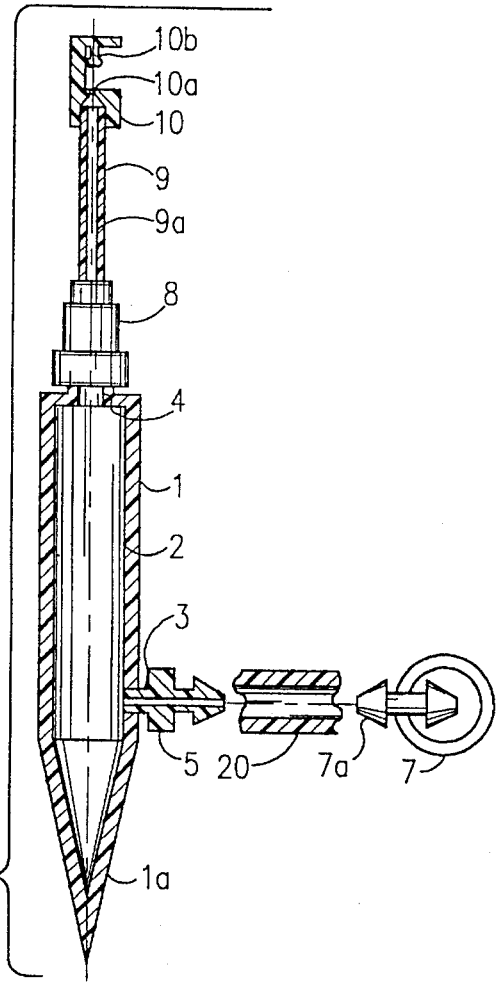

FIG. 5 shows the identical structure of FIG. 1, except that a secondary container containing trapped air is positioned within the receptacle, FIG. 6 is identical to FIG. 1, except that a compensating dripper is replaced by a small nozzle, FIG. 7 is identical to FIG. 1, except that provision is made for insertion of a mechanical obstacle in the outlet of the valve, e.g., using a movable ball as shown, FIGS. 8A and 8B show the pumping action of the valve.

Figure 9A:
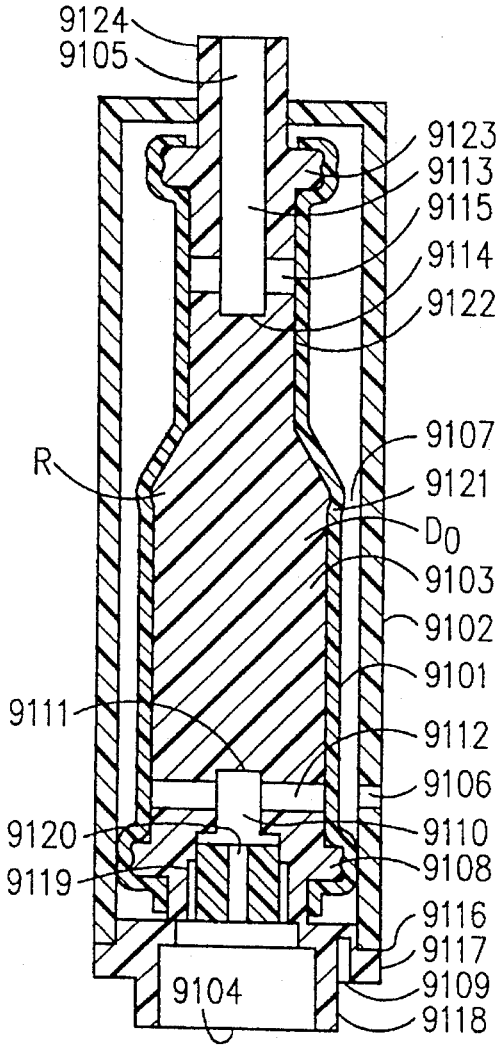
Figure 9B:
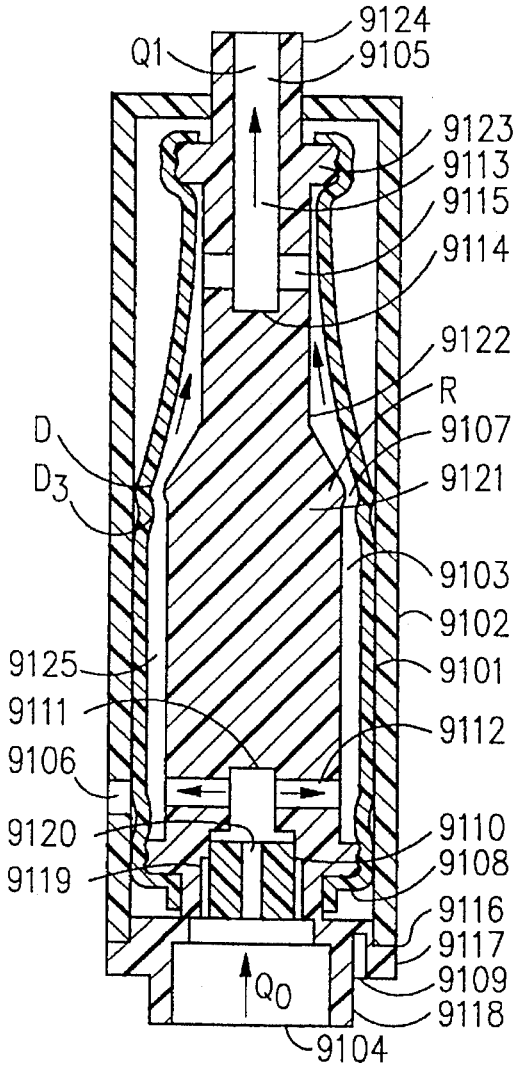

FIG. 9*a* illustrates in cross section a normally closed pulsating valve with a deflector connected to the insert. FIG. 9*b* shows the valve at its open pulsating position.

Figure 9C:
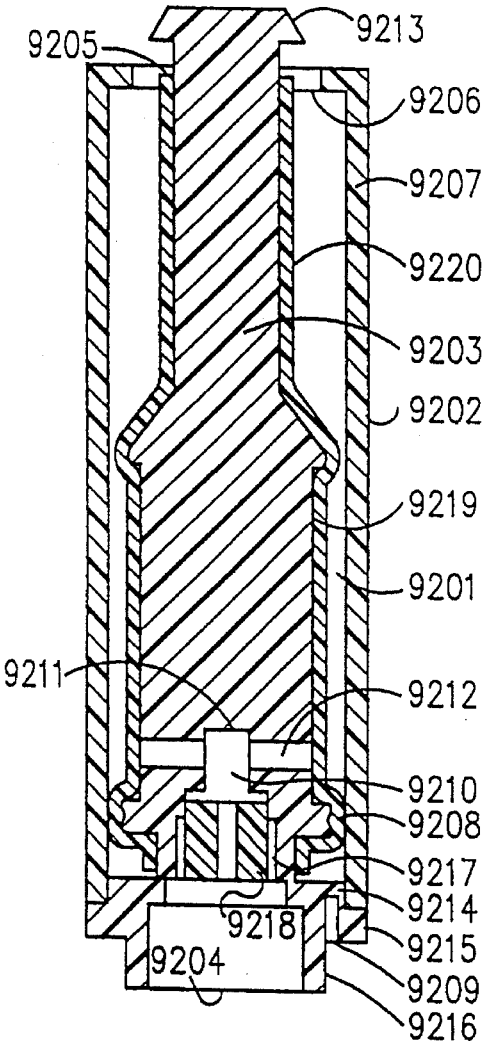
Figure 9D:
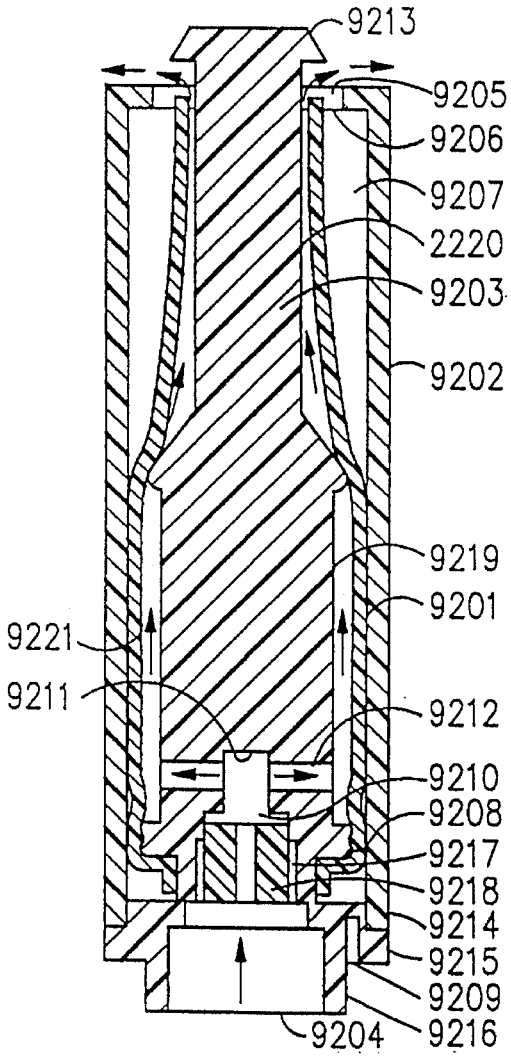
Figure 9E:
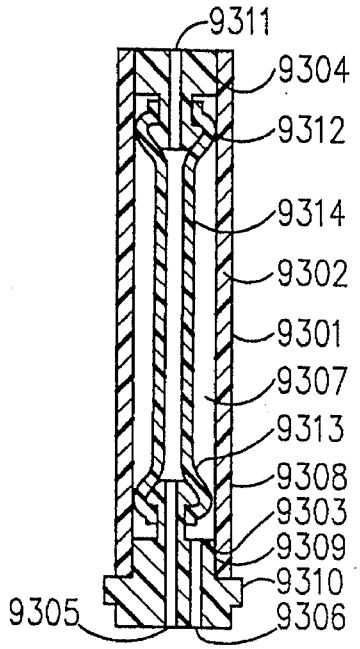
Figure 10A:
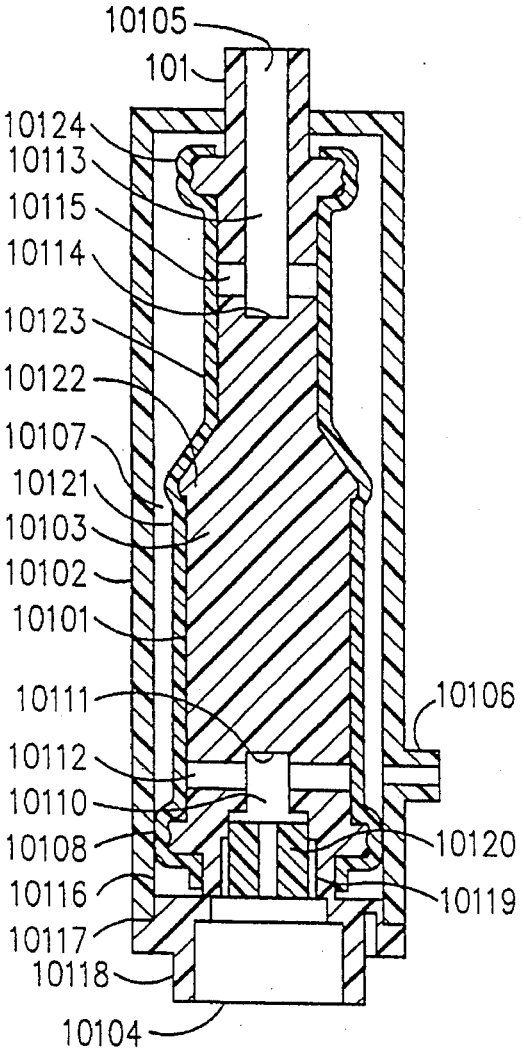
Figure 10B:
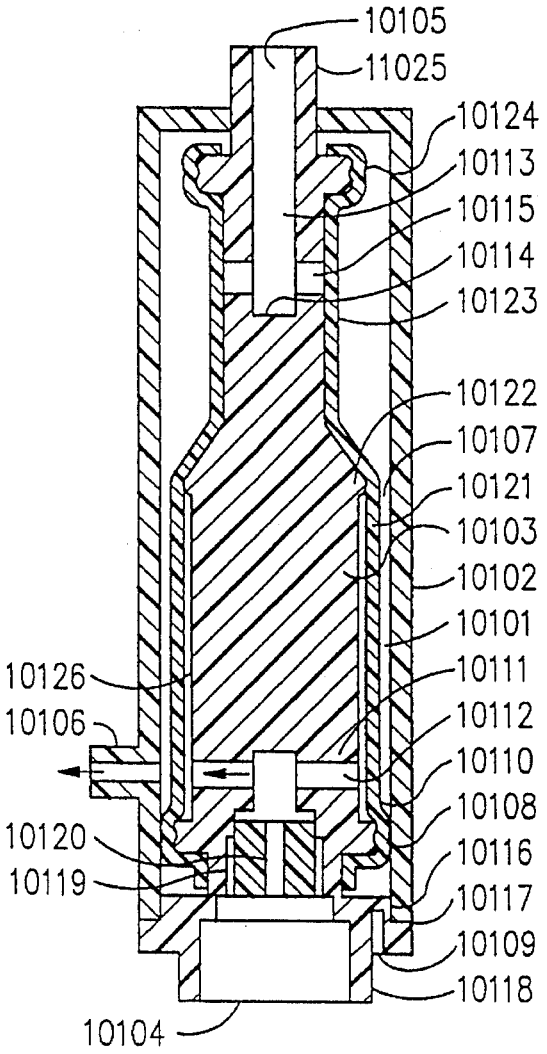
Figure 11A:
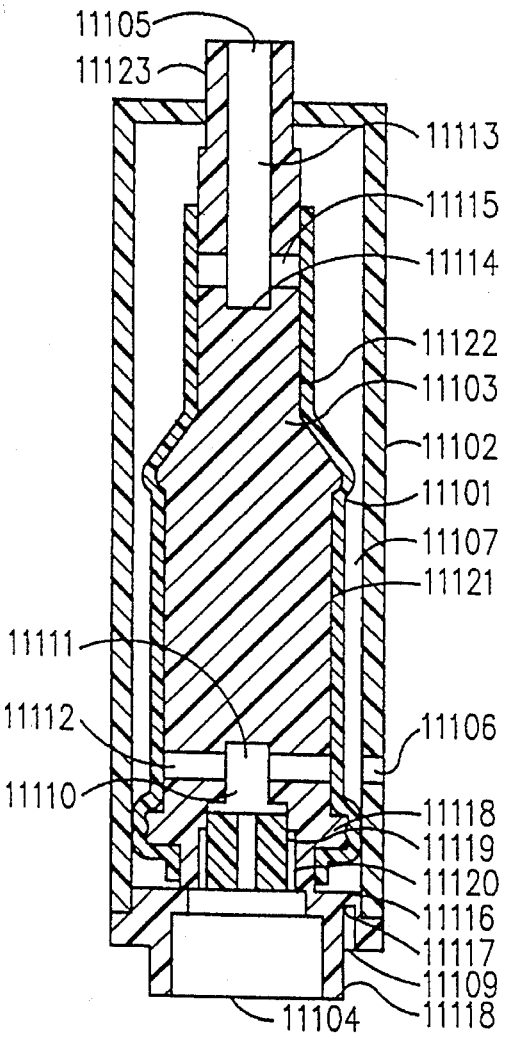
Figure 11B:
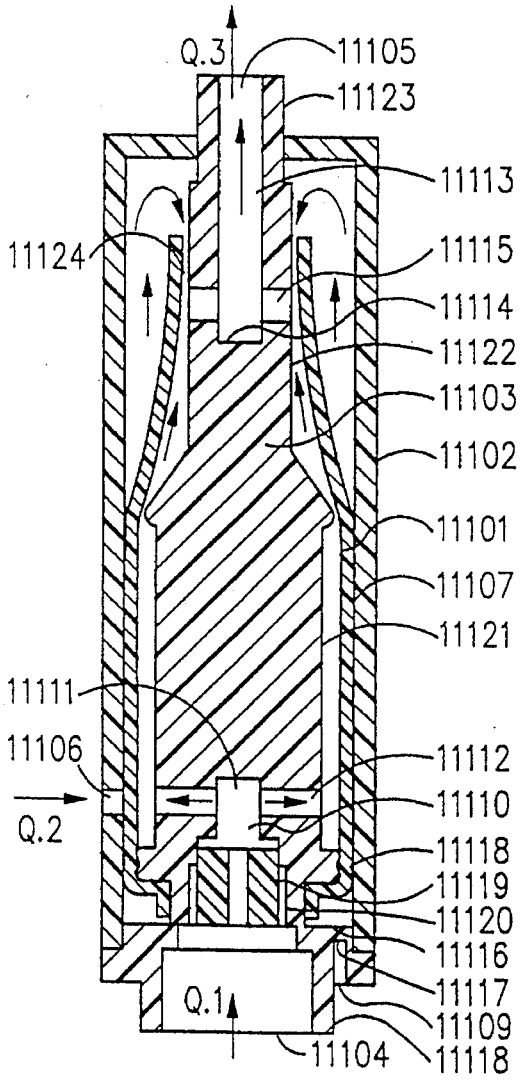

FIG. 9*c* illustrates in cross section normally closed pulsating valve with a deflector being part of the valve. FIG. 9*d* shows the valve at its open pulsating position, FIG. 9*e* illustrates in cross section a normally open pulsating valve of another type with the valve in its pulsating position, FIG. 10*a* illustrates in cross section a self cleaning filter valve in its normally closed stage. FIG. 10*b* shows the valve in its filtration stage, FIG. 11*a* illustrates in cross section an injection pump incorporating the novel valve structure in which the pulsating pump is in its closed position. FIG. 11*b* shows the pump in its pulsating and pumping stage.

Figure 11C:
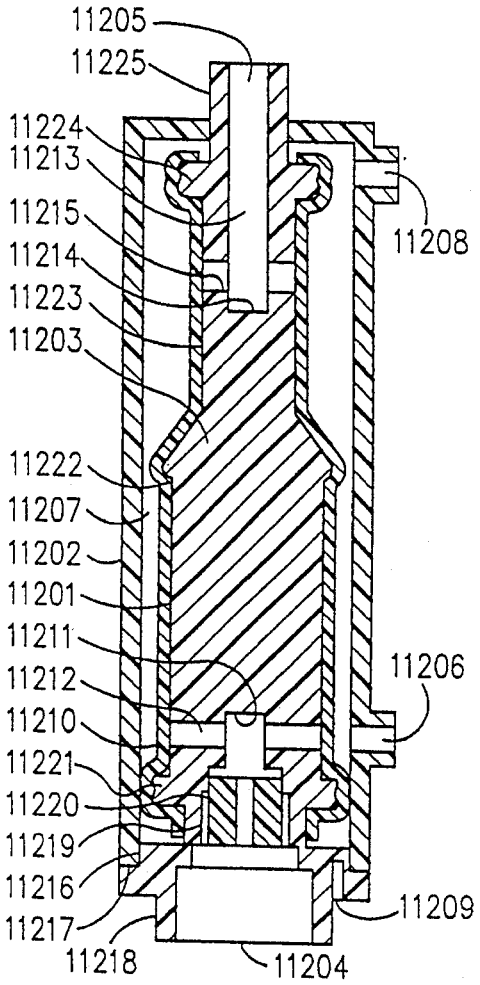
Figure 11D:
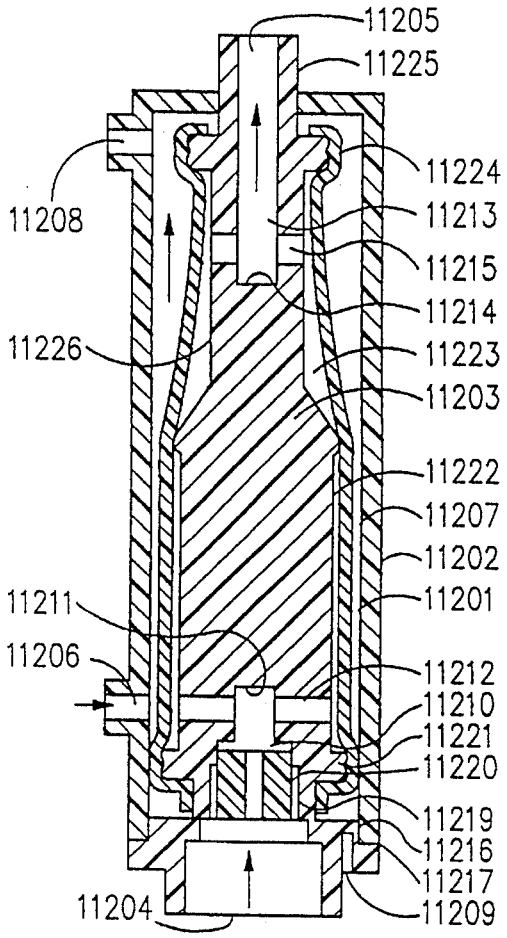

FIG. 11*c* illustrates in cross section another type of a pump consisting of a pulsating valve with two ports in the casing with the pump at its closed position. FIG. 11*d* shows the pump in its pumping stage.

Figure 11E:
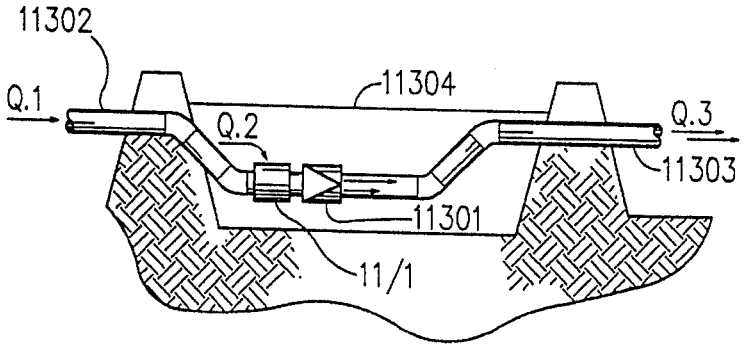

FIG. 11*e* illustrates in outline the injection pump of FIG. 11*a* in operation pumping water from a reservoir.

Figure 11F:
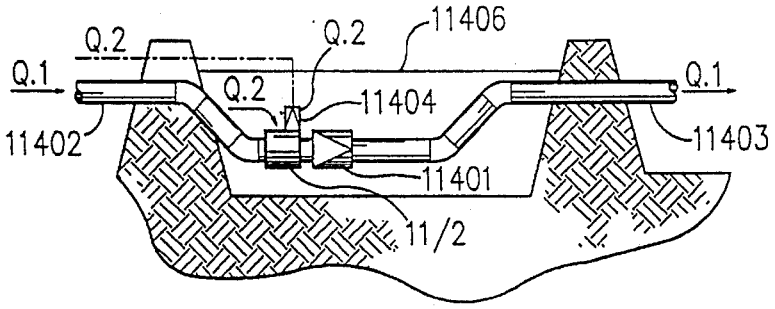

FIG. 11*f* illustrates in outline another similar pumping operation.

Figure 11G:
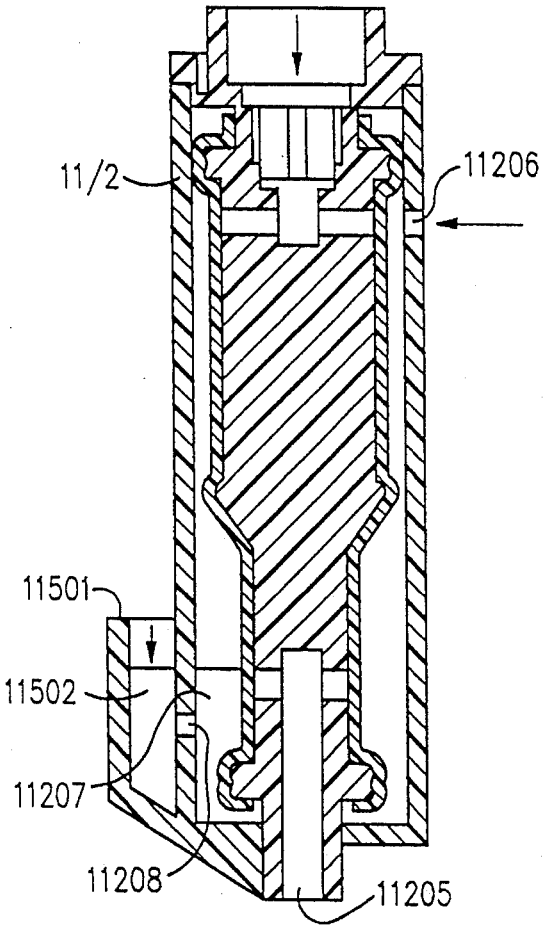
Figure 11H:
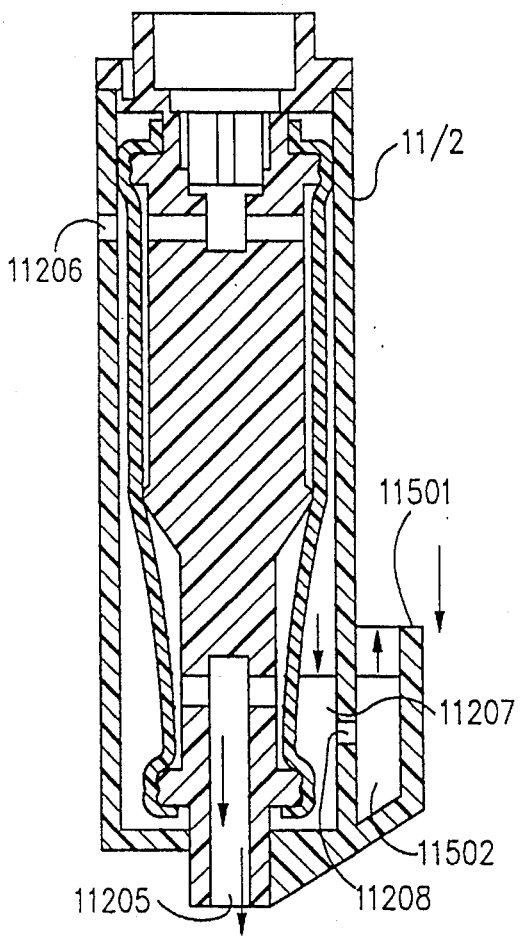

FIGS. 11*g* and 11*h* illustrate in cross section a soaping device incorporating a pump constructed according to FIG. 11*c*.

Figure 12A:
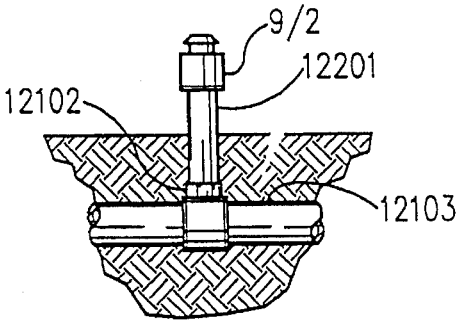
Figure 12B:
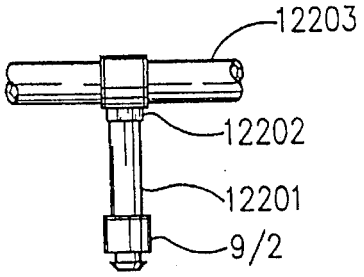
Figure 12C:
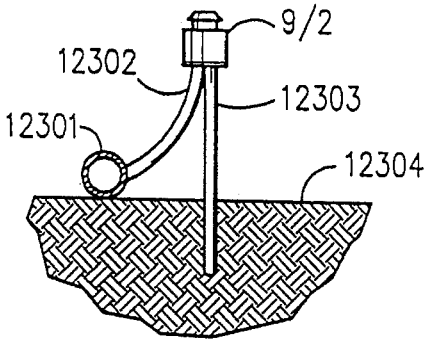
Figure 12D:
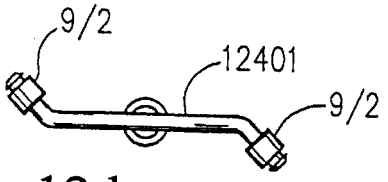
Figure 12E:
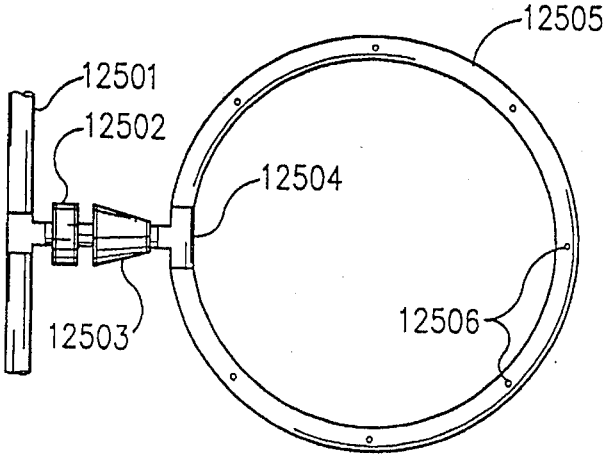

FIG. 12*a* illustrate in outline a pulsating sprinkler which incorporates the novel pulsating valve structure, specifically a pulsating spray head connected to a rigid riser. FIG. 12*b* is a view of the pulsating spray head connected to a pipe with its outlet below the inlet. FIG. 12*c* is a view of the pulsating spray head connected to one flexible tube by means of another flexible tube and a rigid rod which supports the pulsating spray head. FIG. 12*d* is a top view of a pulsating rotating sprinkler. FIG. 12*e* is a view showing a drip perforated tube connected by means of a pulsating valve to a lateral.

Figure 13:
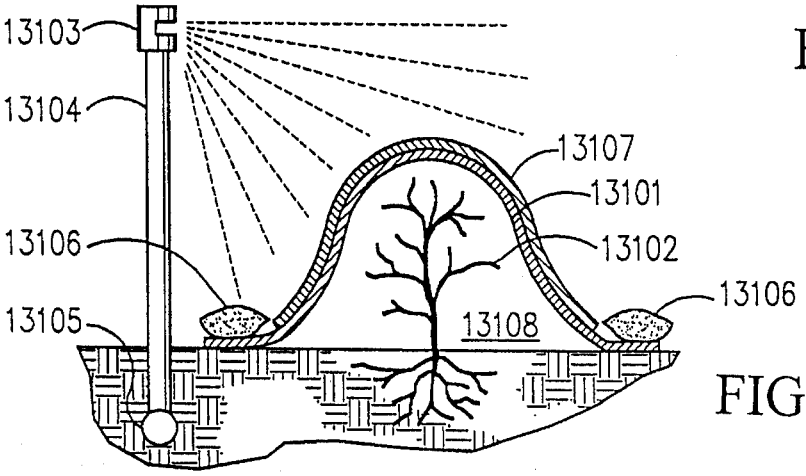

FIG. 13 illustrates in outline a frost control system which utilizes a pulsating spray over a foraminous protective enclosure.

Figure 14C:
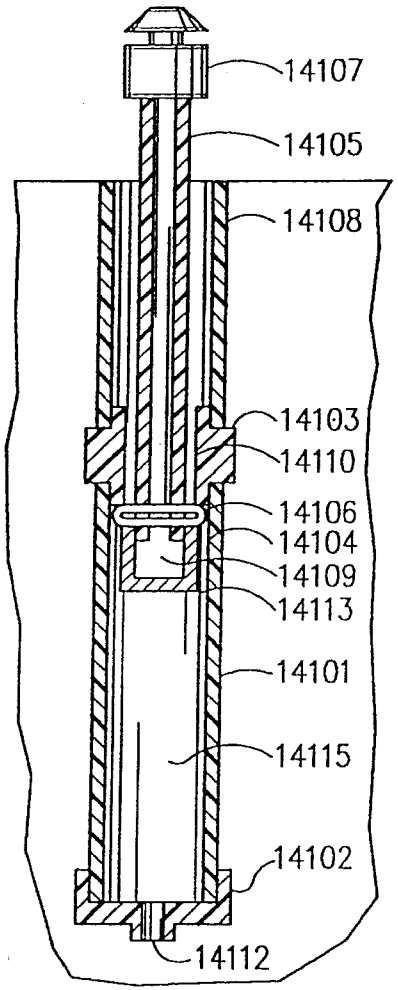
Figure 14B:
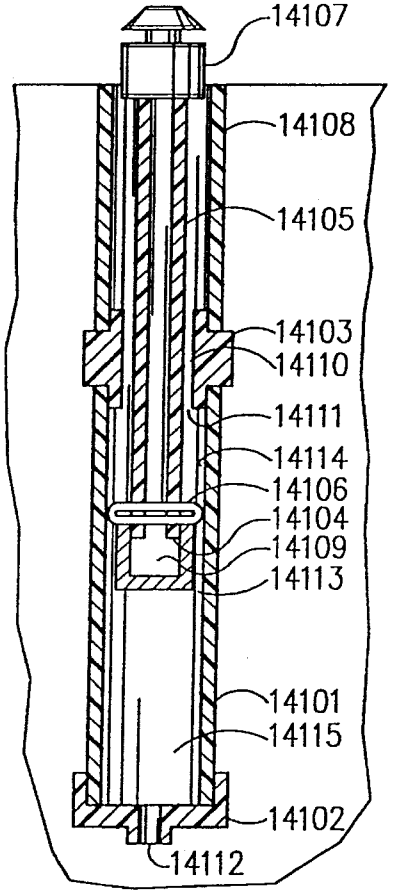
Figure 14A:
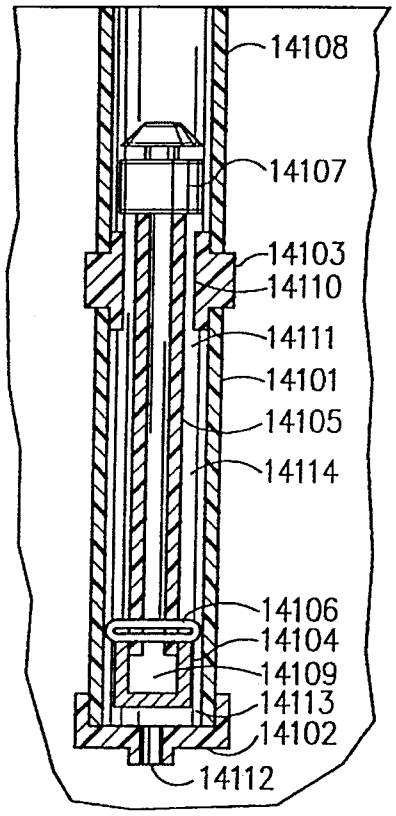

FIG. 14*a* illustrates in cross section a self-cleaning, low flow pulsating pop-up sprayer which incorporates the novel pump structure in its low, closed position. FIG. 14*b* shows the pop-up sprayer at its rising stage. FIG. 14*c* shows the pop-up in its high, open position.

FIG. 15*a* illustrates a valve that opens only at a limited pressure range at its inlet and a device for controlling different outlets connected to the same pipe. The outlets operate separately by changing the pressure in the pipe. A limiting valve comprising a normally open valve 9e (with or without a center rod) with a preset closing pressure PC and a normally closed valve 9a with a preset opening pressure P0 lower than PC connected to the outlet of valve 9e. Such a limiting valve allows fluid to flow through only at limited pressures higher than P0 and lower than PC. FIG. 15b is a schematic drawing showing a system consisting of six groups of outlets connected to the same pipe and operating separately by changing the pressure in the pipe. A normally open valve, limiting valves, and normally closed valves are connected to each outlet and controlled separately in response to pressure changes in the pipe.

FIG. 16a is a view in cross section of a normally open hydraulic valve. FIG. 16b shows the valve in its closed position.

Figure 16C:
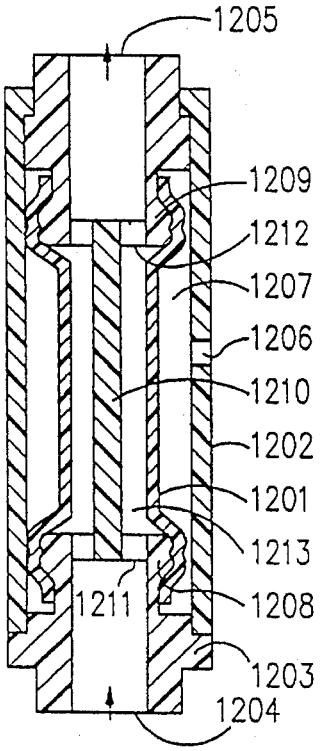

FIG. 16c illustrates a view in cross section of another type of normally open hydraulic valve with a center rod connected to the inlet and outlet fittings of the valve by means of ribs inside the fittings.

Figure 16D:
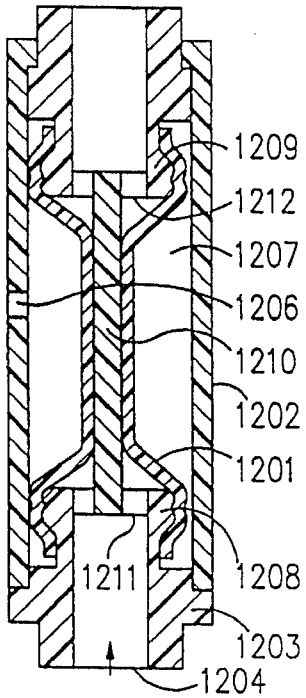

FIG. 16d shows the valve in its closed position.

Figure 17A:
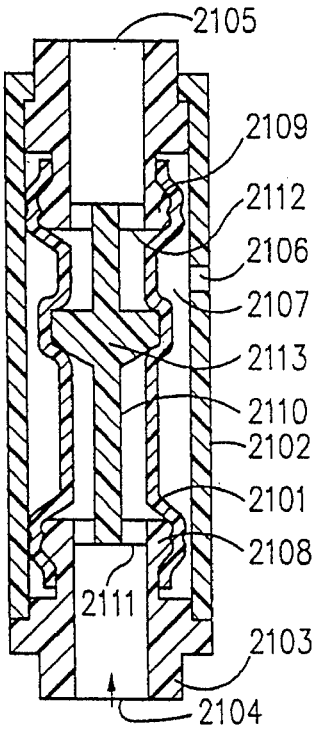
Figure 17B:
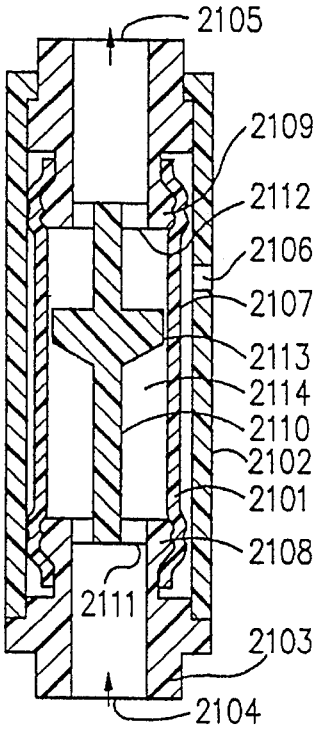

FIG. 17a illustrates a normally closed hydraulic valve in cross section. FIG. 17b shows the valve in its open position.

Figure 18A:
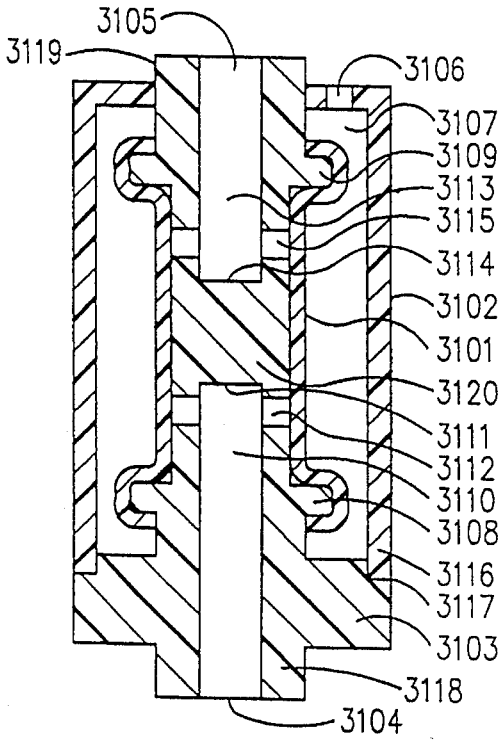
Figure 18B:
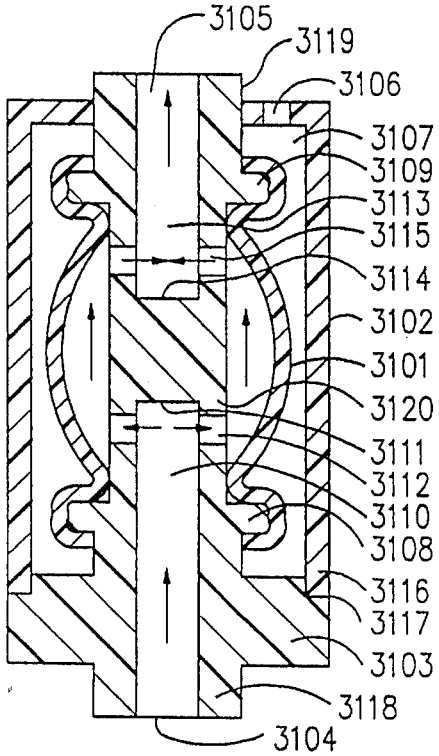

FIG. 18a illustrates a normally closed preset pressure responsive valve in cross section. FIG. 18b shows the valve in its open position.

Figure 19:
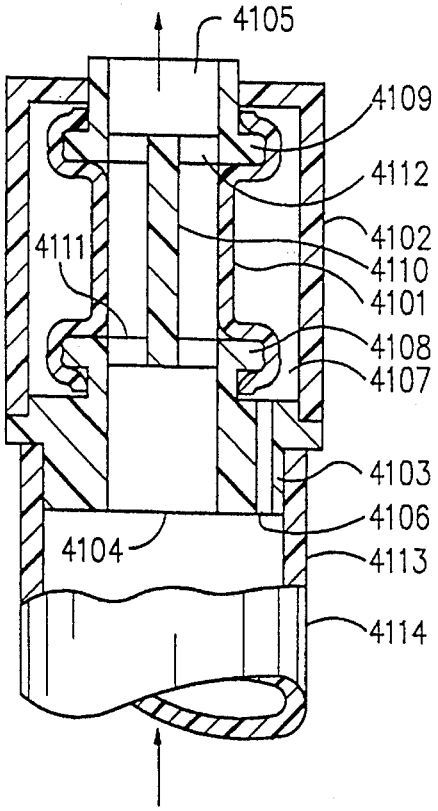

FIG. 19 illustrates a normally open, preset pressure responsive valve in cross section in its normally open position.

Figure 20A:
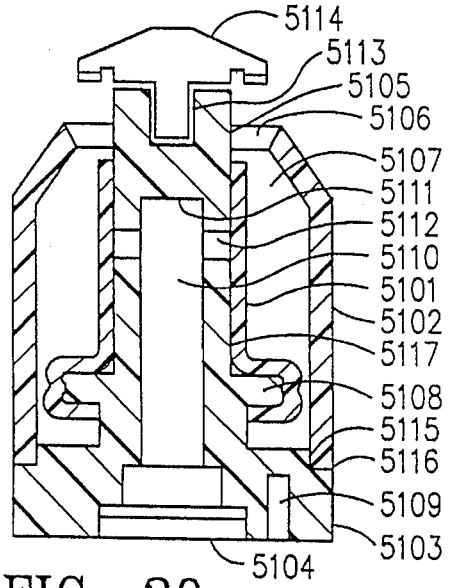
Figure 20B:
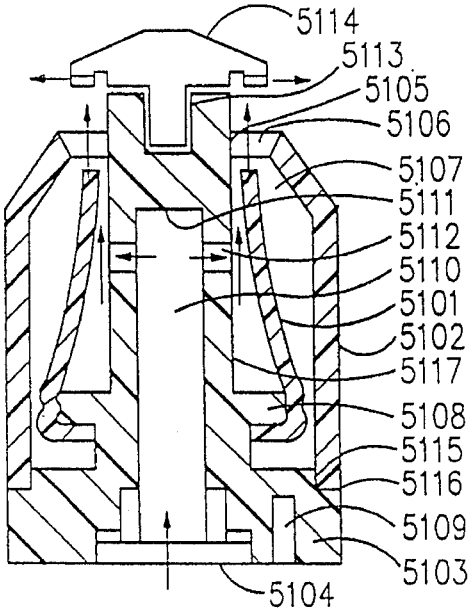

FIG. 20a illustrates a normally closed preset pressure responsive spray head valve with a deflector connected to the outlet of the valve in cross section. FIG. 20b shows the valve in its open position.

Figure 21:
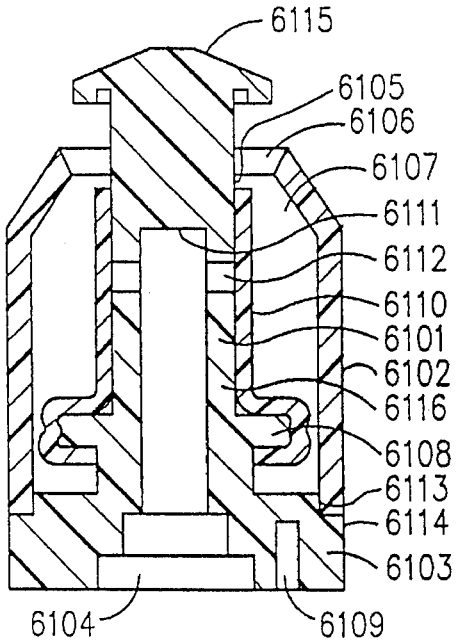

FIG. 21 illustrates a normally closed preset pressure responsive spray head with a deflector as part of the valve in cross section at its normally closed position.

Figure 22A:
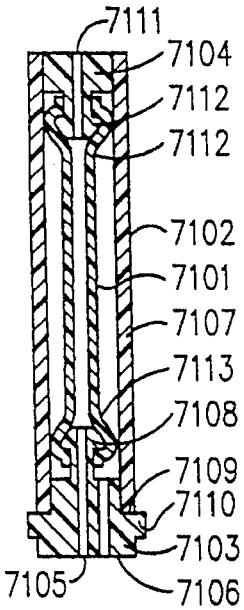
Figure 22B:
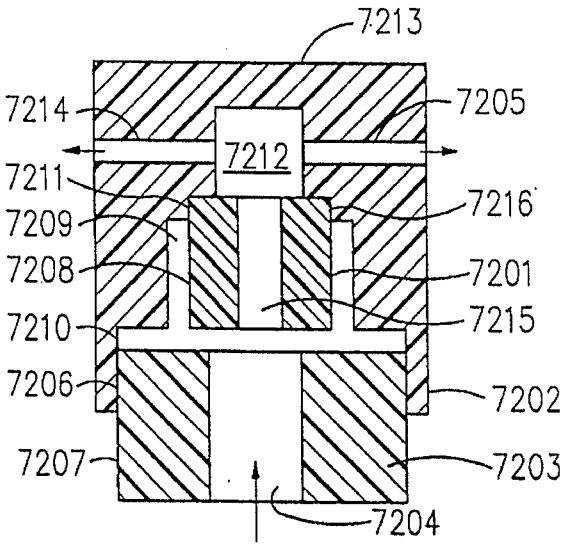

FIG. 22a illustrates in cross section one type of flow control valve. FIG. 22b illustrates in cross section another type of flow control valve.

Figure 23A:
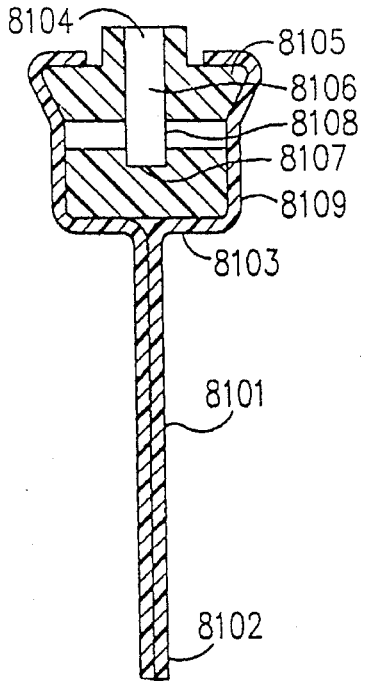
Figure 23B:
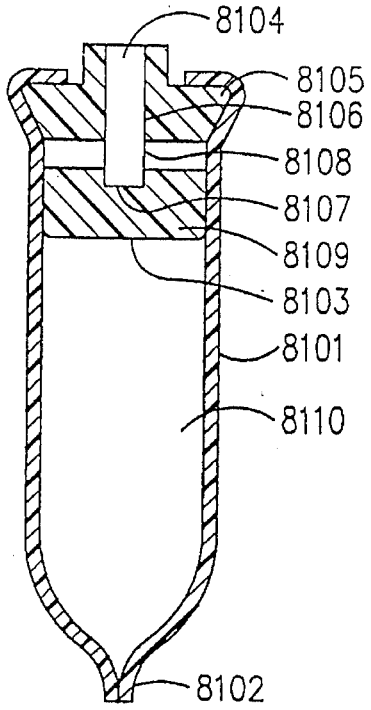

FIG. 23a illustrates in cross section one type of expandable receptacle or container in its normally empty position. FIG. 23b shows the container filled with pressurized fluid.

Figure 23C:
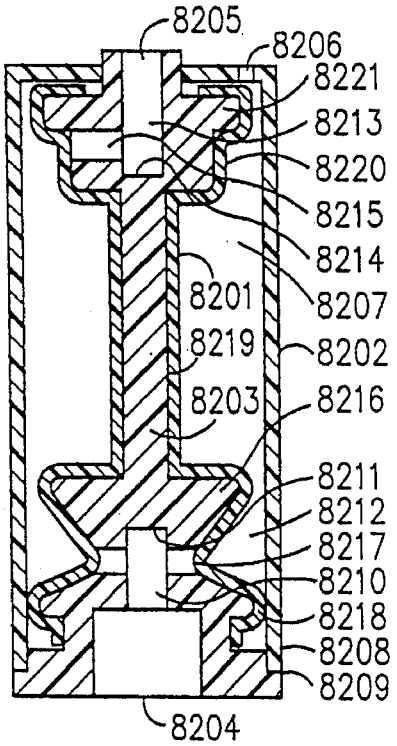
Figure 23D:
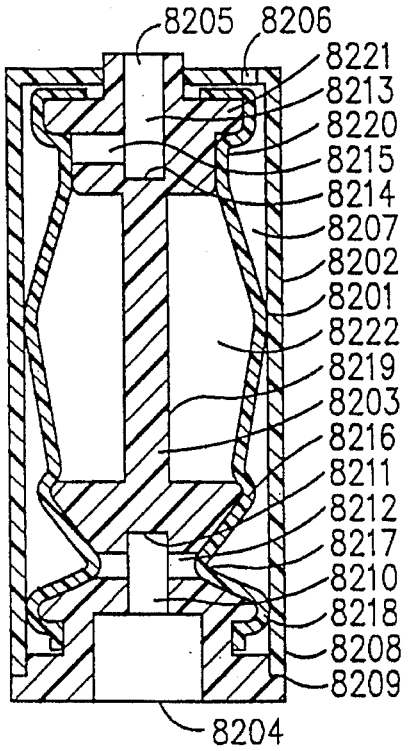

FIG. 23c illustrate in cross section another type of expandable container in its normally empty position. FIG. 23d shows the container filled with pressurized fluid.

Figure 23E:
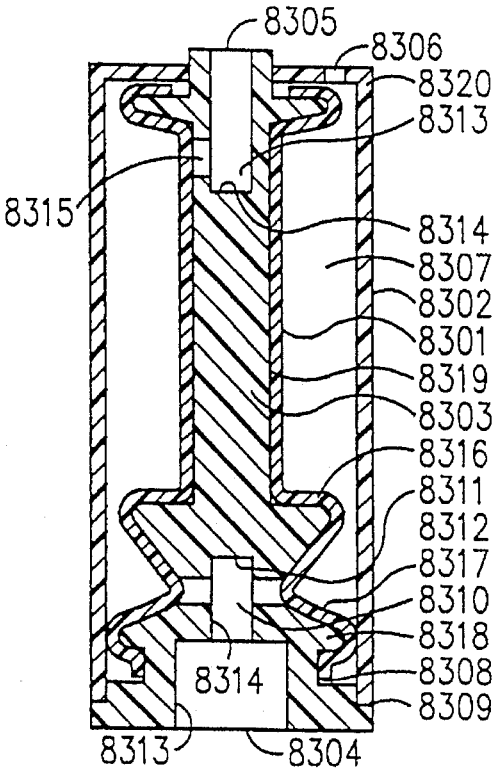
Figure 23F:
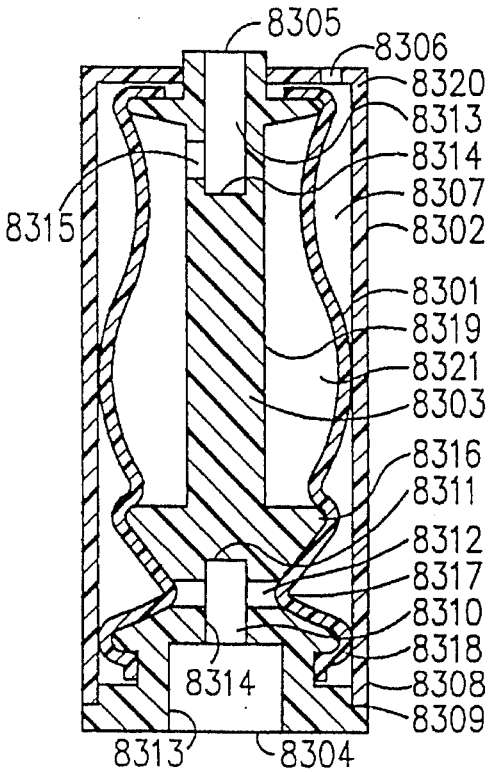

FIG. 23e illustrates in cross section still another type of expandable container in its normally empty position. FIG. 23f shows the container filled with pressurized fluid.

Figure 24A:
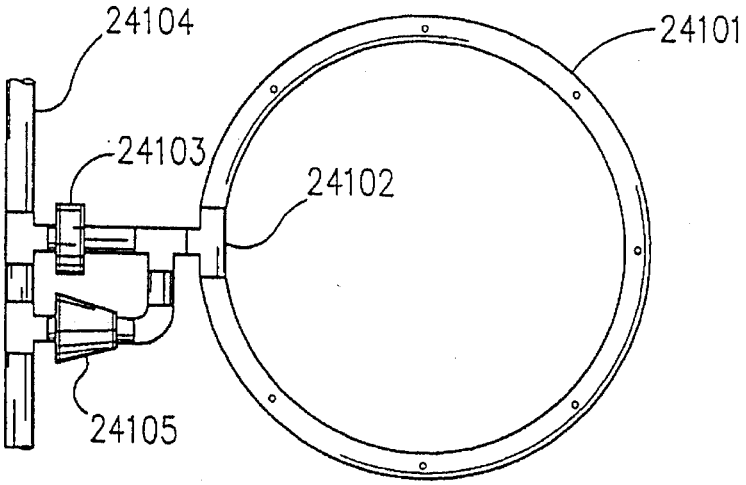

FIG. 24a illustrates a normally closed perforated elastic tube serving as a dripline for irrigating trees.

Figure 24B:
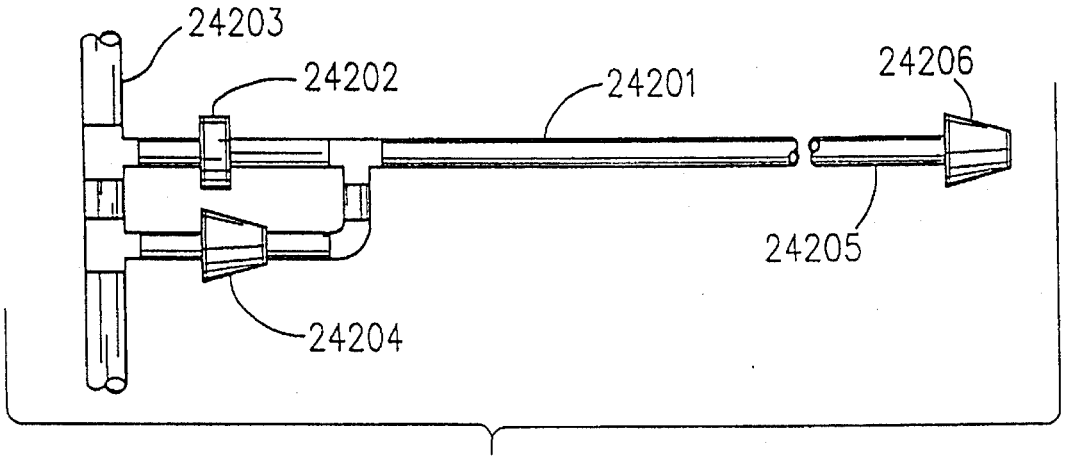
Figure 24C:
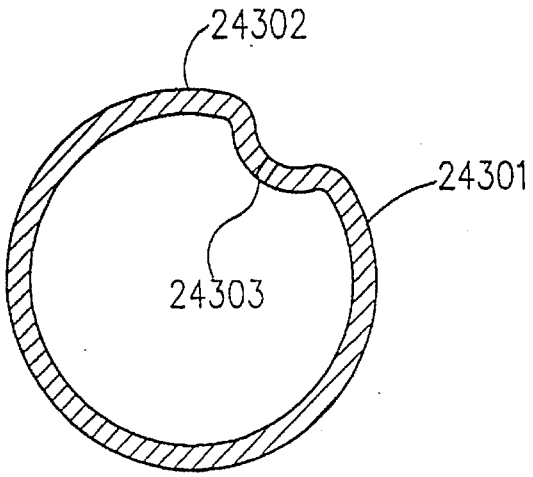

FIG. 24b illustrates a normally closed perforated elastic tube serving as a dripline for irrigating trees, vegetables, and any other type of plants. FIG. 24c shows in cross section one example of a perforated elastic tube in which the flow through the perforation is pressure compensated and the flow through each perforation along the tube is the same.

FIG. 1—MINISPRINKLER WITH PHT METHOD

FIG. 1 illustrates one preferred form of minisprinkler device operated with the PHT method and formed for direct insertion and support in the soil adjacent a tree or another area to be irrigated. A receptacle is in the form of a spike 1 having a sharp point 1a for ground insertion and enclosing a hollow chamber 2 having a square cross section for retention of water. The shape and dimensions of the container are determined by the particular application and can be of any practical volume. As a spike for insertion in the soil, a practical dimension would be as a rectangular cross section 1"×1" with a length of 6"–12". It is formed of a suitable rigid material, preferably of rigid, molded plastic, such that pressure increase within its hollow space will cause it to become slightly rounded and thus increase its volume.

The container has an inlet opening 3 and an outlet 4. The inlet opening is fined with a compensating dripper or other flow control device 5 which is in turn connected to a hose or tube 20 of suitable length for connection by means of a fitting 7a to a water supply pipe 7.

Figure 2:
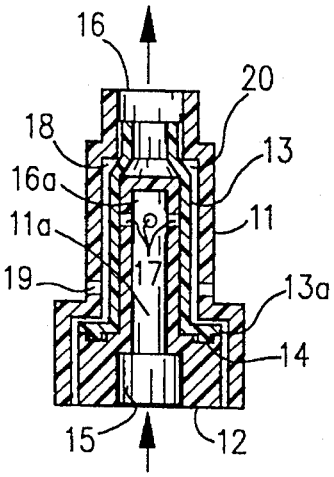
FIG. 2 is a cross section showing one type of a preset pressure response valve utilized with the invention. This valve has a quick response and it has pertbrations in its outer casing, which are used for sucking fluid from its surroundings, and mixing and ejecting it, similar to the operation of a venturi pump.

The outlet is connected to a preset pressure responsive valve 8 of the type illustrated in FIG. 2. This is then connected by means of tube 9, which has a small diameter bore 9a, to a spray means in which water is pulsed through nozzle 10b against a deflector 10a. The spray means may be of any suitable type, such as a finger spray or a rotary spray or like where a large diameter spray area is desired. A preferred type of valve 8 which is especially effective in being quickly responsive to fluctuations in pressure is illustrated in FIG. 2.

FIG. 2—Preset, Pressure Responsive Valve

FIG. 2 illustrates the structure of such a preset pressure responsive valve 8 which includes three parts: an outer casing 11, an insert 12, and an elastic sleeve 13 made of robber or the like, which surrounds and fits snugly around the outside wall of insert 12. The outer casing and the insert preferably are formed of plastic material. These are concentric and preferably cylindrical. As shown, insert 12 is in the shape of an inverted, cuplike member open at the bottom with its side walls surrounded by and engaged by sleeve 13.

Elastic sleeve 13 is formed with a rib 13a, which is engaged in a slot 14 made in insert 12. Insert 12 is formed with a widened portion at the bottom to accommodate the slot and engage the fib portion of the sleeve. Also, an angular fiat portion 13b of the sleeve, as shown, serves as a gasket between outlet casing 11 and insert 12. The bottom portion of insert 12 which is not engaged by the sleeve is cemented or force-fitted to the bottom portion of casing 11, as shown. Casing 11 and insert 12 are made of rigid material and are cemented together and provide a liquid inlet 15 and outlet 16.

Insert 12 has one or more perforations 17 in its side wall. When liquid pressure inside insert 12 is at or below a critical pressure P1 the openings will be enclosed by elastic sleeve 13 which surrounds the insert tightly. When the liquid pressure within insert 12 is increased above a critical pressure P1, the pressure forces elastic sleeve 13 to expand in an expansion space 18 between casing 11 and insert 12.

Then liquid flows out from insert 12 through perforations 17, and will continue to flow between outside walls of insert 12 and inside walls of elastic sleeve 13 out through outlet 16.

Perforations 19 in casing 11 connect expanding space 18. The external surroundings of valve 8 allow fluids, namely, external air, to flow into space 18 and permit the elastic sleeve to expand into this space.

When the valve is at its closed position and elastic sleeve 13 surrounds tightly insert 12, fluid, namely air, penetrates casing 11 through perforations 19, filling the space between sleeve 13 and casing 11. When valve 8 opens and a liquid flows through the valve, elastic sleeve 13 expands, pressing against perforation 19 and against the fluid surrounding elastic sleeve 13. The fluid pressure is increased and it is forced to flow out through outlet 16 where it is mixed and ejects with the liquid that flows through valve 8.

When liquid pressure in insert 12 is reduced below P1, elastic sleeve 13 will return to its position, sealing perforations 17 and preventing liquid within insert 12 from flowing until liquid pressure in insert 12 is increased again to critical pressure P1. The pressure P1 which forces elastic sleeve 13 to expand depends upon the wall thickness of the elastic sleeve and the material it is made from. A thicker wall of the elastic sleeve will increase critical pressure P1.

Inlet 15 is designed to snap on outlet 4 of spike 1 in FIG. 1. Outlet 16 is designed so that rigid tube 9 in FIG. 1 can be snapped onto it.

As shown in FIG. 1 water from irrigation tube 7 flows through hose 6 and pressure compensated dripper 5 at a low continuously controlled flow Q2 to spike 1 in which it is being accumulated and its pressure is increased to a critical pre-designed pressure P1 Elastic sleeve 13 of valve 8, which is connected to outlet 4 from spike 1, expands, and allows water to flow out from spike 1 through preset pressure responsive valve 8 to a small sized inside diameter tube 9.

Friction loss at tube 9 forces elastic sleeve 13 to expand widely, allowing a high flow Q1 of water to be ejected from spike 1 through valve 8 and tube 9. The high flow ejected from the spike flows through nozzle 10*a* of a spray device 10 and spreads by deflector lob over a large designated area.

While water ejects from spike 1 at a high flow Q1, it is supplied into spike 1 through dripper 5 at a low flow Q2. As a result the volume and pressure within spike 1 decreases to P2, lower than P1, and valve 8 closes itself and closes outlet 4 from spike 1. This continues until more water flows from dripper 5 and accumulates in spike 1 increasing the pressure within the container to P1 and starting a new pulsating cycle.

Due to the quick response of valve 8, a water hammer is created which increases the pressure and velocity of the ejected water. When valve 8 closes and opens itself, fluid, namely air, flows into casing 11 and out through valve outlet 16 in pulses which mix with the liquid that flows through the valve.

Instead of the elastic sleeve type valve described above, a conventional spring-loaded, normally closed valve may be used.

Figure 3:
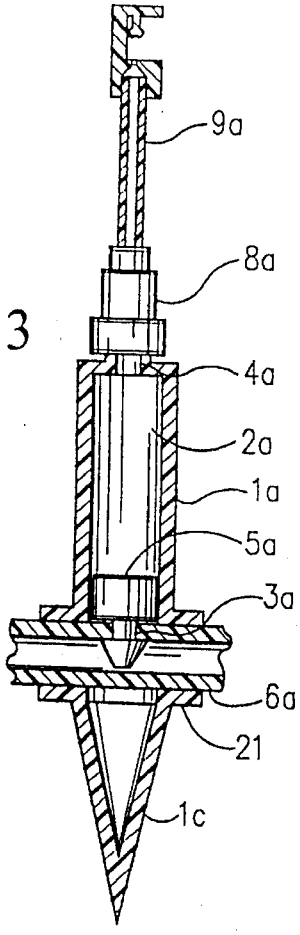
FIG. 3 is a view, partly in cross section, corresponding to FIG. 1 showing the receptacle of FIG. 1 divided into two sections mounted directly upon a liquid conduit.

FIG. 3—Alternative Installation

FIG. 3 shows an alternative manner of installing the device of FIG. 1 in which the spike container is divided into two sections 1*a* and 1*c*. These are designed to encircle and engage the circumference of water conduit 6*a*, which in effect passes through the container and may be engaged at spaced intervals by additional spike units of the same type. During assembly of the sections, a compensating dripper 5*a* is inserted into opening 3*a* in the conduit and is positioned in the upper section as shown. A controlled flow of water is passed into chamber 2*a* and passed through outlet 4*a* into valve 8*a* and tube 9*a* as described above with respect to FIG. 1. The two sections are secured to the conduit by cementing or otherwise. To ensure against leakage, a pair of gasket rings 21 may be cemented in place as shown.

Figure 4:
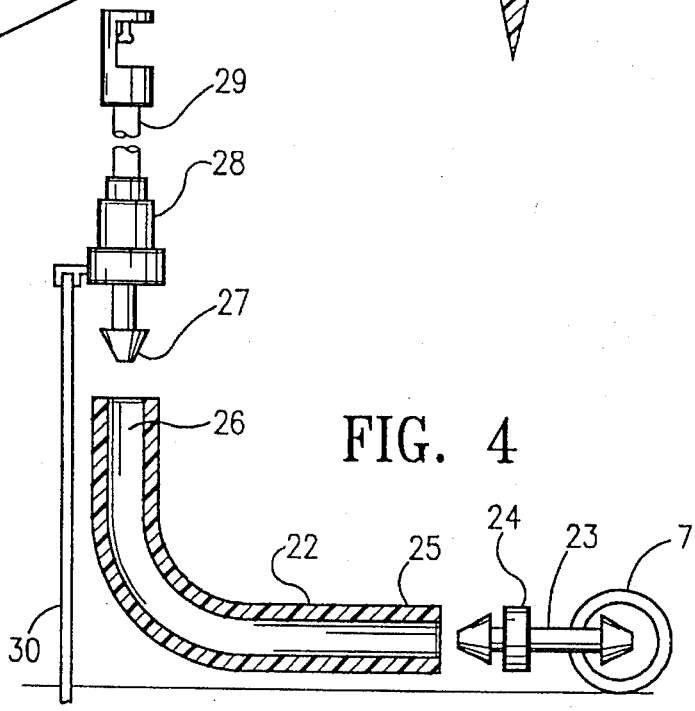
FIG. 4 is a view, partly in cross section, showing a section of a flexible conduit forming a liquid receptacle upon which the valve and spray unit are mounted.

FIG. 4—Mini-Pulsating Valve In Form Of Tube

FIG. 4 illustrates a pulsating minisprinkler in which the container, instead of being in the form of a spike, utilized to support a sprinkler or similar unit, is in the form of a flexible tube 22. Tube 22 is connected to water supply 7 by means of a suitable fitting and in turn to a compensating dripper 24. It is also connected by means of another fining to inlet 25 of the tube and the tube is connected at its outlet 26 by means of fitting 27 to valve 28. The function of the device is similar to that described with respect to FIGS. 1 and 2. Support for the device of FIG. 4 is provided by means of a rod or similar member which is affixed at its upper end to the valve and may be inserted into the ground as shown, to elevate the tubular container.

FIG. 5—Pulsating Valve With Flexible Chamber For Increasing Fluid Ejected

FIG. 5 illustrates the pulsating device of FIG. 1, but where a small chamber 31, formed of semi-rigid or flexible material containing air, is placed within the sprinkler to permit trapped air to increase the ejected amount of liquid in each pulse.

FIG. 6—Pulsator With Small Nozzle

FIG. 6 illustrates the pulsating device of FIG. 1, but where the pressure compensating dripper is replaced by a small nozzle which controls flow into the receptacle. The same a nozzle can be used in place of the drippers shown in FIG. 3 and 4.

FIG. 7—Normally Closed Valve With Float Ball

FIG. 7 illustrates a normally closed valve with a mechanical obstacle in the form of a ball which floats according to the pressure of liquid that flows through valve 8. The ball is incorporated within the outlet structure of the valve in FIG. 2. The ball is placed within a compartment formed by inner ting 33. The compartment has an opening 34 and a fitting 35 which also has an outlet opening 36.

FIGS. 8*a* And 8*b*—Pumping Action

FIG. 8*a* and 8*b* illustrate the pumping action described above. Arrows show the direction of flow of the secondary fluid, which, as shown in FIG. 2, enters perforations 19 during each pulse when the valve is closed and fills space 18 between elastic sleeve 13 and the outer casing. When as described above, the pressure reaches the point at which the valve opens, the sleeve expands to the position shown in FIG. 8*a*. This causes the closure of perforations 19 and forces the fluid from space 18, out between the elastic sleeve and the casing, and out through outlet 16 to become intermingled with the main fluid. The secondary fluid may be a gas such as air.

When the unit is positioned to be surrounded by a liquid above the perforations, this secondary liquid will become admixed with the primary liquid, thus functioning as an injection pump. When the liquid level is below the perforations, the flow will cease and only air will enter through perforations 19.

FIGS. 9*a* and 9*b*—Normally Closed Pulsating Valve

FIGS. 9*a* to 9*b* illustrate a normally closed pulsating valve of Type A by which a low continuous flow is converted to a high intermittent pulsating flow.

FIG. 9*b* illustrates a normally closed pulsating valve consisting of elastic tube 9101, casing 9102, and insert 9103. Insert 9103 has fluid inlet 9104 and fluid outlet 9105.

Casing 9102 has a port 9106 through which space 9107 surrounding tube 9101 can be vented. Insert 9103 has barbs 9108 and 9123 for holding tube 9101 fixed. Insert 9103 has an opening 9109 which can be used for supporting the valve on a rod. Insert 9103 at its inlet 9104 has an opening in the shape of a cylinder 9110 plugged at its end 9111 and having perforations 9112 at its circumference. At its outlet 9105, insert 9103 has an opening in the form of a cylinder 9113 plugged at its end 9114 and having perforations 9115 at its circumference.

Section 9116 of insert 9103 and step 9117 are made for connecting casing 9102 to insert 9103. Outside diameter 9118 of insert 9103 allows the valve to be connected with its outside diameter at its inlet 9104 to a pipe or a fitting.

Fluid inlet 9104 has also an opening in the shape of casing 9119 in which a flow control 9120 type B (see FIG. 9*b*) can be installed for controlling flow Q0 into the valve. At least at one cross section, between perforations 9112 and perforations 9115, insert 9103 has ring R with an outside diameter D larger than the inside diameter DO of elastic tube 9101. Tube 9101 tightly surrounds the ring, creating at this cross section a preset pressure-response normally closed valve. Section 9124 of insert 9103 is made for connecting a spraying device by fitting it to the outside diameter of section 9124 or by inserting it into its inside diameter.

In one preferred form, tube 9101 has an inside diameter DO also smaller than the outside diameter of the insert at the section thereof surrounding inlet perforations 9112.

FIG. 9*a* shows the normally closed pulsating valve in its closed position.

Elastic tube 9101 surrounds tightly insert 9103, preventing fluid flow from inlet 9104 through the valve to outlet 9105.

Assume that a fluid at a pressure P3, higher than the normally closed pressure PO of the valve, enters inlet 9140. The fluid then flows in a continuous low flow Q0, controlled by flow control 9120, into cylinder 9110 at inlet 9104.

The pressure P3 of the fluid at cylinder 9110 forces tube 9101 to expand and its inside diameter to increase to D1, creating a space 9125 between tube 9101 and insert 9103. (FIG. 9*b*)

The fluid then flows through perforation 9112 to space 9125. Space 9125 now acts as a receptacle.

As fluid continues to flow into space 9125, its volume and its pressure in space 9125 increases. At a pressure P1, slightly higher than the normally closed pressure PO of the valve, the inside diameter of the tube will increase to D2, larger than the outside diameter D of the ting. A relatively small, open annular cross section or space (not shown) is thus created between the ting and the tube.

At this stage, the fluid that enters the pulsating valve through inlet 9104 enters space 9125 at a flow Q0 and continues to flow through the annular space around the ring.

A pressure drop dP (hydraulic resistance) is created at this annular space, or anywhere downstream from the ring in response to flow Q0. As a result, the pressure in space 9125 is forced to increase from P1 to P2 and P2=P1+dP. In response to pressure P2 in space 9125, the elastic tube expands and its inside diameter increases from D2 to D3, creating a relatively wide annular space around the ring, as shown in FIG. 9*b*. A volume dV of the fluid which was accumulated in space 9125 now ejects at a high flow Q1 through this annular space, into outlet 9105.

Since the fluid enters space 9125 at a low flow Q0 and ejects from space 9125 at a high flow Q1, the volume dV of fluid in space 9125 decreases and the pressure in this space decreases to a pressure lower than P0. As a result the inside diameter of tube 9101 decreases to a diameter smaller than that of the ring, closing the outlet from space 9125 and terminating one pulsating cycle.

The basic principles by which this pulsating valve operates are the same as that of the pulsating device illustrated in FIGS. 1 to 6 in which a receptacle (B), a normally closed valve (C), and hydraulic resistance (D) are used. FIGS. 9*a* and 9*b* relate to a normally closed pulsating valve in which the above three basic elements (B, C, and D) are created by using only two parts, the rigid insert and the elastic sleeve.

A normally closed valve (C) is created at a section along the insert when an elastic sleeve having an inside diameter DO tightly surrounds the ring formed at this section of the insert with an outside diameter D larger than D0. The elastic sleeve which tightly surrounds the ring creates a normally closed valve (C).

The pulsating valve has no container or receptacle, and a receptacle (B) is created in a space upstream from the ting or the normally closed valve by means of the elastic sleeve which surrounds the insert. At its normal stage, this space may have zero volume.

A second normally closed valve can be created at the inlet to the receptacle when the same elastic sleeve tightly surrounds another diameter of the insert, at a cross section of the insert larger than D0, namely by tightly surrounding the insert and perforations 9112.

The hydraulic resistance (D) can be created in the valve itself (at the annular space around ring) and/or by using any of the means described before in conjunction with FIGS. 1 to 6.

A flow control, a dripper, or other means (A) can be used for controlling the flow into the valve.

Since the same pulsating valve can be used for different applications, namely for operating different types of mini sprinklers (sprinklers and drip tubes as illustrated in FIGS. 12*a* to 12*e*, 24*a*, and 24*b*), or it can be installed in a shower head. Its inlet and its outlet can be made to fit any such device.

The elastic sleeve can be a section of extruded elastic tube or it can be a molded part (like the elastic sleeve of the valve illustrated in FIG. 2).

The elastic sleeve can be held fixed at both of its ends by means of barbs formed on the insert (as illustrated in FIG. 9*a*) or, when using a molded part, by means of a flange, as illustrated in FIG. 2.

The elastic sleeve may be formed with different inside and outside diameters at different cross sections.

The pulsating valve can operate with any fluid, including water, air, or a mixture thereof.

A casing can be used for providing mechanical protection to the elastic sleeve. As the elastic sleeve expands, the space surrounding the elastic sleeve and enclosed in the casing is compressed. This compression may create pressure on the elastic sleeve, causing the pulsating valve to malfunction. A perforation in the casing can be used to prevent such compression.

FIGS. 9*c* and 9*d*—Pulsating Valve With Deflector Outlet

FIGS. 9*c* and 9*d* illustrate a normally closed pulsating valve of type A with its outlet formed into a deflector for controlling the pattern of the ejected flow.

The valve consists of elastic tube 9201, casing 9202, and insert 9203. Insert 9203 has a fluid inlet 9204 and fluid outlet 9205. Casing 9202 has a port 9206 through which space 9207 surrounding elastic tube 9201 is vented.

Section 9208 of insert 9203 has a large outside diameter formed as a barb for holding elastic tube 9201 fixed. An opening 9209 at the bottom of insert 9203 can be used for supporting the valve on a rod. Fluid inlet 9204 has an opening in the form of a cylinder 9210 plugged at its end 9211 and having perforations 9212 at its circumference. At its other end, insert 9203 is formed in the shape of deflector 9213. Section 9214 and step 9215 of insert 9203 are made for connecting casing 9202 to insert 9203. Section 9216 of insert 9203 has an outside diameter that can be used to connect the valve with its outside diameter to a pipe or a fitting. Fluid inlet 9204 has also a space 9217 which can be used for installing a flow control of type B in which a tube 9218 or the like can be installed inside insert 9203 for controlling the flow of fluid Q0 into the pulsating valve.

A flow control, a dripper, a pressure-compensated dripper, or any means for controlling the flow of a fluid into the pulsating valve can be connected to inlet 9204, either by connecting it to the outside diameter of section 9216 or by its inside diameter. Center section 9219 of insert 9203 has an outside diameter smaller than section 9208. Section 9220 of insert 9203 has an outside diameter smaller than section 9219.

Elastic tube 9201 has an inside diameter smaller than the outside diameter of insert 9203 at sections 9219 and 9220.

FIG. 9*c* shows the valve in its closed position.

At this stage the pressure of the fluid at inlet 9204 and at cylinder 9210 is lower than preset pressure P0 of the valve. Also elastic tube 9201 surrounds tightly section 9219 of insert 9203, sealing perforations 9212 and preventing the fluid from flowing from inlet 9204 through the valve to outlet 9205.

FIG. 9*d* shows the valve in its pulsating stage.

When pressure P1 of the fluid at inlet 9204 increases and becomes higher than the preset pressure of the valve, pressure P1 of the fluid forces elastic tube 9201 to expand and its inside diameter to increase to D1 in response to pressure P1.

Fluid at a low controlled flow Q0 then flows from cylinder 9210 through perforations 9212 to space 9221 created between inside diameter D1 of elastic tube 9201 and outside diameter of insert 9203 at section 9219.

The fluid then flows at a low flow Q0 through the small open cross section created around section 9219 and a pressure drop dP is created along section 9219.

In order that the fluid will continue to flow, the pressure at cylinder 9210 has to increase to P2 and P2=P1+dP.

In response to pressure P2, tube 9201's inside diameter increases to D2. At this stage a volume dV of fluid accumulates between tube 9201's inside diameter D2 and the insert's outside diameter at section 9219. The larger open cross sections between insert 9203 at section 9219 and tube 9201's inside diameter D2 allows volume dV of fluid to flow at a high rate Q1 from space 9221 through sections 9219 and 9220 out through valve outlet 9205 created around insert 9203 when tube 9201 expands.

The fluid then flows through port 9206 in casing 9202 to deflector 9213 which controls the pattern of the ejected fluid.

Since the fluid flows out from space 9221 at a high rate Q1 and flows into space 9221 at a low controlled rate Q0, the volume of fluid dV in space 9221 decreases, the pressure of the fluid inside space 9221 decreases, tube 9201's inside diameter decreases and becomes smaller than the outside diameter of insert 9203 at section 9219, and tube 9201 surrounds tightly perforations 9212, preventing the fluid from flowing out from cylinder 9210. This closes the "valve" and terminates one pulsating cycle.

FIG. 9*e*—Normally Open Pulsating Valve—Type B

FIG. 9*e* illustrates a normally open pulsating valve of type B consisting of elastic tube 9301, casing 9302, inlet fitting 9303, and outlet fitting 9304. Inlet fitting 9303 has a fluid inlet 9305 and a port 9306. Space 9307 surrounding elastic tube 9301 is pressurized via port 9306. Outside diameter of inlet fining 9303 at section 9308 is formed as a barb. Sections 9309 and step 9310 of fitting 9303 are formed for connecting casing 9302 to fitting 9303. Outlet fitting 9304 has a fluid outlet 9311 and a barb 9312. Barbs 9308 and 9312 hold tube 9301 fixed.

At the normally open position of the pulsating valve, fluid with a controlled low flow Q0 and a pressure P1 enters fluid inlet 9305 and then flows through tube 9301.

The fluid also enters through port 9306 to space 9307, pressurizing space 9307 with the same pressure P1 of fluid at inlet 9305. As a result of friction loss in tube 9301, a pressure drop dP is created along tube 9301 and pressure P1 inside tube 9301 at its inlet 9313 drops to P2 at section 93 14. The pressure surrounding tube 9301 is P1, which is higher than pressure P2 inside tube 9301 at section 9314. As a result, tube 9301 at section 9314 becomes flat, closing the valve. Since at this stage the fluid does not flow, and no pressure drop dP exists, the pressure at section 9314 increases to P1, tube 9301 expands, the valve opens, and a volume dV of fluid ejects from tube 9301 through fluid outlet 9311 at a high flow Q2, terminating one pulsating cycle.

When the pressure at inlet 9305 is increased and becomes greater than a preset pressure PC, tube 9301 becomes flat and the valve stays closed.

The normally open pulsating valve can be produced also with a center rod supported by ribs where the inlet fitting, the outlet fitting, the center rod, the fibs, and the barbs are produced as one unit, an insert.

FIGS. 10*a* and 10*b*—Self-Cleaning Filter In Form Of Pulsating Valve

FIGS. 10*a* and 10*b* illustrate a self-cleaning filter having a pulsating valve structure. The construction of this valve is the same as the type A pulsating valve described in FIG. 9*a* in which part of the elastic tube section is perforated creating a "screen".

The valve consists of elastic tube 10101, casing 10102, and insert 10103. Insert 10103 has a fluid inlet 10104 and a fluid outlet 10105. Casing 10102 has a port 10106 through which space 10107 surrounding elastic tube 10101 can be vented. Port 10106 is also the filtered fluid outlet. Insert 10103 has a barb 10108 for holding elastic tube 10101 fixed. Insert 10103 has a hole 10109 by which the valve can be supported on a rod.

In one preferred form of such valve, fluid inlet 10104 has a hole in the form of a cylinder 10110 plugged at its end 10111 and has perforations 10112 at its circumference. Fluid outlet 10105 has an opening in the form of a cylinder 10113 plugged at its end 10114 and having perforations 10115 at its circumference. Section 10116 of insert 10103 and step 10117 are formed for connecting casing 10102 to insert 10103.

The outside diameter of insert 10103 at section 10118 can be used for connecting the valve with its outside diameter at the fluid inlet to a fluid supply pipe or fining. Fluid inlet 10104 also has an opening in the form of a casing 10119 for a flow control type B and, as an option, the flow through the valve can be controlled by elastic tube 10120. Center section 10121 of insert 10103 has an outside diameter smaller than section 10108. Section 10122 has a larger diameter than section 10121 and smaller than section 10108. Section 10123 has an outside diameter smaller than that of section 10121 and section 10124 has an outside diameter larger than section 10123. Outside or inside diameters of section 10125 can be used for connecting a deflector to the valve.

Elastic tube 10101 surrounding insert 10103 at part of section 10121, between perforations 10112 and section 10122, is perforated forming a "screen". Elastic tube 10101's inside diameter is smaller than the outside diameter of the insert at sections 10121 and 10123 and it surrounds tightly insert 10103.

FIG. 10*a* shows the filter valve in its closed position. When the pressure of the fluid at cylinder 10110 is lower than preset pressure P0 of the valve, elastic tube 10101 surrounds tightly section 10121 and perforations 10112, preventing from the fluid from flowing out of cylinder 10110 through perforations 10112 and the valve stays closed.

FIG. 10*b* shows the filter valve in its filtering stage. When pressure P1 at cylinder 10110 is higher than a preset pressure P0, the fluid pressure forces tube 110101 to expand and its inside diameter at section 10121 increases to D1, larger than the outside diameter of insert 10103. The fluid then flows from space '10126 through the perforations of the "screen" to space 10107 and out through port 10106.

When the perforations of tube 10101 at its "screen" portion get plugged, the filter valve is converted to a pulsating valve, the pressure inside space 10126 increases, tube's inside diameter becomes larger than the outside diameter of insert 10103 at section 10122, and fluid then ejects at a high pulsating flow from space 10126. The fluid is ejected through the open cross section created between tube 10101's inside diameter and the outside diameter of insert 10103 at sections 10121, 10122 and 10123, through perforations 10115 and cylinder 10113 out through outlet 10105. This flushes the "screen" allowing the fluid to flow again through the "screen".

FIG. 11*a* To 11*h*—Various Pumps

FIGS. 11*a* to 11*h* illustrate different types of pumps having a pulsating valve structure and different applications of these pumps.

FIG. 11*a* illustrates a fluid injection pump. The pump has a similar construction to that of a type A pulsating valve shown in FIG. 9*a*.

The injection pump consists of elastic tube 11101, a casing 11102, and an insert 11103. Insert 11103 has a fluid inlet 11104 and a fluid outlet 11105. Casing 11102 has a port 11106 through which any fluid surrounding the pump can enter into space 11107 surrounding elastic tube 11101. Section 11108 of insert 11103 has a large outside diameter in the form of a barb for holding elastic tube 11101 fixed. Insert 11103 has an opening 11109 by which the pump can be supported on a rod. Fluid inlet 11104 has an opening in the form of a cylinder 11110 plugged at its end 11111 and perforations 11112 at its circumference.

Fluid outlet 11105 has an opening in the shape of a cylinder 11113 plugged at its end 11114 and having perforations 11115 at its circumference. Section 11116 of insert 11103 and step 11117 are made for connecting casing 11102 to insert 11103. Outside diameter of section 11118 can be used as an option for connecting a fluid supply pipe or fitting to the pump. Fluid inlet 11104 has an opening in the form of a casing 11119 for a type B flow control by which an elastic tube 11120 can be used for controlling flow into the pump. Center section 11121 of insert 11103 has an outside diameter smaller than its diameter at section 11108 and larger than its diameter at section 11122. Inside and outside diameters of insert 11103 at section 11123 can be used for connecting a pipe or a fitting for delivering the discharged fluid from the pump.

FIG. 11*a* a shows the injection pump at the stage in which the "pulsating valve" is closed and a fluid M which surrounds the pump enters its casing 11102 through port 11106 filling space 11107.

FIG. 11*b* shows the stage at which fluid N enters the pump at a flow Q1 from its fluid inlet 11104, causing elastic tube 11101 to expand, pressing tube 11101 against casing 11102, sealing port 11106, and increasing the pressure of fluid M in space 11107. Fluid M then flows through an open space 11124 created between section 11122 of insert 11103 and tube 11101 which is forced to expand and increase its inside diameter in response to the pressure of fluid N that flows through the pump in pulses. Fluid M then enters cylinder 11113, mixing and ejecting with fluid N. The mixture then flows through the pump outlet 11105 at a flow Q3 and Q3=Q1+Q2.

FIGS. 11*c* And 11*d*—Fluid-Driven Pump

FIGS. 11*c* and 11*d* illustrate a "fluid-driven pump" consisting of a type A pulsating device. Its casing has one port through which fluid M enters the pump, when the pulsating valve is at its closed position, and a second port through which fluid M is discharged from the pump at a higher pressure, when fluid N flows through the pulsating valve, forcing it to pulsate.

The pump consists of an elastic tube 11201, a casing 11202 and an insert 11203. Insert 11203 has a fluid inlet N 11204 and a fluid outlet N 11205. Casing 11202 has a port 11206 through which fluid M surrounding the pump can enter space 11207 surrounding elastic tube 11201. Casing 11202 has a second port 11208 trough which fluid M can be ejected from space 11207. Insert 11203 has a hole 11209 by which the pump can be supported on a rod. Fluid N inlet 11204 has an opening formed in the shape of a cylinder 11210 plugged at its end 11211 and having perforations 11212 at its circumference. Fluid outlet 11205 (N) has an opening in the form of a cylinder 11213 plugged at its end 11214 and having perforations 11215 at its circumference. Section 11216 of insert 11203 and step 11217 are made for connecting casing 11202 to insert 11203.

Section 11218 of insert 11203 can be used for connecting the pump at its outside diameter to a fluid supply pipe N or a fitting.

Fluid inlet 11204 (N) has also a hole 11219 in the form of a casing for a type B flow control. The flow Q1 of fluid N into the pump can be controlled by an elastic tube 11220.

Section 11221 of insert 11203 has a large outside diameter in the form of a barb for holding elastic tube 11201 fixed. Center section 11222 has an outside diameter smaller than that of section 11221. Section 111223 has an outside diameter smaller than that of section 11222, and section 11224 has an outside diameter larger than that of section 11223.

The outside and inside diameters of sections 11225 can be used for connecting a discharge pipe to fluid outlet 11205 (N).

FIG. 11*c* shows the pump at the stage in which the "pulsating valve" is at its closed position and fluid M flows through port 11206 into space 11207, filling it.

FIG. 11*d* shows the pump at the stage in which fluid N enters the pump through valve inlet 11204, causing it to pulsate. Elastic tube 11201 expands, pressing against casing 11202, sealing port 11206, pressurizing the fluid in space 11207, and forcing it to eject through port 11208 at a flow Q2 while fluid N is ejected through valve fluid N outlet in a pulsating flow.

FIG. 11*e*—Injection Pump

FIG. 11*e* illustrates an arrangement of the injection pump of FIG. 11*a* a pumping water from a reservoir M at a flow Q2, mixing it, and ejecting it with water N that enters the pump at a flow Q1 from source N. The mixture flows out at a total flow Q3=Q1+Q2.

The system consists of the injection pump of FIG. 11*a* a connected to water supply pipe 11302, a check valve 11301 connected to outlet of injection pump 11*a*, and a pipe 11303 connected to outlet of check valve 11302. Water M in the reservoir is at elevation 11304 and it flows by gravity at a rate Q2 into the pump through its port 11106.

Water N enters the pump at a flow Q1 and flows out from it at a flow Q3=Q1+Q2.

FIG. 11*f*—Pump

FIG. 11*f* illustrates A pump 11/2 that pumps water from a reservoir when water from a source flows through the pump.

The installation consists of the pump of FIG. 11*c* and a check valve 11401 connected to a fluid outlet of the pump. Fluid water supply pipe 11402 discharges fluid from pipe 11403. Check valve 11404 is connected to port 11208 of the pump of FIG. 11*c* and fluid discharges from pipe 11405 connected to the outlet of check valve 11404. Water in a reservoir is at elevation 11406 and it flows by gravity at a rate of Q2 into port 11206 of the pump of FIG. 11*c*, filling space 11207 of the pump when the "pulsating valve" is in its closed position. Fluid that flows from pipe 11402 through the pump of FIG. 11*c*, valve 11401, and discharge pipe 11403 causes the valve to pulsate and fluid to be ejected at an elevated pressure from space 11207 of the pump of FIG. 11*c* through its port 11208. Check valve 11404 discharges pipe 11405. By operating the pump of FIG. 11*c* as described when fluid flows through the pump at a flow Q1, water M is pumped and ejected at a flow Q2 at an elevated pressure from the reservoir.

FIGS. 11*g* and 11*h*—Fluid Driven Pump With Soaping Device

FIGS. 11*a* and 11*h* illustrate a soaping device consisting of the "fluid driven pump" of FIG. 11*c* with a liquid soap container 11501 connected to port 11208 of the pump. The device is connected to a faucet which supplies water N to the fluid inlet N of the valve. Container 11501 is filled with liquid soap.

FIG. 11*g* shows the valve in its closed position. Liquid soap from container 11501 flows through port 11208 into space 11207 of this pump.

FIG. 11*h* shows the device in its soaping position. Water N flows through the pump of FIG. 11*c*, causing the pulsating valve to pulsate. Air enters port 11206 of the pump and flows out with the liquid soap at space 11207 of the pump and through port 11208 into container 11501, through liquid soap 11502 in container 11501. It converts the liquid soap to foam which flows by gravity to pump outlet 11205 where it is mixed and ejected with the water that flows at a high pulsating flow.

The pumps described in these figures have the same construction as pulsating valves of type A as in FIGS. 9*a* to 9*e* with the port in the casing located opposite the perforations at the inlet to the "receptacle container" of the pulsating valve. The perforations at the inlet to the receptacle container, are located at one of its ends and the fluid flows out from the container at its other end.

At the closed position of the pulsating valve, the volume of fluid in the receptacle container is zero and the elastic tube surrounds tightly the insert. At this stage a fluid M which surrounds the valve enters the casing of the valve through its port. When fluid N enters the pulsating valve inlet, the elastic tube expands, pressing against the port at the casing, sealing it and compressing fluid M against the casing wall.

The injection pump of FIG. 11*a* is a pump as described in which fluid M enters the casing of the pump at a flow Q1, fluid N enters the pump at a flow Q2, and the two fluids are admixed and ejected through the pump's outlet as a mixture with a flow Q3=Q1+Q2.

In the fluid driven pump of FIG. 11*c*, fluid M enters the casing of the pump at one port, is pressurized, and flows out from the pump through a second port in the casing. When fluid N enters the pump's inlet, it causes it to pulsate and become ejected through the pump's outlet.

When fluid N is water and fluid M is air, the pump is a water-driven Compressor.

When fluid N is air and fluid M is water, the device is an air-driven pump.

FIG. 11*e* illustrates the pumping water from a reservoir by means of injection pump.

When the injection pump of FIG. 11*c* is installed in a reservoir M, water N at a flow Q1 enters the pump's inlet while water M enters the pump through the casing port at a flow Q2. A total flow Q3=Q1+Q2 flows out from the pump.

FIG. 11*f* illustrates the pumping of water from a reservoir by an air-driven fluid pump.

Assume the pump of FIG. 11*c* is installed in a reservoir with water M. When water N flows through the pump and causes it to pulsate, water M enters the pump through one port in its casing and flows out at a higher pressure from a second port at the casing.

The soaping device of FIG. 11*g* functions as a "water driven compressor" with a liquid soap container connected to the air outlet at the casing of the pump. The device is connected to a faucet. When water flows through the liquid soap, it converts it to foam which flows by gravity to the pump's outlet where it is mixed and eject with the water that flows out from the pump at high pulsating flow.

FIGS. 12*a* to 12*e*—Pulsating Spray Heads, Mini- & Rotating Sprinklers & Driplines FIGS. 12*a* to 12*e* illustrate pulsating low flow spray heads, minisprinklers, rotating sprinklers, and driplines for irrigation.

FIG. 12*a* shows a pulsating spray head such as shown in FIG. 9*a* or FIG. 9*c* connected by means of a rigid riser 12101 and tee 12102 to a rigid pipe 12103.

A low flow Q2 of water flows from pipe 12103 through riser 12101 and through a flow control installed inside the pulsating valve of FIG. 9*a* at which the low continuous flow Q2 is converted to a high pulsating flow Q1 which ejects through a deflector connected at the outlet of the pulsating valve of FIG. 9*a* or is formed at the outlet of the pulsating valve of FIG. 9*c*. The high ejected flow Q1 that flows through the deflector is sprayed to a large designated area.

FIG. 12*b* shows a pulsating spray head such as shown in FIGS. 9*a* or FIG. 9*c* installed with its outlet below its inlet and connected by means of a riser 12201 and a tee 12202 to pipe 12203. Such an arrangement can be used, e.g., in greenhouses.

FIG. 12*c* shows a pulsating spray head such as shown in FIG. 9*a* or FIG. 9*c* connected to a flexible tube 12301 by means of flexible tube 12302. The pulsating spray head of FIG. 9*c* is supported with a rod 12303 which is inserted into ground 12304.

FIG. 12*d* shows pulsating spray heads such as shown in FIG. 9*a* connected to the outlets of rotating sprinkler 12401. The pulsating valve can be also installed at the inlet to the sprinkler head.

FIG. 12*e* shows a pulsating drip tube in which irrigation tube 12501 supplies irrigation water through a pressure compensated dripper 12502 which supplies a low controlled flow Q2 to a pulsating valve 12503. The low flow Q2 that enters the pulsating valve from dripper 12502 is converted to a high pulsating flow Q1 that flows through fitting 12504 to tube 12505 and out through perforations 12506. The high pulsating flow Q2 that flows through perforations 12506 allow the size of these perforations to be very large, yet the amount of water that flows through each perforation is very small and equal to the amount of water that flows through dripper 12502 divided by the number of perforations in tube 12505.

FIG. 13—Plant Frost Control System

FIG. 13 illustrates a plant frost control system consisting of a screen 13101 surrounding a plant 13102 and a pulsating sprinkler 13 103 connected with a riser 13104 a to water supply pipe 13105. Screen 13101 floats and is supported by plant 13102 and is held fixed by a mound of dirt 13106. By operating pulsating sprinkler 13103, a layer of water 13107 is held by screen 13101. At a low temperature of 32° F. a layer of water is converted to ice, forming an "igloo" which isolates a volume of air 13108 which surrounds plant 13102.

The theory by which this system operates is exactly the same theory by which the Eskimo igloo operates. The system provides an igloo which surrounds the item that is to be protected from frost.

The frost protection system according to this method consists of two basic elements: A sheath for covering the item that needs frost protection, and a pulsating spray head for wetting the sheath by applying small rates of water.

When the temperature drops to 32° F. the water on the sheath is converted to ice, creating an igloo which surrounds the item that needs protection.

The sheath should be made and installed according to the following specification: The sheath can be made of any material that can be wetted. Water can be held by the sheath in different ways: By absorption, e.g., the sheath can even be paper, or by surface tension, e.g., a screen made of certain materials and having perforations of a certain size and shape.

To assure good protection, the igloo should be completely sealed. (An opening in the igloo will allow wind to flow through and the warm air inside the igloo will be replaced by cold air from outside.) For this purpose the sheath has to be installed in such a way that it will be completely wet by the sprayer.

Plants have some specific requirements:

Plants need light and they cannot be covered for a long period of time by a material that blocks the light.

The space surrounding the plants has to be vented.

The plants require different treatments. e.g., chemical spraying, fertilizing, irrigation, etc.

In a large grove, covering the trees a short time before frost is expected and uncovering the trees a short time after the frost passes is practically impossible. Instead a screen can be used. By using a screen, the space surrounding the plant is vented and has light. At the end of the frost the ice on the screen melts. The light can immediately penetrate through the screen and so does fresh air. By using screens, the plants can be covered a substantial period of time before frost is expected and uncovered a long time after the frost.

Different types of screens can be used made of different materials. The screens can be durable, disposable or degradable and of a suitable degree of porosity or opening size.

For some applications floating screens can be used. Such screens are supported by the plants themselves. Other supporting means can also be used if needed.

In order to wet the screen any type of sprinkler can be used. However a sprinkler with a high rate of water application will create a heavy layer of ice which will cause the screen to collapse. Sprinklers can apply small quantities of water when controlled by a timer. During frost, if the sprinklers do not operate, the water freezes in the sprinkler risers and nozzles. As a result operating high flow sprinklers in cycles is not a practical solution.

On a large ranch, in order to protect all the plants, all the screens covering all the plants should be wetted at the same time, all the time. Most irrigation systems cannot operate this way because of their high flow. Most sprinklers systems operate in cycles. At the end of each irrigation cycle, the water from the pipes, or from some of them, drains through the sprinkler nozzles and a certain time is wasted during the time in which the pipes are filled again.

The pulsating sprinklers provide a solution for those problems. They can apply a low application of water to each screen, all the pulsating sprinklers can be operated at the same time and controlled by one valve, the pipes do not drain, and no time is wasted to refill the pipes. Such a system can be connected to a temperature sensor which automatically operates the system at a preset temperature. The pulsating sprinklers can be installed inside or outside the igloo, providing they fully wet the screens. A pulsating sprinkler installed inside the igloo has a few advantages:

As long as the pulsating sprinkler is operating, water and energy is added to the isolated volume, elevating its temperature.

The same pulsating sprinkler can be used for irrigation at regular times.

Since the pulsating sprinkler itself is protected by the igloo, water won't freeze in the sprinklers and they can be operated in cycles ff needed.

FIG. 14*a* to 14*c*—Self-Cleaning, Low-Flow, Pulsating Pop-Up Sprinkler

FIGS. 14*a* to 14*c* illustrate a self-cleaning, low-flow pulsating pop-up sprinkler consisting of casing 14101, a casing fluid inlet fitting 14102, a casing outlet fitting 14103, a sliding guide 14104, a riser 14105, an O-ring 14106, a pulsating low flow sprayer 14107, and a sleeve 14108. Sliding guide 14104 is a filter in the form of a cylinder with riser 14105 fitting tightly its open end 14109. Outlet fitting 14103 has an inside diameter 14110 larger than the outside diameter of riser 14105. A space 14111 is created at outlet fitting between its inside diameter 14110 and outside diameter of riser 14105.

The outside diameter of sliding guide 14104 and of O-ring 14106 is smaller than the inside diameter of casing 14101.

FIG. 14*a* shows the pop-up pulsating sprayer at its low position. In this position the pressure at casing inlet 14112 is low and no water flows into pop-up casing 14101.

FIG. 14*b* shows the pop-up sprayer in its rising stage. At this stage the irrigation valve which controls the flow to the lateral is turned on and pressurized water flows through casing inlet 14112 into casing 14101. Water in this position flows to space 14115 between fluid inlet 14112 and sliding guide 14104 and then around the screen at space 14113, flushing the screen. The flushing water then flows out through space 14113, space 14114, and space 14111 out from the casing outlet, which at this stage is open.

The pressure in space 14115 at this stage is lower than the preset pressure P0 of pulsating spray head 14107 and no water flows through normally closed pulsating spray head 14107. Fluid enters casing inlet 14112 at a flow Q1 and flows to space 14115. Some of the fluid flows at a rate of Q2 out from casing 14101 through space 14113, space 14114, and space 14111. The rest of the fluids, having a flow Q3=Q1−Q2 is used for increasing volume of space 14115, forcing sliding guide 14106, O-ring 14104, riser 14105, and sprayer 14107 to move up to their highest elevation.

FIG. 14*a* shows the pulsating pop-up sprayer in its open position. At this stage sliding guide 14104 is pressing "O ring" 14106 against the bottom of outlet fitting 14103, sealing space 14111. The pressure in space 14115 increases to P2, higher than preset pressure P0 of the pulsating sprayer, and fluid flows through filter 14104 to riser 14105 and to pulsating sprayer 14107 at a low flow Q0, wetting a large designated area.

At any new irrigation cycle, fluid at a flow Q2 flows through space 14113, flushing filter 14104 and ejecting the flushing fluid through open space 14111.

Since the pulsating sprinkler is normally closed, during the lifting stage of the sprinkler, no water flows through the sprinkler.

The sprinkler operates at a low flow Q0 which is controlled by the flow control or by a pressure-compensated dripper at the inlet to the pulsating valve. As a result, the flow that enters the casing of the pop-up sprinkler at the lifting stage and the operating flows are low. And when the pop-up sprinklers operate, each sprinkler can have the same flow, regardless of the pressure in the irrigation system.

Since the required flows at the lifting and operating stages are low, a small size pop-up casing and riser can be used.

The height to which the pop-up sprayer can be lifted is theoretically unlimited.

The sliding guide of this pop-up sprayer can be a screen which filters the water that flows through the flow control and the pulsating sprayer. The screen is flushed at each new irrigation cycle.

FIGS. 15*a* to 15*b*—Different Outlets On Same Pipe

FIGS. 15*a* To 15*b* illustrate by diagram mid structure a method and devices for controlling different outlets connected to the same pipe and operating separately by changing the pressure in the pipe.

FIG. 15*a* shows a "limiting valve" consisting of a normally closed valve which opens itself at a preset pressure P0 connected to the outlet of a normally open valve which closes itself at a preset pressure PC higher than P0.

Fluid can flow through such a limiting valve from its fluid inlet 15101 to its fluid outlet 15102 only when its pressure at fluid inlet 15101 is in the range from P0 to PC. At any pressure lower than P0 at fluid inlet 15101 to the limiting valve, the normally closed valve eliminates the fluid from flowing through the valve. At any pressure higher than PC at fluid inlet 15101 to the limiting valve, the normally open valve eliminates the fluid from flowing through the valve.

FIG. 15*b* is a schematic drawing showing an example of a system consisting of six groups of outlets connected to the same pipe and operating separately by changing the pressure in the pipe.

Group 15201 consists of a normally open valve with a preset closing pressure PC=20 psi. It is connected to outlet 15202 from pipe 15203.

Group 15204 consists of the limiting valve of FIG. 15*a* with a pressure opening range of 25 to 30 psi and connected to outlet 15205 from pipe 15203.

Group 15208 consists of the limiting valve of FIG. 15*a* with a pressure opening range of 30 to 35 psi and connected to outlet 15209 from pipe 15203.

Group 15210 consists of the limiting valve of FIG. 15*a* with an opening range of 25 to 40 psi connected to outlet 15211 from pipe 15203.

Group 15212 consists of a normally closed valve with a preset opening pressure of 40 psi connected to outlet 15213 from pipe 15203. The pressure in pipe 15203 is controlled by valve 15214.

At any pressure lower than 20 psi at pipe 15203, fluid flows out from pipe 15203 only through outlet 15202 and group 15201.

At any pressure ranging from 20 to 25 psi at pipe 15203, fluid flows only through outlet 15205 and group 15204.

At any pressure ranging from 25 to 30 psi at pipe 15203, fluid flows out from pipe 15203 only through outlet 15207 and group 15206.

At any pressure ranging from 30 to 35 psi at pipe 15203, fluid flows out from pipe 15203 only through outlet 15209 and group 15208.

At any pressure ranging from 35 to 40 psi at pipe 15203, fluid flow out from pipe 15203 only through outlet 15211 and group 15210.

At any pressure higher than 40 psi at pipe 15203, fluid flows out from pipe 15203 only through outlet 15213 and group 15212.

FIGS. 16 To 16*d*—Normally Open Hydraulic Valves

FIGS. 16*a* To 16*d* illustrate two types of normally open hydraulic valves.

FIGS. 16*a* and 16*b* illustrates a normally open hydraulic valve (type A) consisting of elastic tube 1101, casing 1102, inlet fitting 1103, and outlet fitting 1104. Inlet fitting 1103 has a fluid inlet 1105 and outlet fitting 1104 has a fluid outlet 1106. Casing 1102 has a port 1107 through which space 1108 surrounding elastic tube 1101 can be pressurized for closing the valve, or vented for opening the valve. Inlet fitting 1103 has a barb 1109 and outlet fitting 1104 has a barb 1110. Barbs 1109 and 1110 are made for holding the elastic tube 1101 fixed.

FIG. 16*a* shows the hydraulic valve in its normally open position when space 1108 is vented. Fluid in this position of the valve can flow from fluid inlet 1105 through elastic tube 1101 and out through fluid outlet 1106.

FIG. 16*b* shows the valve in its closed position when space 1108 is pressurized. Elastic tube 1101 becomes flat with its walls pressed against each other, closing the valve and eliminating fluid from flowing from fluid inlet 1105 to fluid outlet 1106.

As shown in the figure, the valve comprises an elastic tube installed inside a rigid casing having fluid inlet, fluid outlet, and a port through which the space surrounding the elastic tube is pressurized for closing the valve and vented for opening the valve. At the normally open position of the valve, fluid flows through the elastic tube and out through the valve's outlet.

When the space surrounding the elastic tube is pressurized, the elastic tube becomes flat and its walls become pressed against each other, closing the valve.

FIGS. 16*c* and 16*d* illustrate a normally open hydraulic valve (type B) which has the same shape as the normally open hydraulic valve (type A) in which inlet fitting and outlet fitting are connected by means of a center red.

This valve consists of elastic tube 1201, casing 1202, and insert 1203. Insert 1203 has a fluid inlet 1204 and fluid outlet 1205.

Casing 1202 has a port 1206 through which space 1207 surrounding tube 1201 is pressurized for closing the valve and vented for opening the valve. Insert 1203 has a large outside diameter formed as barbs 1208 and 1209 by which elastic tube 1201 is held fixed. Insert 1203 has a center rod 1210 and supporting ribs 1211 at inlet 1204 and 1212 at outlet 1205. This allows inlet fitting 1204, outlet fitting 1205, center rod 1210, supporting ribs 121 1 and 1212, and barbs 1208 and 1209 to be produced as one part-insert 1203.

Elastic tube 1201 has an inside diameter which is larger than the outside diameter of center rod 1210.

FIG. 16*c* shows normally open hydraulic valve (type B) in its normally open position.

At this position, fluid can flow from fluid inlet 1204, bypassing ribs 1211, through space 1213, surrounding center rod 1210, bypassing ribs 1212, and out through fluid outlet 1205.

FIG. 16*d* shows the normally open hydraulic valve (type B) in its closed position.

At this stage space 1207 is pressurized, elastic tube 1201 is pressed against center rod 1210 surrounding tightly rod 1210, and eliminating the fluid from flowing from fluid inlet 1204 to fluid outlet 1205, closing the valve.

The normally open hydraulic valve may also include a center rod as shown with an outside diameter smaller than the inside diameter of the elastic tube. The center rod is supported between the inlet and the outlet by means of ribs or the like.

At the normally open position of the valve, fluid flows from the inlet, bypassing the ribs, through the space created between the elastic-tube and the rod, bypassing the ribs at the outlet and out through the fluid outlet. At its closed position the elastic tube surrounds tightly the center rod.

FIGS. 17*a* And 17*b*—Normally Closed Hydraulic Valve

FIGS. 17*a* And 17*b* illustrate a normally closed hydraulic valve consisting of elastic tube 2101, casing 2102, and insert 2103. Insert 2103 has a fluid inlet 2104 and a fluid outlet 2105. Casing 2102 has a port 2106 through which space 2107 surrounding elastic tube 2101 can be pressurized or vented. Insert 2103 has large outside diameter in the form of barbs 2108 and 2109 for holding elastic tube 2101 fixed. Insert 2103 has a center rod 2110, supporting ribs 2111 at inlet 2104, and ribs 2112 at outlet 2105. Section 2113 of rod 2110 has a diameter larger than the inside diameter of elastic tube.

The term "barbs" refers to transverse projections on the insert which serve to define the diameter of the insert and retain the tubular elastic member. In most cases the tube ends will be held in position by elastic tension, but where necessary, cementing may also be used at such points.

FIG. 17*a* shows the normally closed hydraulic valve in its normally closed position. In this position elastic tube 2101 surrounds tightly rod 2110 at its large diameter portion 2113, eliminating any fluid flow from valve fluid inlet 2104 to fluid outlet 2105.

FIG. 17*b* shows the normally close hydraulic valve in its open position. In this position the pressure of the fluid at inlet 2104 is higher than the preset pressure P0 of the valve, and the pressure of the fluid forces elastic tube 2101 to expand, its inside diameter to increase and become larger than the outside diameter of center rod 2110 at section 2113. This allows the fluid to flow from inlet 2104, bypassing ribs 2111 through elastic tube 2101 and space 2114 created around rod 52110 at its large section 2113, bypassing ribs 2112 and out through outlet 2105. At this stage the valve can be closed by pressurizing space 2107 or by decreasing the pressure at fluid inlet 2104 below preset pressure P0 of the valve.

This valve has the same construction as that of a normally open hydraulic valve with the elastic tube surrounding a center rod. Pan of the rod has a diameter larger than the inside diameter of the elastic tube. In its normally closed position, the elastic tube surrounds tightly the large portion of the rod, preventing fluid from flowing through the valve. This hydraulic valve will open itself when the port in the casing is vented and the pressure at the valve inlet is higher than preset pressure P0. The valve will close itself when the pressure at the inlet is reduced to a pressure lower than P0 or when the space surrounding the elastic tube is pressurized through the port in the casing.

FIGS. 18*a* And 18*b*—Normally Closed Valve

FIGS. 18*a* and 18*b* illustrate a normally closed valve consisting of elastic tube 3101, casing 3102, and insert 3103. Insert 3103 has a fluid inlet 3104 and a fluid outlet 3105. Casing 3102 has a port 3106 through which space 3107 surrounding the elastic tube is vented.

Insert 3103 has barbs 3108 and 3109 by which elastic tube 3101 is held its place. Fluid inlet 3104 has a hole in the form of a cylinder 3110 plugged at its end 3111 and has perforations 3112 at its circumference. Fluid outlet 3105 has a hole in the form of a cylinder 3113 plugged at its end 3114 and has perforations 3115 at its circumference. Insert 3103 has an outside section 3116 and a step 3117 by which casing 3102 is connected to insert 3103. At inlet 3104, insert 3103 has an outside diameter 3118 that can be used for connecting the pulsating valve at its outside diameter to a fluid supply pipe or a pipe fitting.

Outlet fitting 3105 has an outside diameter 3119 that can be used for connecting the pulsating valve at its outside diameter to a sprinkler or any other device.

The center section of insert 3103 has an outside diameter 3120 larger than inside diameter of elastic tube 3101 and elastic tube surrounds tightly insert 3103.

FIG. 18*a* shows the normally close valve in its normally closed position. In this position elastic tube 3101 surrounds tightly insert 3103, closing perforations 3112 and 3115, eliminating fluid flow from inlet 3104 to fluid outlet 3105, keeping the valve in a closed position.

FIG. 18*b* shows the valve in its open position.

When the pressure of the fluid at fluid inlet 3104 and at cylinder 3110 is increased and becomes higher than a preset pressure P0 of the valve, the pressure of the fluid forces tube 3101 to expand and its inside diameter to become larger than outside diameter 3120 of insert 3103. The fluid then flows from fluid inlet 3104 through cylinder 3110 and perforations 3112 to space 3121 created between insert 3103 and elastic tube 3101, through perforations 3115 to cylinder 3113, and out through outlet 3105. The valve will stay in its open position as long as the pressure at inlet 3104 is higher than preset pressure P0 of the valve.

This valve operates only in response to pressure changes at its inlet. For this purpose a normally closed hydraulic valve with its port in the casing vented can be used. Normally closed valves can also consists of two elements, an insert, and an elastic tube surrounding tightly the insert.

Such a valve comprises an insert in which each of its ends has a cylindrically shaped hole perforated at its circumference and plugged at its end. Both ends are formed as barbs by means of which the elastic tube is held fixed.

The center section of the insert has an outside diameter larger than the inside diameter of the elastic tube. When the pressure at the inlet (or the outlet) is lower than a preset pressure P0, the elastic tube surrounds tightly the center section of the insert and the perforations of the cylinders at the inlet and the outlet. When the pressure P2 at the inlet is higher than P0, the fluid flows from the cylinder at the inlet through the perforation in its circumference to a space created between the outside diameter of the insert and the elastic tube to the perforations of the cylinder at the outlet, then through the cylinder and out from the valve's outlet. The casing is used to protect and support the elastic tube assembly.

FIG. 19—Normally Open, Pressure-Responsive Valve

FIG. 19 illustrates a normally open, pressure-responsive valve consisting of elastic tube 4101, casing 4102, and insert 4103. Insert 4103 comprises a fluid inlet 4104, a fluid outlet 4105, a port 4106 through which space 4107 surrounding tube 4101 is pressurized, barbs 4108 and 4109 by which tube 4101 is held fixed, a center rod 4110 supported by ribs 4111 at inlet 4104 and ribs 4112 at outlet 4105. Insert 4103 has an outside diameter 4113 by which a fluid supply pipe or fitting 4114 can be connected to the valve.

FIG. 19 shows the valve in its normally open position in which fluid can flow from inlet 4104, bypassing ribs 4111 through tube 4101 around center rod 4110, bypassing ribs 4112, and out through outlet 4105.

In space 4107 the fluid has the same pressure as at fluid inlet 4104. When the pressure at the inlet is increased and becomes higher than a preset pressure PC, the force created by the fluid in space 4107 pressing on the outside diameter of tube 4101 becomes larger than the force acting on the inside diameter of tube 4101. As a result the inside diameter of tube 4101 decreases and tube 4101 surrounds tightly center rod 4110, eliminating fluid flow from inlet 4 104 to outlet 4105 and closing the valve. The valve will stay closed as long as the pressure of the fluid at inlet 4104 is higher than preset pressure PC.

This valve has the same construction as that of a normally open hydraulic valve with its pressurizing port connected constantly to a pressure source at the valve's inlet. The elastic tube is exposed to the same pressure inside and outside its circumference. Since the outside diameter of the tube is larger than its inside diameter, force F3 on the tube from outside is larger than force F2 on the inside. The force differential dF=F3–F2 will cause the tube to become flat when it is larger than the resistance dF0 of the tube to become flat at preset pressure PC, according to the conditions described supra.

FIGS. 20*a* and 20*b*—Normally Closed Valve For Spray Heads

FIG. 20*a* and 20*b* illustrate a normally closed valve for spray heads comprising elastic tube 5101, casing 5102, and insert 5103. Insert 5103 has a fluid inlet 5104 and a fluid outlet 5105. Casing 5102 has a port 5106 through which space 5107 surrounding elastic tube 5101 is vented. Insert 5103 has a barb 5108 by which elastic tube 5101 is held fixed. Insert 5103 has a hole 5109 by which the valve can be supported on a rod. Fluid inlet 5104 has a hole in the form of a cylinder 5110 plugged at its end 5111 and having perforations 5112 in its circumference. Insert 5103 has a hole 5113 by which a deflector 5114 is connected to the valve. Insert 5103 has a section 5115 and a step 5116 by which casing 5102 is connected to insert 5103.

Insert 5103 has at its center section an outside diameter 5117 larger than the inside diameter of elastic tube 5101.

FIG. 20*a* shows the valve in its closed position. Elastic tube 5101 surrounds tightly outside diameter 5117 of insert 5103 and perforations 5112, preventing fluid flow from fluid inlet 5104 and perforations 5112 to fluid outlet 5105.

FIG. 20*b* shows the valve in its open position.

Assume that the pressure of the fluid at fluid inlet 5104 and in cylinder 5110 is increased and becomes higher than preset pressure P0 of the valve. The pressure of the fluid forces elastic tube 5101 to expand, its inside diameter becomes larger than the outside diameter 5117 of insert 5103, and the fluid then flows from fluid inlet 5104 and cylinder 5110 through perforations 5112 and space 5118 created between insert 5103 and elastic tube 5101, through outlet 5105 and port 5106 to deflector 5114 which controls the pattern of the flowing fluid.

The fluid will continue to flow through the valve and the deflector 5114 as long as the pressure of the fluid at inlet 5104 is higher than preset pressure P0 of the valve.

As shown, the valve consists of an insert surrounded tightly by an elastic tube and having a cylindrical hole at one end which is the inlet of fluid to the valve. The cylinder is plugged at its end and has perforations at its circumference which communicate with the elastic tube. The outside diameter of the insert at the inlet section is formed as a barb for holding the elastic tube fixed.

The outside diameter of the insert, at its end, is the fluid outlet, from which the fluid flows, when the valve opens and the elastic tube expands, through the space created between the elastic tube and the insert. The fluid flows to a deflector connected to the insert end, which controls the pattern of the ejected fluid. The elastic tube has an inside diameter smaller than the outside diameter of the center section of the insert. When the fluid pressure at the inlet's cylinder is lower than a preset pressure P0, the valve stays closed. When the pressure at the cylinder is higher than the preset pressure P0, the valve opens.

Note that the deflector is connected to the valve without a bridge. Also The fluid does not flow from the valve to the deflector through a nozzle. When the valve is closed, its outlet is closed. Solid particles trapped at the valve's outlet do not change the flow through the valve and cannot eliminate the valve from closing itself at a low pressure. Solid particles trapped at the valve's outlet cause the elastic tube to expand more, flushing them.

FIG. 21—Normally Closed Spray Head

FIG. 21 illustrates a normally closed spray head with a deflector which is an integral part of the insert. The drawing shows the valve in its normally closed position.

The valve consists of elastic tube 6101, casing 6102, and insert 6103. Insert 6103 has a fluid inlet 6104 and a fluid outlet 6105. Casing 6102 has a port 6106 through which space 6107 surrounding elastic tube 6101 is vented. Insert 6103 has a barb 6108 by which elastic tube 6101 is held fixed.

Insert 6103 has a hole 6109 by which the valve can be supported on a rod. Fluid inlet 6104 has a hole in the form of a cylinder 6110 plugged at its end 6111 and having perforations 6112 at its circumference.

Section 6113 and step 6114 of insert 6103 are formed for connecting casing 6102 to insert 6103. The top of insert 6103 is formed in the shape of a deflector 6115. Center section of insert 6103 has an outside diameter 6116 larger than the inside diameter of elastic tube 6101 and elastic tube 6101 surrounds tightly insert 6103.

FIG. 21 shows the valve in its normally closed position.

Elastic tube 6101 surrounds tightly insert 6103 at its outside diameter 6116, sealing perforations 6112 and eliminating fluid flow from fluid inlet 6104 to the fluid outlet 6105.

When the pressure at the fluid inlet 6104 and at cylinder 6110 is increased and becomes higher than the preset pressure P0 of the valve, the pressure of the fluid forces elastic tube 6101 to expand, its inside diameter becomes larger than outside diameter 6116 of insert 6103. The fluid then flows from fluid inlet 6104 and cylinder 6110, through perforations 6112 out through a space created between elastic tube 6101 and insert 6103, through fluid outlet 6105 and port 6106 to deflector 6115 which controls the pattern of the ejected fluid. The valve will stay open as long as the pressure at fluid inlet 6104 is higher than preset pressure P0 of the valve.

This normally closed spray head has the same construction as that of the valve described above, with the deflector being part of the valve itself. The deflector is created by different combinations of the insert and elastic tube 30.

FIGS. 22*a* and 22*b*—Flow Controls

FIGS. 22*a* and 22*b* illustrates two types of flow controls.

FIG. 22*a* illustrates a type A flow control which has a similar construction to that of a normally open valve. The valve consists of elastic tube 7101, casing 7102, inlet fitting 7103, and outlet fitting 7104. Inlet fitting 7103 has a fluid inlet 7105 and a port 7106. A space 7107 surrounding tube 7101 is constantly pressurized at the same pressure of the fluid at fluid inlet 7105. Inlet fitting 7103 has a barb 7108 and also section 7109 and step 7110 for connecting casing 7102 to inlet fitting 7103. Outlet fitting 7104 has a fluid outlet 7111 and a barb 7112. Barbs 7108 and 7112 are formed for holding elastic tube 7101 fixed.

Tube 7101 has a length and inside diameter such that at a certain nominal fluid flow Q0 can pass through tube 7101 without or with a negligible pressure drop along the tube.

When pressure P3 at fluid inlet 7105 increases, a flow increase results in a pressure drop dP in tube 7101. As a result of the pressure drop, the pressure inside tube 7101 drops from P3 to P2 where P2=P3–dP. The force on the outside diameter of tube 7101 becomes larger than the force on the inside diameter of tube 7101. As a result, the inside diameter of tube 7101 between cross section 7113 at the inlet to tube 7101 and cross section 7114 at the outlet from tube 7101 decreases, preventing fluid flow through the valve from increasing.

The range of pressures P3 at which this valve operates as a flow control depends upon the dimensions and physical properties of elastic tube 7101, as well as pressure drop dP created in tube 7101. When pressure P3 of the fluid at inlet 7105 increases and becomes higher than preset pressure PC, the flow control will close itself.

FIG. 22*b* illustrates a type B flow control which operates in the same way the type A flow control operates.

This flow control consists of elastic tube 7201, casing 7202, and insert 7203. Insert 7203 has a fluid inlet 7204 and casing 7202 has a fluid outlet 7205. Casing 7202 has an inside diameter 7206 by which insert 7203 with its outside diameter 7207 is connected to casing 7202. Casing 7202 has also a smaller inside diameter 7208 with slots 7209 at its inside circumference which at section 7210 are deeper than slots 7209. At section 7211, casing 7202 has no slots and casing 7202 has a hole in the form of a cylinder 7212 having an inside diameter smaller than in section 7211. Cylinder 7212 is plugged at its end 7213 and has perforations 7214 at its circumference which are also fluid outlet 7205 of the flow control.

Elastic tube 7201 at its outside diameter fits casing 7202 at its inside diameter 7211.

Fluid flows from inlet 7204 through tube 7201 and out through outlet 7205. At the same time fluid fills slots 7209. As a result pressure P3 of the fluid surrounding tube 7201 is the same as pressure P3 of the fluid at inlet 7204. When the fluid is flowing at a nominal flow Q0, a negligible pressure drop is created along elastic tube 7201.

When pressure P3 increases, a pressure drop dP is created in tube 7201 and the pressure inside tube 7201 drops from P3 at inlet 7215 of elastic tube 7201 to a pressure P2 at outlet 7216 from elastic tube 7201. P2=P3–dP. The pressure inside the tube becomes lower than pressure P3 surrounding tube 7201. As a result the tube's inside diameter decreases, preventing nominal flow Q0 from increasing, thus controlling the flow through the valve.

The flow controls described have the same construction as the construction of a normally open valve. In such a valve, the elastic tube has such dimensions, length, and inside diameter that when pressure P3 at the inlet increases, fluid flows through the tube and a pressure drop dP is created in the tube. As a result, the pressure in the tube drops from P3 at the inlet to the tube to P2 at any cross section along the tube. The space surrounding the tube is connected to the fluid inlet and has the same pressure P3 as the inlet to the tube. Because of the pressure differential dp=P3–P2, the inside diameter of the tube decreases, preventing the flow from increasing, thus controlling it. The conditions at which this valve controls the flow are described above.

The type A flow control tube has the same construction as a normally open valve and consists of a casing, inlet, outlet, and elastic tube connected between the inlet and the outlet fittings. The inlet fitting has a hole through which the space surrounding the elastic tube is pressurized and has the same pressure P3 as at the inlet to the tube. The tube has an inside diameter and a length such that when fluid flows through it at a flow higher than a certain nominal flow Q0, friction loss or pressure drop dP causes the pressure to the tube to decrease from P3 at the inlet to P2 at the outlet. As a result pressure P3 surrounding the tube becomes larger than pressure P2 and the tube is forced to decrease its inside diameter, preventing any increase in flow.

The type B flow control tube operates exactly like the type A tube, although it has a different structure. The type B flow control consists of a casing having a cylindrical inlet plugged at its end and having perforations at its circumference which are the outlet of the flow control.

The cylinder has an inside diameter in which an elastic tube is installed.

The casing has a slot which creates an open space surrounding the tube. A fluid that enters the valve's inlet enters the space surrounding the elastic tube, pressurizing it with the same pressure that the fluid has at the inlet to the tube.

At a nominal flow, the pressure drop along the tube is minor and the pressure surrounding the tube is the same as the pressure at the outlet of the tube.

When the pressure at the inlet to the valve increases, the flow through the tube tends to increase, but a flow increase through the tube results in a pressure drop along the tube. The pressure in the space surrounding the tube becomes larger than the pressure inside the tube. As a result the inside of the tube decreases and this prevents the flow through the valve from increasing, thus controlling it.

Since the flow is controlled by a tube and not by an orifice, a tube with a relatively large open cross section can be used for controlling a low liquid flow.

FIGS. 23*a* to 23*f*—Receptacle Containers

FIGS. 23*a* to 23*f* show different types of receptacle containers.

FIG. 23*a* illustrates a type A receptacle container in its empty position.

The container consists of elastic tube 8101 plugged at one end 8 102 (or closed like a balloon) and an insert 8 103 which incorporates an inlet 8104 of the container which also serves as an outlet of the container. Insert 8103 has a barb 8105 by which elastic tube 8101 is held fixed. Insert 8103 has a hole in the form of a cylinder 8106 plugged at one end 8107 and having perforations 8108 at its circumference. Insert 8103 has at section 8109 an outside diameter smaller than the outside diameter of barb 8105. Tube 8101 has an inside diameter smaller than the outside diameter of insert 8103 at section 8109 and tube 8101 surrounds tightly insert 8103 and perforations 8108, forming a normally closed valve.

Elastic tube 8101 is flat and at this stage the container has zero volume. Fluid can enter the container through inlet 8104 only if its pressure is higher than preset pressure P0 of the valve.

FIG. 23*b* shows the receptacle filled with pressurized fluid.

In order that fluid will enter the container, it has to be injected through inlet 8104 at a pressure P1 higher than preset pressure P0 of the normally closed valve created at the valve inlet/outlet 8104 by tube 8101 which surrounds tightly perforations 8108 at section 8109. A fluid at a pressure P1 higher than P0 forces tube 8101 to expand and the fluid then flows from inlet 8104, through perforations 8108 into space 8110 created when the tube 8101 expands. When a volume dV enters space 8110, the volume of the container itself increases by dV. When the fluid flows into space 8110, the pressure of the fluid in this space increases from zero (atmospheric pressure) to P2. At pressure P2 (lower than P0), injection of the fluid stops.

The fluid can flow out from space 8110 only when its pressure becomes higher than preset pressure P0. The pressure inside space 8110 can be increased by pressing on elastic tube 8101. This causes the pressure inside space 8110 to increase and become higher than P0. The fluid then flows from space 8110 out through outlet 8104. When a volume dV of fluid flows out from the container, the volume of the container itself decreases by dV.

FIG. 23*c* illustrates a type B receptacle in its empty position. The container consists of elastic tube 8201, casing 8202, and insert 8203. Insert 8203 has a fluid inlet 8204 and a fluid outlet 8205. Casing 8202 has a port 8206 through which space 8207 surrounding the tube is vented.

The outside diameter of insert 8203 at section 8208 and step 8209 are made for connecting casing 8202 to insert 8203. Fluid inlet 8204 has an opening in the form of a cylinder 8210 plugged at its end 8211 and having perforations 8212 at its circumference. Fluid outlet 8205 has a hole in the form of a cylinder 8213 plugged at its end 8214 and having perforations 8215 at its circumference.

The outside diameter of insert 8203 at section 8216 is larger than at section 8217 and smaller than at section 8218. Center section 8219 of insert 8203 has an outside diameter smaller than at section 8216 and smaller than its diameter at section 8220. At section 8221 the insert 8203 has an outside diameter larger than in section 8220.

Elastic tube 8201 has an inside diameter smaller than the outside diameter of insert 8203 in its center section 8219. As such tube 8201 surrounds tightly insert 8203.

At this stage a fluid can flow through the valve inlet or outlet only if it is injected at a pressure which is higher than preset pressure P0/1 of the valve at the inlet or P0/2 at the outlet.

FIG. 23*d* illustrates the receptacle container filled with pressurized fluid.

In order to fill the container, a fluid is injected through inlet 8204 at a pressure P1, higher than preset pressure P0/1 of the normally closed valve created by tube 8201 which surrounds tightly the large outside diameter at section 8216 of insert 8203. The pressurized fluid then enters space 8222 created between center section 8219 of insert 8203 and tube 8201, which expands in response to the pressure of the fluid.

At a certain pressure P2 inside space 8222 injection of the fluid into the receptacle terminates. Pressure P2 is lower than preset pressure P0/2 of the normally closed valve created at outlet 8205 by tube 8201 which surrounds tightly outside diameter 8220 of insert 8203.

By pressing on flexible casing 8202 the pressure inside space 8222 increases to P3, which is higher than P0/2 and lower than P0/1 and the fluid flows from space 8222 out through outlet 8205.

When a volume dV of fluid flows out from space 8222, the volume of the receptacle container decreases from VO to V1 and the pressure inside space 8222 decreases from P2 to P4.

When all the fluid stored in space 8222 is forced to flow out from the container, the pressure in space 8222 drops to P5. This means that even the last drop in the container is under pressure. No fluid can enter space 8222, neither from inlet 8204 nor from outlet 8205 unless it is injected at a pressure higher than the preset pressures P0/1 or P0/2. The fluid can be ejected from space 8222 also by pressurizing space 8207 through port 8206 at casing 8202. By pressurizing space 8207 the pressure inside space 8222 increases to P2 higher than preset pressure P0/2 and the fluid is forced to eject from space 8222 out through outlet 8205.

FIG. 23*c* illustrates a type C receptacle in its empty position. It has a normally closed spring loaded valve (not shown) at its outlet.

The container consists of elastic tube 8301, casing 8302, and insert 8303. Insert 8303 has a fluid inlet 8304 and a fluid outlet 8305. Casing 8302 has a port 8306 through which space 8307 surrounding elastic tube 8301 is vented. Section 8308 and step 8309 are made in insert 8303 for connecting casing 8302 to insert 8303. Fluid inlet 8304 has an opening with the shape of a cylinder 8310 plugged at its end 8311 and having perforations 8312 at its circumference. At its outlet 8305 insert 8303 has an opening in the form of a cylinder 8313 plugged at its end 8314 and having perforations 8315 in its circumference. Section 8316 of insert 8303 has an outside diameter larger than the outside diameter of section 8317 and smaller than section 8318. Center section 8319 of insert 8303 has an outside diameter smaller than section 8316 and smaller than of section 8320. Tube 8301 has an inside diameter smaller than the outside diameter of center section 8319 of insert 8303. As such tube 8301 surrounds tightly insert 8303.

In this position, fluid can enter the container only if the fluid's pressure is higher than a preset pressure P0 of the normally closed valve at inlet 8304.

FIG. 23*f* shows the receptacle filled with pressurized fluid. Assume that fluid is injected into the container from inlet 8304 at a pressure P1 higher than the preset pressure P0/1 of the normally closed valve created at section 8317 of insert 8303. The fluid enters space 8321 created between outside diameter 8319 of insert 8303 and elastic tube 8301, which is forced to expand in response to the pressure of the fluid. When the pressure of the fluid is P2, lower than preset pressure P0/1, injection of the fluid terminates. The pressure of the fluid at inlet 8304 drops to zero and the normally closed valve at inlet 8304 closes itself, at sections 8316 and 8317, preventing the fluid in space 8321 from flowing back through inlet 8304. Outlet 8305 is sealed with a normally closed, spring loaded valve.

By pressing on the spring loaded valve, outlet 8305 opens and the fluid flows out from space 8321, through outlet 8305 and the spring loaded valve. When a volume dV of fluid flows out from space 8321, the volume of the container decreases by dV. The pressure of the fluid in space 8321 is in the range from P2 (when the container is full) to P3 (when it is empty to the "last drop"). No fluid can enter space 8321 through inlet 8304 or outlet 8305 unless it is pressurized.

The pressure by which the fluid ejects from space 8321 can be increased by pressing on casing 8302 or by pressurizing space 8307 through port 8306.

Casing 8302 can be also rigid and without port 8306. In this case when a fluid is injected into space 8321, the air in space 8307 is compressed, creating additional pressure on the fluid stored in space 8321.

As shown in the figures, different types of receptacle containers are described which have zero volume when they are empty. When fluid is injected into the containers, the volume of the container increases at the same volume V of the fluid that flows into the container. At the same time the pressure inside the container increases from P1 to P2.

Note that no fluid can penetrate into the container unless its pressure is higher than preset pressure P0. The fluid inside the container is pressurized and it flow out from the container only if its pressure increases to a pressure higher than preset pressure P0 or by turning on a valve at its outlet. The fluid is stored in the container at a pressure P3 when the container is full and a pressure P2 when the container is empty. These pressures are lower than preset pressure P0.

Three types of expandable containers are described as follows:

Type A (FIGS. 23*a* and 23*b*):

This container has the form of a balloon having a fluid inlet at one end and plugged at its other end. Such a balloon can be produced conventionally or by using an elastic tube plugged at the end. The fluid inlet to the container, which is also the fluid outlet, is formed in the same way a normally closed valve is produced. The inlet fitting consists of an insert which is surrounded tightly by the elastic tube which forms the container. The tube can be a flat tube. As such it has zero volume when empty and it can be a regular tube which is compressed. Its volume decreases to zero before liquid is injected into the container through the inlet fitting.

Fluid is injected into the container at a pressure higher than P0, which is the pressure at which the normally closed valve opens. The volume of the fluid inside the container increases and so does its pressure. When the pressure inside the container increases to P1, which is lower than P0, injection of fluid stops, the pressure at the inlet drops to zero, and the valve closes itself. At this stage the container stores a volume of fluid V at a pressure P1. By pressing on the tube, the pressure inside the container increases to P3 (higher than P0) and the fluid flows out through the container's outlet.

When a volume dV flows out from the container, the volume of the container decreases by dV. When all the fluid stored in the container flows out, the pressure inside the container drops to zero, yet no fluid can enter the container unless its pressure is higher than P0.

In order to press the elastic tube and cause the fluid to flow out, different means can be used as follows:

The elastic tube can be pressed by hand.

The container can be installed inside a vented flexible container which, when pressed, the fluid surrounding the elastic tube flows out through the casing vent and the tube is compressed.

By connecting an air pumping device to the casing described above.

Type B (FIGS. 23*c* and 23*d*):

The type B container consists of an insert surrounded tightly by an elastic tube. The insert and the elastic tube are formed with one normally closed valve at the fluid inlet and one normally closed valve at the outlet. The valve at the inlet has a higher preset pressure P0/1 than the preset pressure P0/2 of the valve at the outlet. The insert in the center section has an outside diameter D1 larger than the inside diameter DO of the tube. At the inlet valve, the insert has an outside diameter D2 which controls the pressure P0/1 at which the fluid can enter into the container. The container's center section has an outside diameter D1 smaller than D2. At the outlet valve, the insert has an outside diameter D3 which controls the preset pressure P0/2 at which the valve at the outlet opens. D3 is larger than D1 and smaller than D2.

Fluid is injected into the container at a pressure P1 higher than P0/1. The fluid flows to the center section—the receptacle container. The volume of liquid in the container increases and so does its pressure. When the pressure of the fluid in the container is at a level P3, slightly lower than P0/2, injection of the fluid terminates.

The pressure at the inlet drops to atmospheric pressure and the valve at the inlet closes itself. At this stage the container stores a volume v of fluid at a pressure P3. By pressing on the elastic tube, the pressure of the fluid in the container increases to P4, which is higher than P0/2 and lower than P0/1 and a volume dV of the fluid flows out through the outlet. The volume of the container decreases by dV from V0 to V1 and the pressure of the fluid inside the container decreases from P3 to P3/1.

When all the fluid flows out from the container, the pressure of the last drop is P3/L. At this stage the elastic tube, which has an inside diameter DO smaller than D1, continues to press on the last drop at a pressure P3/L. In order to eject the fluid from the container, the elastic tube can be pressed in different ways, for example by using a flexible vented housing which surrounds the container.

Type C (FIGS. 23*e* and 23*f*)

This container has the same design as the type B container in which the normally closed valve at the outlet is replaced with a normally closed preset spring-loaded valve, commonly used in aerosol containers. Pressurized fluid is ejected from the container through the valve's nozzle when top of the valve is pressed. The receptacle can be installed inside any type of container.

FIGS. 24*a* To 24*c*—Normally Closed Perforated Elastic Tube

FIG. 24*a* illustrates a normally closed perforated elastic tube serving as a dripline for irrigating trees or other plants.

Elastic tube 24101 is connected by means of a tee fitting 24102 to a dripper 24103 which is connected to an irrigation lateral 24104. A normally closed valve or pulsating valve 24105 is connected between tube 24101 and lateral 24104 in parallel to dripper 24103.

Elastic tube 24101 has multiple fine perforations. At any pressure lower than a preset pressure P1 inside the tube, these perforations remain closed or have a very fine size hole d1.

As water from lateral 24104 flows through dripper 24202 into elastic tube 24101, the volume of water inside elastic tube 24101 and its pressure increases to P2, expanding the elastic tube, thereby forcing the size of the fine perforations to increase to a larger size d2. At this point the total flow Q2 of water that flows through dripper 24103 flows out through the multiple perforations in the tube. At this stage, if the tube includes N perforations, then the average flow through each perforation will be q2=Q2/N.

In its normal operating position, the size d2 of the perforations may be very small (a few microns) and they will tend to plug. In order to prevent them from plugging, their size has to be periodically increased to d3. This is achieved by periodically increasing the pressure in the tube from P2 to P3. Normally closed pulsating valve 24105 remains closed at normal operating pressure P2 in lateral 24104. By periodically increasing the presstire in lateral 24104 to a pressure P3, higher than the preset normally closed pressure of the valve 24105, the valve is forced to open.

Water at a higher flow and pressure then enters the elastic tube, causing the size of the perforations to increase from d2 to d3, thereby flushing the holes and preventing them from plugging.

FIG. 24*b* illustrates a normally closed perforated elastic tube which can be used as a drip irrigation tube for any crop. Tube 24201 is connected at one of its ends by means of dripper 24202 and a normally closed or pulsating valve 24204 to lateral 2403. Its other end 24205 is plugged by means of a plug fitting 24206. This tube operates in a similar manner to that of the tube in FIG. 24*a*.

In a system as described, one normally closed valve or pulsating valve can be connected to a group of elastic drip tubes. The normally closed or pulsating valve can be replaced by other means, including a regular valve which can be an automatic or manually controlled valve. The system as described can also be used for distributing different liquids and gases. E.g., it can be used to inject air into water.

FIG. 24*c* illustrates a perforated elastic tube in which the flow through each perforation is pressure compensated. As such it stays the same regardless of the pressure inside the tube. Such tube 124301 has a cross section such that section 24302 of it, in which perforation 24303 is made, is caved into the center of tube 24301. When he pressure inside tube 24301 increases, caved portion 24302 is forced out from the center and the size of the perforations becomes smaller, thus controlling the flow therethrough. At a certain pressure inside tube 24301, its cross section becomes round and at a higher pressure tube 24301 expands and the cross section of perforations 24303 increases, the flow through perforation 24303 increases, and it is flushed.

SUMMARY, RAMIFICATIONS, SCOPE

Accordingly the reader will see that, according to the invention, I have provided a pulsator which can spray fluid and wet a large area next to a tree or other plant by using a very small flow. An irrigation system using such a device is able to receive a very small flow which is much smaller than that of conventional drip or mini-sprinkler systems, and create a large wetted area next to the plants. Also the present device solves or reduces all of the other aforenoted problems.

While the above description contains many specificities, these should not be construed as limitations on the scope of the invention, but as exemplifications of the presently preferred embodiments thereof. Many other ramifications and variations are possible within the teachings of the invention.

Thus the scope of the invention should be determined by the appended claims and their legal equivalents, and not by the examples given.

I claim:

1. A pulsating device having an inlet and an outlet for converting a continuous, relatively low, controlled fluid flow rate entering said inlet of said pulsating device to an intermittent and pulsating high rate of fluid flow ejected from said outlet of said pulsating device, comprising:

(a) an insert having an inlet, an outlet and an outer surface;

(b) an elastic tube which:

(1) normally surrounds and directly contacts at least a major portion of said insert, (2) can be expanded away from said insert to form an expandable chamber between said outer surface of said insert and an inner surface of said elastic tube, (c) said expandable chamber having (a) an inlet portion and (b) an outlet portion intermittently in fluid communication with said inlet and with said outlet of said insert, (d) said inlet of said insert communicating with said inlet portion of said expandable chamber so that fluid flowing into said inlet of said insert will reach said inlet portion of said expandable chamber, (e) said elastic tube, when in said normal state in direct contact with said insert, being shaped so that it directly closes said outlet portion of said expandable chamber so as to (1) prevent fluid communication between said inlet portion of said expandable chamber and said outlet portion of said expandable chamber, and (2) prevent flow of fluid out from said expandable chamber, (f) said elastic tube, when partially expanded in response to fluid pressure within said inlet portion of said expandable chamber exceeding a first predetermined level, being shaped to form a fluid path between said inlet portion of said expandable chamber and said outlet portion of said expandable chamber, (g) said elastic tube, when partially expanded, surrounding and being in contact with said insert in said outlet portion of said expandable chamber and thereby resisting flow of fluid out from said outlet portion of said expandable chamber to said outlet of said insert and thereby causing an increased pressure in said inlet portion of said expandable chamber, resulting in an additional expansion of said elastic tube and opening said outlet portion of said expandable chamber widely and quickly into communication with said outlet of said insert, (h) said pulsating device thus ejecting fluid from said expandable chamber through said outlet of said insert at a high rate of flow so as to cause the volume and pressure of fluid within said expandable chamber to decrease and said elastic tube to close said outlet portion of said expandable chamber in response to decreased pressure, thereby to complete a cycle of an intermittent pulsating flow of fluid through said outlet of said pulsating device.

2. A pulsating device according to claim 1, further including a housing enclosing said insert and said elastic tube.

3. A pulsating device according to claim 2 wherein said elastic tube is also arranged to create a water hammer in response to said outlet portion of said chamber responding quickly and eject said fluid from said expandable chamber at increased pressure and velocity.

4. A pulsating device according to claim 2, further including an annular barb on said insert between said inlet and said outlet thereof, and wherein said elastic tube fully engages said annular barb when said elastic tube normally closes said outlet portion of said expandable chamber.

5. A pulsating device according to claim 2 wherein said elastic tube has a length and has different respective diameters and wall thicknesses at selected locations along said length.

6. A pulsating device according to claim 2, further including a flow control means connected to said inlet of said pulsating device for controlling said continuous low rate of flow of fluid into said inlet of said pulsating device.

7. A pulsating device according to claim 2, further including dripper means connected to said inlet of said pulsating device for controlling said continuous low rate of flow of fluid into said inlet of said pulsating device.

8. A pulsating device according to claim 2 wherein said pulsating device is normally closed but said elastic tube is arranged to open said device to commence said pulsating flow in response to pressure of said fluid in said expandable chamber exceeding a second predetermined level.

9. A pulsating device according to claim 8, further including a deflector affixed to said outlet for controlling the pattern of fluid ejected from said outlet.

10. A pulsating device according to claim 9 wherein said deflector is integral with said insert and is configured to control the distribution pattern of fluid ejected therefrom.

11. A pulsating device according to claim 8 wherein said fluid is water, and further including a plurality of drippers connected to be supplied with water from said outlet of said device.

12. A pulsating device according to claim 8, further including a spray head connected to said outlet of said device, whereby said device is configured as a liquid sprayer.

13. A pulsating device according to claim 12 wherein said spray head is a sprinkler.

14. A pulsating device according to claim 13 wherein said fluid is water, and further including a sheath for enclosing a plant, means for applying water at small application rates using said pulsating device, thus forming a fine layer of water in said sheath, and retaining said water on said sheath so that said water will be converted to ice when a freezing temperature is reached, thereby creating a protected zone about said plant.

15. A pulsating device according to claim 12 wherein said spray head is a mister, whereby said device is useful for cooling a surrounding volume.

16. A pulsating device according to claim 12 wherein said housing contains a plurality of openings for permitting fluid to flow through said openings out from a space inside said housing and surrounding said elastic tube.

17. A pulsating device according to claim 16, further including a second fluid in a space surrounding said housing such that said second fluid can enter said housing from said space surrounding said housing and be compressed and ejected at elevated pressure due to said elastic tube inside said housing expanding and contracting, whereby said device functions as a fluid pump.

18. A pulsating device according to claim 17, further including a pumping system in which water from a reservoir flows by gravity into said housing, whereby said water is mixed and ejected with the fluid that flows into said device through said inlet of said device, thereby pumping water from said reservoir.

19. A pulsating device according to claim 17, further including a pumping system in which water from a reservoir flows by gravity into said housing, through one of said openings and is ejected at elevated pressure through another one of said openings in said housing when said fluid is flowed into the inlet of said device so as to cause said device to pulsate.

20. A pulsating device according to claim 17 wherein said fluid is water, and further including a sprinkler head connected to said outlet of said pulsating device and means for ejecting mixed air and water through said sprinkler head.

21. A pulsating device according to claim 17 wherein said fluid flowing into said inlet of said pulsating device is water and said second fluid is liquid soap, thereby to provide a soaping device.

22. A pulsating device according to claim 17, wherein said housing defines a port and said elastic tube defines perforations which permit fluid that enters said device through its inlet to flow out through said perforations to the space within said housing surrounding said elastic tube and out through said openings in said housing so that when solid particles obstruct said perforations, said device operates as a pulsating valve ejecting said fluid and said solid particles out through said outlet, flushing and cleaning said device.

23. A pulsating device according to claim 1 wherein said fluid is water and further including means connected to said outlet of said device for controlling the distribution pattern of water ejected from said device.

24. A pulsating device according to claim 23 wherein said means for controlling the distribution pattern is a sprinkler by which a low rate of flow of water is sprayed intermittently over a large area in pulses, each having a high rate of flow, whereby said device is configured for irrigating plants.

25. A pulsating device according to claim 1, further including a self-cleaning, pulsating pop-up sprinkler, comprising:

an outer hollow cylindrical casing open at one end and having a fluid inlet at the other end, a hollow cylindrical riser with a pulsating device and a hood positioned within said casing, said riser being shorter in length than said casing and positioned therein to be spaced therefrom and concentric therewith, a base of said riser having a cylindrical screen filter with a gasket positioned around said riser above said screen, and an outlet fining, positioned within said casing at an intermediate point therein and shaped to be engaged by said gasket when said riser is in elevated position, whereby fluid flowing into said inlet of said casing will flush said screen and cause said riser to rise until it contacts said outlet fitting, at which point said fluid will flow through said screen and riser to said pulsating device.

26. A pulsating device according to claim 1, further including a fluid distribution tube made of elastic material, said fluid distribution tube having a plurality of holes therein, said holes in said fluid distribution tube being made by piercing said fluid distribution tube, whereby no material is removed from said fluid distribution tube, so that said holes stay normally closed and open themselves in response to a deformation of said fluid distribution tube created by a stress in the elastic material of said fluid distribution tube in response to increased pressure of a fluid inside said fluid distribution tube.

27. A pulsating device according to of claim 26 in which said fluid is water, said fluid distribution tube has a predetermined length, and said holes in said tube are at a predetermined spacing along said length.

28. A pulsating device according to of claim 27 wherein said fluid distribution tube is connected to a source of water under pressure and is configured as a drip tube for irrigation of plants.

29. A pulsating device according to of claim 27 wherein said fluid distribution tube is connected to a source of water under pressure and is configured as a spray tube for wetting a designated arc adjacent said fluid distribution tube.

30. A pulsating device according to claim 27 wherein said holes are small enough for said fluid distribution tube to function effectively as a misting tube when connected to a source of water under pressure.

31. A pulsating device according to claim 27 wherein said fluid distribution tube has at least two ends, one of which is plugged, and another of which is connected to a supply of water under pressure.

32. A pulsating device according to claim 31 in which said fluid distribution tube is connected to said supply of water through a flow control device controlling the rate of flow of water into said fluid distribution tube.

33. A pulsating device according to claim 1 wherein said insert has a projecting annular ring therearound which divides said expandable chamber into said inlet and outlet portions.

34. A method for converting a continuous fluid flow at a low rate of flow to high intermittent pulsating flow at a high rate of flow, comprising:

(a) supplying fluid at a low controlled flow rate into a receptacle having a relatively low elasticity, said receptacle having an integral fluid inlet means and an integral fluid outlet means;

(b) establishing a body of said fluid under pressure in said receptacle;

(c) said integral fluid outlet means of said receptacle preventing outflow of said fluid from said receptacle until a predetermined pressure is achieved in said receptacle;

(d) said outlet means of said receptacle allowing said fluid to flow out from said receptacle through a resistance so as to force the pressure within said receptacle to increase and force said outlet means to become widely open;

(e) ejecting said fluid from said receptacle and through said resistance at a high rate of flow as a pulse while fluid continues to flow into said receptacle at said low controlled flow rate and, by ejecting said fluid, causing the pressure and the volume of fluid within said receptacle to decrease and allowing said outlet means to close and terminate one pulsating cycle, (f) said supplying fluid being done with a liquid fluid, (g) supplying said liquid at a constant continuous controlled rate to said receptacle and allowing said liquid to flow out of said receptacle through said outlet means until said pressure in said receptacle is diminished to a predetermined level, (h) at the same time (1) restricting said outflow sufficiently to create a water hammer effect to generate a high pressure liquid pulse, and (2) quickly discontinuing emission of liquid until said pressure within said receptacle is again increased to said predetermined level, and (i) repeating said sequence continuously for a desired period of time to produce said high intermittent pulsating flow.

35. A method according to claim 34 wherein said supplying fluid is done with water, and further including discharging said water adjacent to growing plants for irrigation purposes.

36. Apparatus for converting pressurized low continuous liquid flow to a high intermittent pulsating flow, comprising:

(a) a pressure container having low elasticity, (b) means for supplying a continuous flow of liquid thereto at a controlled low flow rate, thereby to establish a pressurized body of liquid within said pressure container, (c) a preset normally closed valve means connected to an outlet of said pressure container, said valve means remaining closed and preventing liquid from flowing out of said pressure container at a lower pressure and opening in response to a preset higher pressure within said pressure container to permit liquid to flow out of said pressure container, said valve means closing itself at said lower pressure, (d) conduit means connected to an outlet of said preset valve means, and (e) resistance means associated with said conduit means providing sufficient resistance to liquid flow through said conduit means to cause said preset valve means, when it opens, to become widely open, thus allowing liquid to be ejected from said pressure container a high rate of flow, thereby causing the volume and pressure of the liquid within said container to decrease and said preset valve means to close.

37. Apparatus according to claim 36 wherein said preset valve means consists of an outer casing surrounding and spaced from a hollow insert having perforations in its side wall, an elastic sleeve covering tightly as outside of said insert and its perforations, additional perforations in said outer casing which are exposed to surroundings of said preset valve means, an expansion space between said outer casing and said sleeve, said expansion space permitting said elastic sleeve to expand into said expansion space when pressure within said insert is increased, thus allowing liquid to flow from said insert out through its perforations and then between as inside of said sleeve and said outside of said insert and out through said outlet of said valve means.

38. Apparatus according to claim 37, further including means for surrounding said outer casing of said valve means with a fluid and including a quantity of said fluid together with said liquid flowing out of said pressure container.

39. Apparatus according to claim 36 wherein said pressure container is formed from a rigid material with low flexibility, such that pressure increase within said container will cause some deformation and thereby increase its volume while under pressure.

40. Apparatus according to claim 36 wherein said container is made of rigid material and includes trapped air in a secondary container therewithin.

41. Apparatus according to claim 36, further including means located within said pressure container for controlling said controlled low flow rate.

42. Apparatus according to claim 36, further including a small inside diameter tube connected to said outlet of said preset valve means for creating said resistance to liquid flow.

43. Apparatus according to claim 36, further including a long tube connected to said outlet of said preset valve means for creating said resistance to liquid flow.

44. Apparatus according to claim 36, further including a small orifice connected to said outlet of said valve means for creating said resistance to liquid flow.

45. Apparatus according to claim 36, further including an elevated spray nozzle connected to said outlet or said valve means by an elongated tube for creating said resistance to liquid flow.

46. Apparatus according to claim 36 wherein said pressure container is a length of flexible tubing having an inlet connected to a liquid supply means and an outlet connected to said valve means.

47. A normally open pulsating valve comprising:

(a) a casing defining an enclosed interior space therein;

(b) an inlet fitting extending through a part of said casing into said interior space, said inlet fitting defining a fluid inlet passage and a port, said fluid inlet passage and said port extending through and communicating with said interior space;

(c) an outlet fitting spaced apart from said inlet fitting and extending through a part of said casing into said interior space, said outlet fitting defining a fluid outlet passage extending therethrough and communicating with said interior space;

(d) an elastic tube located within said interior space defined by said casing, said elastic tube having an exterior surface and an interior with a path therethrough, (e) a first end of said elastic tube being connected with said inlet fitting and a second end of said elastic tube being connected with said outlet fitting;

(f) said fluid inlet passage and said fluid outlet passage communicating with said interior of said elastic tube so as to form a path for fluid to proceed through said inlet fitting into said elastic tube, and through said interior of said elastic tube into said outlet fitting, all within said interior space defined by said casing; and (g) means for supplying a quantity of fluid under pressure to both said port and said inlet passage defined by said inlet fitting;

(h) said elastic tube being long enough to develop a pressure drop along said path within said interior of said elastic tube, between said inlet fitting and said outlet fitting, during flow of fluid along said path, said pressure drop also creating a pressure difference between said interior of said elastic tube and a quantity of said fluid located in said interior space surrounding said exterior surface of said elastic tube;

(i) said elastic tube being smooth enough to collapse and flatten, closing said path through said interior of said elastic tube in response to said pressure drop and pressure difference, thus interrupting said flow of said fluid along said path intermittently.

48. An irrigation system, comprising:

(a) a source of pressurized liquid, (b) a distributor for discharging said liquid intermittently therefrom, and (c) a pulsator connected between said source and said distributor, said pulsator comprising:

(1) a pulsator inlet for receiving pressurized liquid therein from said source, (2) a pulsator outlet for emitting said liquid in intermittent pulses to said distributor, (3) a casing defining a cavity therein, (4) a mounting member disposed in said cavity, (5) elastomeric tube means, defining an expandable chamber therein and disposed between said casing and said mounting member, for movement from a normally contracted condition when said pressure of said liquid in said chamber falls below a predetermined level to an expanded condition when said pressure of said liquid in said chamber exceeds said predetermined level, (6) flow control means between said pulsator inlet and said chamber for modulating said pressure of said liquid at said pulsator inlet to control said flow rate of said liquid into said chamber, and (7) valve means, normally closed when said tube means is in its contracted condition and defined between said mounting member and said tube means, for intermittently opening to discharging liquid from said chamber through said pulsator outlet in said intermittent pulses at substantially regular frequencies and uniform discharges in response to said pressure of said liquid in said chamber intermittently exceeding said predetermined level.

* * * * *

UNITED STATES PATENT AND TRADEMARK OFFICE

CERTIFICATE OF CORRECTION

PATENT NO. : 5,507,436

DATED : APR. 16, 1996

INVENTOR(S) : G. RUTTENBERG

It is certified that error appears in the above-indentified patent and that said Letters Patent is hereby corrected as shown below:

Col. 1, l. 54, after "of" insert —a—.

Col. 1, l. 66, change "penetrates" to —penetrate—.

Col. 2, l. 18, after "fluid" delete the comma.

Col. 2, l. 20, change "fertilize" to —fertilizer—.

Col. 3, l. 9, change "where" to —were—.

Col. 4, line 16, after "have" insert —an—.

Col. 4, line 36, change "than" to —then—.

Col. 5, line 19, change ". The water hammer" to —the water hammer,—.

Col. 6, l. 41, after "have" insert —a—.

Col. 7, l. 50, after "of" insert —a—.

Col. 7, l. 54, change "Control" to —control—.

Col. 9, l. 15, change "valve" to —valves—.

Col. 15, l. 35, after "1" insert —,—.

Col. 16, line 25, delete "a".

Col. 16, line 35, change "ting" to —ring—.

Col. 17, line 49, change "ting" to —ring—.

Col. 17, line 51, change "ting" to —ring—.

Col. 18, line 21, change "ting" to —ring—.

Col. 21, line 5, change "fining" to —fitting—.

Col. 21, line 27, delete "from" (first occurrence).

Col. 21, line 46, after '"screen"' insert —,—.

UNITED STATES PATENT AND TRADEMARK OFFICE

CERTIFICATE OF CORRECTION

PATENT NO. : 5,507,436

DATED : APR. 16, 1996

INVENTOR(S) : G. RUTTENBERG

It is certified that error appears in the above-indentified patent and that said Letters Patent is hereby corrected as shown below:

Col. 23, line 23, delete "a".

Col. 23, line 35, change "A" to —a—.

Col. 24, l. 15, delete ",".

Col. 24, l. 35, change "Compressor" to —compressor—.

Col. 24, l. 39, after "pumping" insert —of—.

Col. 24, l. 40, after "of" insert —an—.

Col. 25, line 41, change "13 103" to —13103—.

Col. 25, line 41, change "a to" to —to a—.

Col. 25, line 65, change "having" to —have—

Col. 26, line 60, change "ff" to —if—.

Col. 29, line 14, change "fluid inlet," to —a fluid inlet, a—

Col. 29, line 26, change "red" to —rod—.

Col. 30, line 21, change "close" to —closed—

Col. 30, line 36, change "Pan" to —Part—.

UNITED STATES PATENT AND TRADEMARK OFFICE

CERTIFICATE OF CORRECTION

PATENT NO. : 5,507,436

DATED : APR. 16, 1996

INVENTOR(S) : G. RUTTENBERG

It is certified that error appears in the above-indentified patent and that said Letters Patent is hereby corrected as shown below:

Col. 31, line 4, change "close" to —closed—

Col. 32, line 2, change "4 104" to —4104—.

Col.32 , line 13, change "fiat" to —flat—.

Col. 35, line 52, change "8 102" to —8102—; change "8 103" to —8103—.

Col. 37, l. 48, delete ",".

Col. 38, l. 9, change "flow" to —flows—.

Col. 40, l. 19, change "he" to —the—.

Signed and Sealed this

Twenty-ninth Day of October 1996

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT : 5,507,436

DATED : Apr. 16, 1996

INVENTOR(S) : Gideon Ruttenberg

It is certified that error appears in the above-identified patent and that said Letters Patent is hereby corrected as shown below:

On the title page, item [63[, "Mar. 10, 1993, abandoned" should be --abandoned, filed as PCT/US90/05033, filed Sep. 10, 1990--.

Signed and Sealed this

Third Day of March, 1998

*Attest:*

Bruce Lehman

BRUCE LEHMAN

*Attesting Officer*

*Commissioner of Patents and Trademarks*

US005507436C1

(12) EX PARTE REEXAMINATION CERTIFICATE (5261st)

United States Patent
Ruttenberg

(10) Number: US 5,507,436 C1
(45) Certificate Issued: Jan. 31, 2006

(54) METHOD AND APPARATUS FOR CONVERTING PRESSURIZED LOW CONTINUOUS FLOW TO HIGH FLOW IN PULSES

(75) Inventor: Gideon Ruttenberg, 81-465 Date Palm Ave., Indio, CA (US) 92201

(73) Assignee: Gideon Ruttenberg, Indio, CA (US)

Reexamination Request:
No. 90/006,241, Mar. 8, 2002

Reexamination Certificate for:

| | |
|---|---|
| Patent No.: | **5,507,436** |
| Issued: | **Apr. 16, 1996** |
| Appl. No.: | **08/396,176** |
| Filed: | **Feb. 24, 1995** |

Certificate of Correction issued Oct. 29, 1996.

Certificate of Correction issued Mar. 3, 1998.

Related U.S. Application Data

(63) Continuation of application No. 07/988,946, filed as application No. PCT/US90/05033 on Sep. 10, 1990, now abandoned.

(51) Int. Cl.
*B05B 1/08* (2006.01)

(52) U.S. Cl. ..... 239/1; 239/99; 239/204; 239/412; 239/416.5; 239/428.5; 239/524; 239/547; 239/570; 137/624.14; 137/853; 137/895; 251/5

(58) Field of Classification Search ..... 239/1, 239/99, 101, 276, 428.8, 533.13, 547, 570, 239/204, 412, 416.5, 524; 137/624.14, 853, 137/895, 860, 843, 888; 251/4, 5, 342
See application file for complete search history.

(56) References Cited

U.S. PATENT DOCUMENTS

| | | | |
|---|---|---|---|
| 3,298,391 | A | 1/1967 | Savage |
| 3,624,801 | A | 11/1971 | Gannon |
| 3,687,365 | A | 8/1972 | Laessig |
| 3,739,952 | A | 6/1973 | Chafitz et al. |
| 3,883,074 | A | 5/1975 | Lambert |
| 3,902,664 | A | 9/1975 | Deines |
| 4,301,967 | A | 11/1981 | Hunter |
| 4,512,514 | A | 4/1985 | Elcott |
| 4,702,280 | A | 10/1987 | Zakai et al. |
| 4,955,539 | A | 9/1990 | Ruttenberg |

*Primary Examiner*—Lisa A. Douglas

(57) ABSTRACT

A device and method, especially adapted for operating sprinklers, shower heads etc. at low flow, converts low continuous liquid flow to a high intermittent and pulsating flow. The liquid is introduced at a controlled low rate of flow, such as by the use of a pressure-compensated dripper in a liquid supply line. The liquid then flows into a chamber which is somewhat expandable in volume. The pressure increases in the chamber while outflow of the liquid is restricted until pressure created by introduction of the liquid is sufficient to eject the fluid intermittently at a higher flow. This is achieved by utilizing a pressure-responsive valve in the liquid exit of the container. The valve has a preset pressure response designed for quick response to create a water hammer effect. The valve has openings which create a pumping effect to admix air or another liquid with the effluent stream. Sprinklers, shower heads, or any other spraying devices connected to this pulsator will spray liquids to a large designated area with only a very small fluid flow. A drip line connected to such a device may have very large openings, yet the flow through each such dripper can be very large. A preferred form of the pulsator is a pulsating valve in which the receptacle container and the other required elements for such a pulsating device are part of the valve itself.

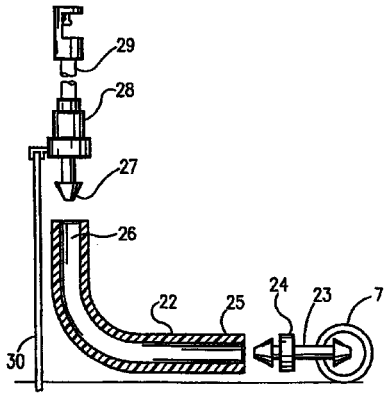

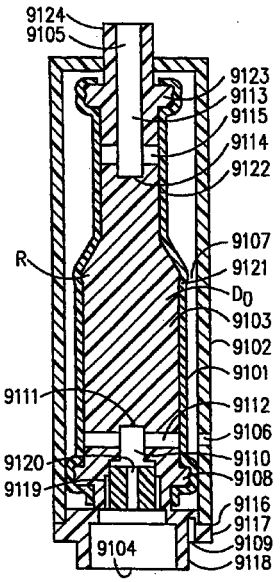

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 1, lines 9–12:

This *application* is a continuation of [parent] *U.S.* application Ser. No. 07/988,946, filed *Mar. 10,* 1993[Mar. 10], now abandoned[. This parent application is based upon PCT application Ser.], *which was the National Stage of International Application* No. PCT/US90/05033, filed *Sep. 10,* 1990[Sep. 10].

AS A RESULT OF REEXAMINATION, IT HAS BEEN DETERMINED THAT:

The patentability of claims 1–5 and 7–48 is confirmed.

Claim 6 is determined to be patentable as amended.

New claims 49–70 are added and determined to be patentable.

6. A pulsating device according to claim [2]*1*, further including a flow control means connected to said inlet of said pulsating device for controlling said continuous low rate of flow of fluid into said inlet of said pulsating device.

*49. The irrigation system of claim 48 wherein said mounting member has at least one rigid raised portion positioned adjacent said pulsator inlet, and said elastomeric tube means extends from said rigid raised portion toward said pulsator outlet.*

*50. The irrigation system of claim 48 wherein said mounting member has a pair of rigid raised portions, and said elastomeric tube means extends between and terminates adjacent said rigid raised portions.*

*51. The irrigation system of claim 48 wherein said mounting member has two ends, and include a tube-retaining portion adjacent each end thereof.*

*52. The irrigation system of claim 48 wherein said flow control means includes an elastic member having an orifice which, in response to inlet pressure changes, undergoes a deformation, causing the cross-section of the orifice to decrease at high inlet pressure and to increase at low inlet pressure.*

*53. The pulsating device of claim 48 wherein said insert outlet includes perforation disposed radially therein for receiving fluid from said expandable chamber.*

*54. The pulsating device of claim 48 wherein said insert extends continuously from said expandable chamber inlet to said expandable chamber outlet.*

*55. The pulsating device of claim 48 wherein said insert has a pair of ends and said elastic tube has ends that are substantially co-terminus with said insert ends.*

*56. A pulsating device having an inlet and an outlet for converting a continuous, relatively low, controlled fluid flow rate entering said inlet of said pulsating device to an intermittent and pulsating high rate of fluid flow ejected from said outlet of said pulsating device, comprising:*

*(a) an insert having an inlet, an outlet and an outer surface;*

*(b) an elastic tube which:*

*(1) normally surrounds and directly contacts at least a major portion of said insert,*

*(2) can be expanded away from said insert to form an expandable chamber between said outer surface of said insert and an inner surface of said elastic tube,*

*(c) said expandable chamber having (a) an inlet portion and (b) an outlet portion intermittently in fluid communication with said inlet and with said outlet of said insert,*

*(d) said inlet of said insert communicating with said inlet portion of said expandable chamber so that fluid flowing into said inlet of said insert will reach said inlet portion of said expandable chamber,*

*(e) said elastic tube, when in said normal state in direct contact with said insert, being shaped so that it directly closes said outlet portion of said expandable chamber so as to (1) prevent fluid communication between said inlet portion of said expandable chamber and said outlet portion of said expandable chamber, and (2) prevent flow of fluid out from said expandable chamber,*

*(f) said elastic tube, when partially expanded in response to fluid pressure within said inlet portion of said expandable chamber exceeding a first predetermined level, being shaped to form a fluid path between said inlet portion of said expandable chamber and said outlet portion of said expandable chamber,*

*(g) said elastic tube, when partially expanded, surrounding and being in contact with said insert in said outlet portion of said expandable chamber and thereby resisting flow of fluid out from said outlet portion of said expandable chamber to said outlet of said insert and thereby causing an increased pressure in said inlet portion of said expandable chamber, resulting in an additional expansion of said elastic tube and opening said outlet portion of said expandable chamber widely and quickly into communication with said outlet of said insert,*

*(h) said pulsating device thus ejecting fluid from said expandable chamber through said outlet of said insert at a high rate of flow so as to cause the volume and pressure of fluid within said expandable chamber to decrease and said elastic tube to close said outlet portion of said expandable chamber in response to decreased pressure, thereby to complete a cycle of an intermittent pulsating flow of fluid through said outlet of said pulsating device,*

*(i) flow control means connected to said inlet of said pulsating device for controlling said continuous low rate of flow of fluid into said inlet of said pulsating device, and*

*(j) a housing enclosing said insert and said elastic tube.*

*57. A pulsating device according to claim 56 wherein said elastic tube is also arranged to create a water hammer in response to said outlet portion of said chamber responding quickly and eject said fluid from said expandable chamber at increased pressure and velocity.*

*58. A pulsating device according to claim 57, further including an rigid annular barb on said insert between said*

*inlet and said outlet thereof, and wherein said elastic tube fully engages said rigid annular barb when said elastic tube normally closes said outlet portion of said expandable chamber.*

*59. A pulsating device according to claim 56 wherein said elastic tube has a length and has different respective diameters and wall thicknesses at selected locations along said length.*

*60. A pulsating device according to claim 56, further including dripper means connected to said inlet of said pulsating device for controlling said continuous low rate of flow of fluid into said inlet of said pulsating device.*

*61. A pulsating device according to claim 56 wherein said pulsating device is normally closed but said elastic tube is arranged to open said device to commence said pulsating flow in response to pressure of said fluid in said expandable chamber exceeding a second predetermined level.*

*62. The pulsating device of claim 61 wherein said insert outlet includes radially opposed portions to receive fluid from opposing sides of said expandable chamber.*

*63. The pulsating device of claim 56 wherein said insert extends continuously from said expandable chamber inlet to said expandable chamber outlet.*

*64. The pulsating device of claim 56 wherein said elastic tube is positioned between said housing and said insert.*

*65. The pulsating device of claim 56 wherein said insert having a pair of barbs disposed thereon, wherein said elastic tube having ends that are affixed to and terminated at said barbs.*

*66. A method for converting a continuous fluid flow at a low rate of flow to high intermittent pulsating flow at a high rate of flow, comprising:*

*(a) supplying fluid at a low controlled flow rate into a receptacle having a relatively low elasticity, said receptacle having an integral fluid inlet means and an integral fluid outlet means;*

*(b) establishing a body of said fluid under pressure in said receptacle;*

*(c) said integral fluid outlet means of said receptacle preventing outflow of said fluid from said receptacle until a predetermined pressure is achieved in said receptacle;*

*(d) said outlet means of said receptacle allowing said fluid to flow out from said receptacle through a resistance so as to force the pressure within said receptacle to increase and force said outlet means to become widely open;*

*(e) ejecting said fluid from said receptacle and through said resistance at a high rate of flow as a pulse while fluid continues to flow into said receptacle at said low controlled flow rate and, by ejecting said fluid, causing the pressure and the volume of fluid within said receptacle to decrease and allowing said outlet means to close and terminate one pulsating cycle,*

*(f) said supplying fluid being done with a liquid fluid,*

*(g) supplying said liquid at a relatively constant continuous controlled rate automatically to said receptacle and allowing said liquid to flow out of said receptacle through said outlet means until said pressure in said receptacle is diminished to a predetermined level,*

*(h) at the same time (1) restricting said outflow sufficiently to create a water hammer effect to generate a high pressure liquid pulse, and (2) quickly discontinuing emission of liquid until said pressure within said receptacle is again increased to said predetermined level, and*

*(i) repeating said sequence continuously for a desired period of time to produce said high intermittent pulsating flow.*

*67. The method according to claim 66 wherein said supplying liquid fluid is water, and the method further includes discharging said water adjacent to growing plants for irrigation purposes.*

*68. A pulsating device having an inlet and an outlet for converting a continuous, relatively low, controlled fluid flow rate entering said inlet of said pulsating device to an intermittent and pulsating high rate of fluid flow ejected from said outlet of said pulsating device, comprising:*

*(a) an insert having an inlet, an outlet and an outer surface;*

*(b) an elastic tube having its entire length surrounds and normally in direct contact with said outer surface of said insert, wherein said elastic tube can be expanded away from said insert to form an expandable chamber defined by said outer surface of said insert and an inner surface of said elastic tube,*

*(c) said expandable chamber having (a) an inlet portion and (b ) an outlet portion intermittently in fluid communication with said inlet and with said outlet of said insert,*

*(d) said inlet of said insert communicating with said inlet portion of said expandable chamber so that fluid flowing into said inlet of said insert will reach said inlet portion of said expandable chamber,*

*(e ) said elastic tube, when in said normal state in direct contact with said insert, being shaped so that it directly closes said outlet portion of said expandable chamber so as to (1) prevent fluid communication between said inlet portion of said expandable chamber and said outlet portion of said expandable chamber, and (2) prevent flow of fluid out from said expandable chamber,*

*(f) said elastic tube, when partially expanded in response to fluid pressure within said inlet portion of said expandable chamber exceeding a first predetermined level, being shaped to form a fluid path between said inlet portion of said expandable chamber and said outlet portion of said expandable chamber,*

*(g) said elastic tube, when partially expanded, surrounding and being in contact with said insert in said outlet portion of said expandable chamber and thereby resisting flow of fluid out from said outlet portion of said expandable chamber to said outlet of said insert and thereby causing an increased pressure in said inlet portion of said expandable chamber, resulting in an additional expansion of said elastic tube and opening said outlet portion of said expandable chamber widely and quickly into communcation with said outlet of said insert,*

*(h) said pulsating device thus ejecting fluid from said expandable chamber through said outlet of said insert at a high rate of flow so as to cause the volume and pressure of fluid within said expandable chamber to decrease and said elastic tube to close said outlet portion of said expandable chamber in response to decreased pressure, thereby to complete a cycle of an intermittent puslating flow of fluid through said outlet of said pulsating device.*

*69. The device of claim 68 further comprising a rigid housing mounted over and affixed to at least one end of said insert.*

*70. The device of claim 69 further comprising a flow control means connected to said inlet of said insert for controlling said low rate of flow of fluid through said inlet of said insert into said inlet portion of said expandable chamber.*

* * * * *